US006611261B1

(12) United States Patent
Zhang et al.

(10) Patent No.: US 6,611,261 B1
(45) Date of Patent: Aug. 26, 2003

(54) LIQUID CRYSTAL DISPLAY DEVICE HAVING REDUCED NUMBER OF COMMON SIGNAL LINES

(75) Inventors: Hong Yong Zhang, Kawasaki (JP); Kazuhiro Takahara, Kawasaki (JP)

(73) Assignee: Fujitsu Display Technologies Corp., Kawasaki (JP)

( * ) Notice: Subject to any disclaimer, the term of this patent is extended or adjusted under 35 U.S.C. 154(b) by 70 days.

(21) Appl. No.: 09/619,593

(22) Filed: Jul. 19, 2000

(30) Foreign Application Priority Data

Jul. 21, 1999 (JP) ..... 11-206822

(51) Int. Cl.[7] ..... E09G 3/36

(52) U.S. Cl. ..... 345/204; 345/1.1; 345/30; 345/42; 345/55; 345/87; 345/90; 345/99; 345/100; 345/103

(58) Field of Search ..... 345/1.1, 30, 42, 345/55, 87, 90, 99, 100, 103, 204

(56) References Cited

U.S. PATENT DOCUMENTS 5,264,835 A * 11/1993 Shaw et al. ..... 345/694
5,266,936 A * 11/1993 Saitoh ..... 345/89
5,313,631 A 5/1994 Kao
5,777,591 A * 7/1998 Katoh et al. ..... 345/103
5,877,740 A * 3/1999 Hirakata et al. ..... 345/1.1
5,944,789 A 8/1999 Tzelnic
5,966,707 A 10/1999 VanHuben et al.
6,065,019 A 5/2000 Ault et al.
6,065,100 A 5/2000 Schafer et al.
6,300,930 B1 * 10/2001 Mori ..... 345/94
6,329,980 B1 * 12/2001 Uehara et al. ..... 208/87
6,344,841 B1 * 2/2002 Moon ..... 315/169.4
6,362,863 B1 * 3/2002 Kataoka et al. ..... 349/123
6,388,722 B1 * 5/2002 Yoshii et al. ..... 349/58
6,391,690 B2 * 5/2002 Miyasaka ..... 438/149
6,404,470 B1 * 6/2002 Kim et al. ..... 349/110

* cited by examiner

*Primary Examiner*—Bipin Shalwala
*Assistant Examiner*—Vincent E. Kovalick
(74) *Attorney, Agent, or Firm*—Greer, Burns & Crain, Ltd.

(57) ABSTRACT

A liquid-crystal-display device which displays an image on display matrix by supplying video signals to pixel cells of the display matrix includes a data driver supplying the video signals to the display matrix and including N digital drivers, N×k common-signal lines, and N×k×n switch blocks, wherein every k lines of the N×k common-signal lines are connected to a corresponding one of the N digital drivers, and every n blocks of the N×k×n switch blocks are connected to a corresponding one of the N×k common-signal lines, each of the common-signal lines being comprised of m lines and each of the switch blocks includes m selection switches, which couples the common-signal lines to the pixel cells of the display matrix.

16 Claims, 42 Drawing Sheets

FIG. 5

| PHYSICAL BLOCK / TIMING BLOCK | | A (DB) | | | B (DB) | | | … | N (DB) | | |
|---|---|---|---|---|---|---|---|---|---|---|---|
| | | A1~Ak (CB) | | | B1~Bk (CB) | | | … | N1~Nk (CB) | | |
| ONE HORIZONTAL SCAN PERIOD Th | BL1 | A11 (SB) | … | Ak1 (SB) | B11 (SB) | … | Bk1 (SB) | … | N11 (SB) | … | Nk1 (SB) |
| | BL2 | A12 | … | Ak2 | B12 | … | Bk2 | … | B12 | … | Nk2 |
| | BL3 | A13 | … | Ak3 | B13 | … | Bk3 | … | B13 | … | Nk3 |
| | ⋮ | ⋮ | ⋮ | ⋮ | ⋮ | ⋮ | ⋮ | … | ⋮ | ⋮ | ⋮ |
| | BLn-2 | Aln-2 | … | Akn-2 | Bln-2 | … | Bkn-2 | … | Nln-2 | … | Nkn-2 |
| | BLn-1 | Aln-1 | … | Akn-1 | Bln-1 | … | Bkn-1 | … | Nln-1 | … | Nkn-1 |
| | BLn | Aln | … | Akn | Bln | … | Bkn | … | Nln | … | Nkn |

FIG. 11

| PHYSICAL BLOCK / TIMING BLOCK | A 1 (CB) | A 2 (CB) | TOTAL |
|---|---|---|---|
| BL 1 | A11 | A21 | 384 BIT |
| BL 2 | A12 | A22 | 384 BIT |
| BL 3 | A13 | A23 | 384 BIT |
| BL 4 | A14 | A24 | 384 BIT |
| BL 5 | A15 | A25 | 384 BIT |
| BL 6 | A16 | A26 | 384 BIT |
| BL 7 | A17 | A27 | 384 BIT |
| BL 8 | A18 | A28 | 384 BIT |
| TOTAL | 1536 BIT (192×8) | 1536 BIT (192×8) | 3072 BIT (384×8) |

FIG. 14

| PHYSICAL BLOCK / TIMING BLOCK | A 1 (CB) | A 2 (CB) | TOTAL |
|---|---|---|---|
| BL 1 | A11 | A21 | 384 BIT |
| BL 2 | A12 | A22 | 384 BIT |
| BL 3 | A13 | A23 | 384 BIT |
| BL 4 | A14 | A24 | 384 BIT |
| BL 5 | A15 | A25 | 384 BIT |
| BL 6 | A16 | A26 | 384 BIT |
| BL 7 | A17 | A27 | 384 BIT |
| BL 8 | A18 | A28 | 384 BIT |
| BL 9 | A19 | A29 | 384 BIT |
| BL10 | A110 | A210 | 384 BIT |
| TOTAL | 1920 BIT (192×10) | 1920 BIT (192×10) | 3840 BIT (384×10) |

FIG. 21

| PHYSICAL BLOCK / TIMING BLOCK | A 1 (No. 1) | B 1 (No. 2) | C 1 (No. 3) | D 1 (No. 4) | TOTAL |
|---|---|---|---|---|---|
| BL 1 | A11 | B11 | C11 | D11 | 1536 BIT |
| BL 2 | A12 | B12 | C12 | D12 | 1536 BIT |
| BL 3 | A13 | B13 | C13 | D13 | 1536 BIT |
| BL 4 | A14 | B14 | C14 | D14 | 1536 BIT |
| TOTAL | 1536 BIT (384×4) | 1536 BIT (384×4) | 1536 BIT (384×4) | 1536 BIT (384×4) | 6144 BIT (1536×4) |

FIG. 25

| PHYSICAL BLOCK / TIMING BLOCK | A 1 (No. 1) | B 1 (No. 2) | C 1 (No. 3) | D 1 (No. 4) | TOTAL |
|---|---|---|---|---|---|
| BL 1 | A11 | B11 | C11 | D11 | 1536 BIT |
| BL 2 | A12 | B12 | C12 | D12 | 1536 BIT |
| BL 3 | A13 | B13 | C13 | D13 | 1536 BIT |
| BL 4 | A14 | B14 | C14 | D14 | 1536 BIT |
| BL 5 | A15 | B15 | C15 | D15 | 1536 BIT |
| TOTAL | 1536 BIT (384×5) | 1536 BIT (384×5) | 1536 BIT (384×5) | 1536 BIT (384×5) | 7680 BIT (1536×5) |

FIG. 28

| PHYSICAL BLOCK / TIMING BLOCK | A1 (CB) | A2 (CB) | B1 (CB) | B2 (CB) | TOTAL |
|---|---|---|---|---|---|
| BL1 | A11 | A21 | B11 | B21 | 768 BIT |
| BL2 | A12 | A22 | B12 | B22 | 768 BIT |
| BL3 | A13 | A23 | B13 | B23 | 768 BIT |
| BL4 | A14 | A24 | B14 | B24 | 768 BIT |
| TOTAL | 768 BIT (192×4) | 768 BIT (192×4) | 768 BIT (192×4) | 768 BIT (192×4) | 3072 BIT (768×4) |

FIG. 31

| PHYSICAL BLOCK / TIMING BLOCK | A 1 (CB) | A 2 (CB) | B 1 (CB) | B 2 (CB) | TOTAL |
|---|---|---|---|---|---|
| BL 1 | A11 | A21 | B11 | B21 | 768 BIT |
| BL 2 | A12 | A22 | B12 | B22 | 768 BIT |
| BL 3 | A13 | A23 | B13 | B23 | 768 BIT |
| BL 4 | A14 | A24 | B14 | B24 | 768 BIT |
| BL 5 | A15 | A25 | B15 | B25 | 768 BIT |
| TOTAL | 960 BIT (192×5) | 960 BIT (192×5) | 960 BIT (192×5) | 960 BIT (192×5) | 3840 BIT (768×5) |

FIG. 36

| CLASSIFICATION | ITEM | UNIT | SPECIFICATION |
|---|---|---|---|
| MEASUREMENT | TYPE OF LIQUID-CRYSTAL DISPLAY | --- | INTEGRAL TYPE INCLUDING LOW-TEMPERATUR P-Si PERIPHERAL CIRCUITRY |
| | PANEL TYPE (DIAGONAL LENGTH) | INCH (cm) | 15 INCH (38cm) |
| | DISPLAY FORMAT | | QXGA (XCA) |
| | DISPLAY MATRIX | pixel | (2048×3)×1536 |
| | NUMBER OF PIXELS | pixel | 9437,184 (~944万) |
| | PIXEL SIZE | mm | (0・0495×3)×0・1485 |
| | MEASUREMENTS OF UNIT EXTERIOR | mm | 374・3×264・3×21・0 |
| | PANEL (TFT) MEASUREMENT | mm | 315・55×239・30±・30 |
| | CF BOARD | mm | 312・55×236・30±・30 |
| | POLARIZATION BOARD (TFT) | mm | 308・00×232・00±・30 |
| | POLARIZATION BOARD (CF) | mm | 311・35×235・10±・30 |
| | EFFECTIVE DISPLAY AREA | mm | 311・35×235・10±・30 |
| OPTICAL/INPUT SPECIFICATION | DISPLAY TYPE | | TFT-DRIVEN NORMAL BLACK |
| | WIDE-VIEW-ANGLE METHOD | | MVA (MULTI-DOMAIN VA) |
| | NUMBER OF DOMAIN DIVISIONS | | 4 DOMAINS/PIXEL |
| | COLORS | | 16,700K COLOR (8 BIT) / 260K (8 BIT) |
| | DISPLAY LEVELS | | 256 LEVEL /64 LEVEL |
| | BACK-LIGHT | | 4 COLD-CATHODE TUBES (2 ON TOP /2 AT BUTTOM) |
| | INPUT DATA | | 8 BIT / 6 BIT (DIGITAL) |
| | | | |

FIG. 37

| PHYSICAL BLOCK / TIMING BLOCK | A (DB LAYER) | | B (DB LAYER) | | C (DB LAYER) | | D (DB LAYER) | | TOTAL |
|---|---|---|---|---|---|---|---|---|---|
| | A1 (CB) | A2 (CB) | B1 (CB) | B2 (CB) | C1 (CB) | C2 (CB) | D1 (CB) | D2 (CB) | |
| BL1 | A11 (SB) | A21 (SB) | B11 (SB) | B21 (SB) | C11 (SB) | C21 (SB) | D11 (SB) | D21 (SB) | 1536 BIT |
| BL2 | A12 (SB) | A22 (SB) | B12 (SB) | B22 (SB) | C12 (SB) | C22 (SB) | D12 (SB) | D22 (SB) | 1536 BIT |
| BL3 | A13 (SB) | A23 (SB) | B13 (SB) | B23 (SB) | C13 (SB) | C23 (SB) | D13 (SB) | D23 (SB) | 1536 BIT |
| BL4 | A14 (SB) | A24 (SB) | B14 (SB) | B24 (SB) | C14 (SB) | C24 (SB) | D14 (SB) | D24 (SB) | 1536 BIT |
| TOTAL | 768 BIT 192×4 | 768 BIT 192×4 | 768 BIT 192×4 | 768 BIT 192×4 | 768 BIT 192×4 | 768 BIT 192×4 | 768 BIT 192×4 | 768 BIT 192×4 | 6144 BIT 1536× 4 |

FIG. 42

| PHYSICAL BLOCK / TIMING BLOCK | A (DB LAYER) | | B (DB LAYER) | | C (DB LAYER) | | D (DB LAYER) | | TOTAL |
|---|---|---|---|---|---|---|---|---|---|
| | A1 (CB) | A2 (CB) | B1 (CB) | B2 (CB) | C1 (CB) | C2 (CB) | D1 (CB) | D2 (CB) | |
| BL1 | A11 (SB) | A21 (SB) | B11 (SB) | B21 (SB) | C11 (SB) | C21 (SB) | D11 (SB) | D21 (SB) | 1536 BIT |
| BL2 | A12 (SB) | A22 (SB) | B12 (SB) | B22 (SB) | C12 (SB) | C22 (SB) | D12 (SB) | D22 (SB) | 1536 BIT |
| BL3 | A13 (SB) | A23 (SB) | B13 (SB) | B23 (SB) | C13 (SB) | C23 (SB) | D13 (SB) | D23 (SB) | 1536 BIT |
| BL4 | A14 (SB) | A24 (SB) | B14 (SB) | B24 (SB) | C14 (SB) | C24 (SB) | D14 (SB) | D24 (SB) | 1536 BIT |
| BL5 | A15 (SB) | A25 (SB) | B15 (SB) | B25 (SB) | C15 (SB) | C25 (SB) | D15 (SB) | D25 (SB) | 1536 BIT |
| TOTAL | 960 BIT 192×5 | 960 BIT 192×5 | 960 BIT 192×5 | 960 BIT 192×5 | 960 BIT 192×5 | 960 BIT 192×5 | 960 BIT 192×5 | 960 BIT 192×5 | 7686 BIT 1536× 5 |

LIQUID CRYSTAL DISPLAY DEVICE HAVING REDUCED NUMBER OF COMMON SIGNAL LINES

BACKGROUND OF THE INVENTION

1. Field of the Invention

The present invention generally relates to liquid-crystal-display devices, and particularly relates to a liquid-crystal-display device that is of a type having peripheral circuits integrated therein, and is capable of displaying a large and fine screen.

2. Description of the Related Art

In recent years, there has been a demand for a large-scale fine display as well as for a small-scale fine display. Such a demand has led to an increase in popularity of liquid-crystal-display devices using p-SiTFTs (poly-silicon thin film transistors), which allows the liquid-crystal display unit and peripheral circuits to be formed as an integrated device.

One type of liquid-crystal-display devices, which is relevant to the present invention, has a liquid-crystal-display area thereof divided into a plurality of blocks, and a video signal is written into the blocks one block after another. Hereinafter, such a driving method is referred to as a simple-block-succession method.

FIG. 1 is a block diagram of a liquid-crystal-display device 10 which is an example of a liquid-crystal-display device driven by the simple-block-succession method.

As shown in FIG. 1, the liquid-crystal-display device 10 includes a digital driver LSI 12, common-signal lines D1 through Dn, analog switches 14, block-control lines BL, a gate driver 16, and a display matrix 18. The digital driver LSI 12, the common-signal lines D1 through Dn, the analog switches 14, etc., together form a data driver 19.

The display matrix 18 is divided into N blocks B1 through BN, and each block is provided with scan lines 20 and signal lines 22 arranged in a matrix form. At intersections of the scan lines 20 and the signal lines 22 are situated pixel cells 24.

The analog switches 14 include as many as n switches provided for each of the blocks B1 through BN. The analog switches 14 are connected to the common-signal lines D1 through Dn via lead lines 31. Each of the analog switches 14 is also connected to the block-control lines BL. The analog switches 14 are turned on when block-control signals BL1 through BLN are supplied through the block-control lines BL.

The digital driver LSI 12 receives digital signals from an external data-supply device (not shown), and generates video signals Vs based on the received digital signal. The digital driver LSI 12 supplies the video signals Vs to each of the blocks B1 through BN via the common-signal lines D1 through Dn on a time-division basis.

When the liquid-crystal-display device 10 operates, a scan signal Vg supplied from the gate driver 16 activates successively the pixel cells 24 one line after another. In the liquid-crystal-display device 10, a horizontal scan period Th is comprised of N block-control periods Tb. During the first block-control period Tb, the block-control signal BL1 turns on n analog switches 14 that are connected to the signal lines 22 within the block B1. During the second block-control period Tb, the block-control signal BL2 turns on n analog switches 14 that are connected to the signal lines 22 inside the block B2. Further, during the N-th block-control period Tb that is the last in one horizontal scan period Th, n analog switches 14 connected to the signal lines 22 in the block BN are turned on by the block-control-signal BLN. Video signals Vs generated by the digital driver LSI 12 are supplied through the turned-on analog switches 14 to the activated pixel cells 24, thereby effecting liquid-crystal display.

FIG. 2 is a block diagram for explaining configurations of the data driver 19 and the display matrix 18 provided in the liquid-crystal-display device 10. FIG. 2 shows a configuration of n being 384 and N being 10 in the configuration of FIG. 1. Namely, the display matrix 18 is divided into 10 blocks, and the number of horizontal pixels is 3840 (=384×10).

As shown in FIG. 2, the data driver 19 includes the digital driver LSI 12, the common-signal lines D1 through D384, the analog switches 14, etc. The digital driver LSI 12 has 384-bit outputs, which correspond to the common-signal lines D1 through D384. The analog switches 14 are provided as many as 384 for each of the blocks B1 through B10. The common-signal lines D1 through D384 are connected to a corresponding one of the analog switches 14 in each of the blocks B1 through B10.

In general, one horizontal scan period Th becomes shorter as size of the liquid-crystal-display area increases. In the VGA format having 640×3(RGB)×480 pixels, the horizontal scan period Th is approximately 34.6 μs whereas in the QXGA format having 2048×3×1536 pixels, the horizontal scan period Th is approximately 10.8 μs.

In the liquid-crystal-display device 10 described above, a time period required for writing signals in one block, i.e., the block-control period Tb, is determined by 1 horizontal scan period Th/the number of blocks N. As the horizontal scan period Th decreases with an increase in size of the display area, the block-control periods Tb also decreases.

In order to maintain a sufficient block-control periods Tb, width of each block may be widened, and the number N of the blocks may be decreased. When this measure is taken, however, the problem as follows will be encountered.

As shown in FIG. 1, the liquid-crystal-display device 10 has a data width (number of bits) of one block being equal to the number n of the common-signal lines D1 through Dn. When the data width is increased, the number of the common-signal lines is also increased, resulting in an increase in space required for the wiring of the signal lines. This makes larger the frame size of the display panel of the liquid-crystal-display device 10.

For example, when an XGA panel having 3072 horizontal pixels and a 22-microsecond horizontal scan period Th is implemented by using 8 blocks having the data width of 384 bits, the block-control periods Tb will be longer than 2.0 μs. In order to achieve a 2.0-microsecond block-control periods Tb by using a QXGA panel having 6144 horizontal pixels and an 11-microsecond horizontal scan period Th, 4 blocks each having a data width of 1536 bits must be used. In this case, assuming that the wiring pitch is 16 μm, the wiring width of the common-signal lines D1 to D384 in the XGA panel is 6.14 mm (16 μm×384 bits). In contrast, the wiring width of the common-signal lines D1 to D1536 of the QXGA panel is 24.6 mm (16 μm×1536 bits). This is quite a wide width.

Further, when the digital driver LSI 12 is used as an external attachment to the liquid-crystal-display device 10, an increase in the width of the common-signal lines D1 through Dn results in an increase in the number of outputs of the digital driver LSI 12. Consequently, the digital driver LSI 12 becomes highly expensive, and the yield in the manufacturing process decreases.

Moreover, widening the data width leads to an increase in the number of intersections of the common-signal lines D1 through Dn and the lead lines 31 shown in FIG. 1, resulting in the capacitance load on the common-signal lines D1 through Dn being increased. This means an increased time constant. In the QXGA panel, for example, a single common-signal line may have more than 6144 intersections. In such a case, the capacitance load of one intersection point may be 4 fF, for example, and, then, the total capacitance may be as large as 25 pF.

As shown in FIG. 1, the liquid-crystal-display device 10 has the common-signal lines D1 through Dn the length approximately equal to the width of the display matrix 18. As the size of the display matrix 18 is increased, therefore, the length of the common-signal lines D1 through Dn is also increased. The resulting increase in the wiring resistance contributes to a rise in the time constant.

Accordingly, there is a need for a liquid-crystal-display device which can provide high image quality, yet is small in size and provided at low cost.

SUMMARY OF THE INVENTION

It is a general object of the present invention to provide a liquid-crystal-display device that substantially obviates one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by the liquid-crystal-display device particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides a liquid-crystal-display device which displays an image on display matrix by supplying video signals to pixel cells of the display matrix, the liquid-crystal-display device including a data driver supplying the video signals to the display matrix and including N digital drivers, N×k common-signal lines, and N×k×n switch blocks, wherein every k lines of the N×k common-signal lines are connected to a corresponding one of the N digital drivers, and every n blocks of the N×k×n switch blocks are connected to a corresponding one of the N×k common-signal lines, each of the common-signal lines being comprised of m lines and each of the switch blocks includes m selection switches, which couples the common-signal lines to the pixel cells of the display matrix.

In the liquid-crystal-display device described above, each digital driver has k common-signal lines connected thereto, so that the number m of signal lines that constitute any given one of the common-signal lines can be 1/k of that of the related-art configuration. This makes it possible to make the wiring width of the common-signal lines 1/k as wide as the related art. As a result, the size of panel frames can be reduced.

Further, since the number m of the signal lines in each of the common-signal lines is 1/k of that of the related art, the common-signal lines intersect with lead lines at 1/k as many locations as in the related art where the lead lines connect between the common-signal lines and the selection switches. This reduces intersection capacitance of the common-signal lines.

Further, the present invention allows digital drivers having a relatively small number of outputs to be used, which leads to a cost reduction of the digital drivers.

According to another aspect of the present invention, the liquid-crystal-display device as described above is such that one horizontal scan period includes n timing periods, during each of which one of the every n blocks of the N×k×n switch blocks is selected by a control signal, the digital drivers supplying the video signals to the pixel cells that are connected by the selection switches of the selected switch blocks.

In the liquid-crystal-display device described above, switch blocks are selected one each for a corresponding one of the common-signal lines during each timing period, which makes it possible to write video signals as data having a wide data width without increasing the wiring width of the common-signal lines and without increasing the capacitance load and the resistance load.

According to another aspect of the present invention, the liquid-crystal-display device as described above is such that the data driver includes first through third layers, the digital drivers being arranged in line in the first layer, the common-signal lines being arranged in line in the second layer, and the switch blocks being arranged in line in the third layer.

When the common-signal lines having 1/k of the horizontal extension of the related art are arranged in one line, the wiring resistance of each common-signal line becomes 1/k as small. In the liquid-crystal-display device of the present invention, reductions in the intersection capacitance and the wiring resistance result in a significant decrease in the RC time constant. Therefore, the present invention can improve image quality by the improved time constant.

Further, if the digital drivers are implemented as a panel-built-in circuit based on p-SiTFT that helps to reduce circuit size, a reduction of power consumption can be achieved. Since the number of TFTs constituting the digital drivers can also be reduced, a yield of the manufacturing process is also improved. Further, the present invention can widen the pitch of output terminals of the digital drivers.

BRIEF DESCRIPTION OF THE DRAWINGS

FIG. 5 is a table showing control timings of switch blocks during a horizontal scan period in the liquid-crystal-display device of FIG. 3;

FIG. 11 is a table showing control timings of switch blocks during one horizontal scan period of the liquid-crystal-display device of FIG. 6;

FIG. 14 is a table showing control timings of switch blocks during one horizontal scan period of the liquid-crystal-display device of the second embodiment;

FIG. 21 is a table showing control timings of switch blocks during one horizontal scan period of the liquid-crystal-display device of FIG. 19;

FIG. 25 is a table showing control timings of switch blocks during one horizontal scan period Th of the liquid-crystal-display device of FIG. 24;

FIG. 28 is a table showing control timings of switch blocks during one horizontal scan period of the liquid-crystal-display device of FIG. 26;

FIG. 31 is a table showing control timings of switch blocks during one horizontal scan period of the liquid-crystal-display device of FIG. 30;

FIG. 36 is a table showing an example of design specifications of the liquid-crystal-display device of FIG. 32;

FIG. 37 is a table showing control timings of switch blocks during one horizontal scan period of the liquid-crystal-display device of FIG. 32;

FIG. 42 is a table showing control timings of switch blocks during one horizontal scan period of the liquid-crystal-display device of FIG. 41.

DESCRIPTION OF THE PREFERRED EMBODIMENTS

A principle of the present invention resides in a noble configuration in which a data driver has N digital drivers, N×k common-signal lines, and N×k×n switch blocks including a predetermined selection switches therein, wherein switch blocks are successively selected one after another at predetermined timings from the n switch blocks for each of the N×k common-signal lines, and the selection switches of the selected switch blocks allow passage of video signals from the digital drivers to pixel cells.

A basic configuration of the present invention will be described with reference to FIG. 3, FIG. 4, and FIG. 5.

Figure 3:
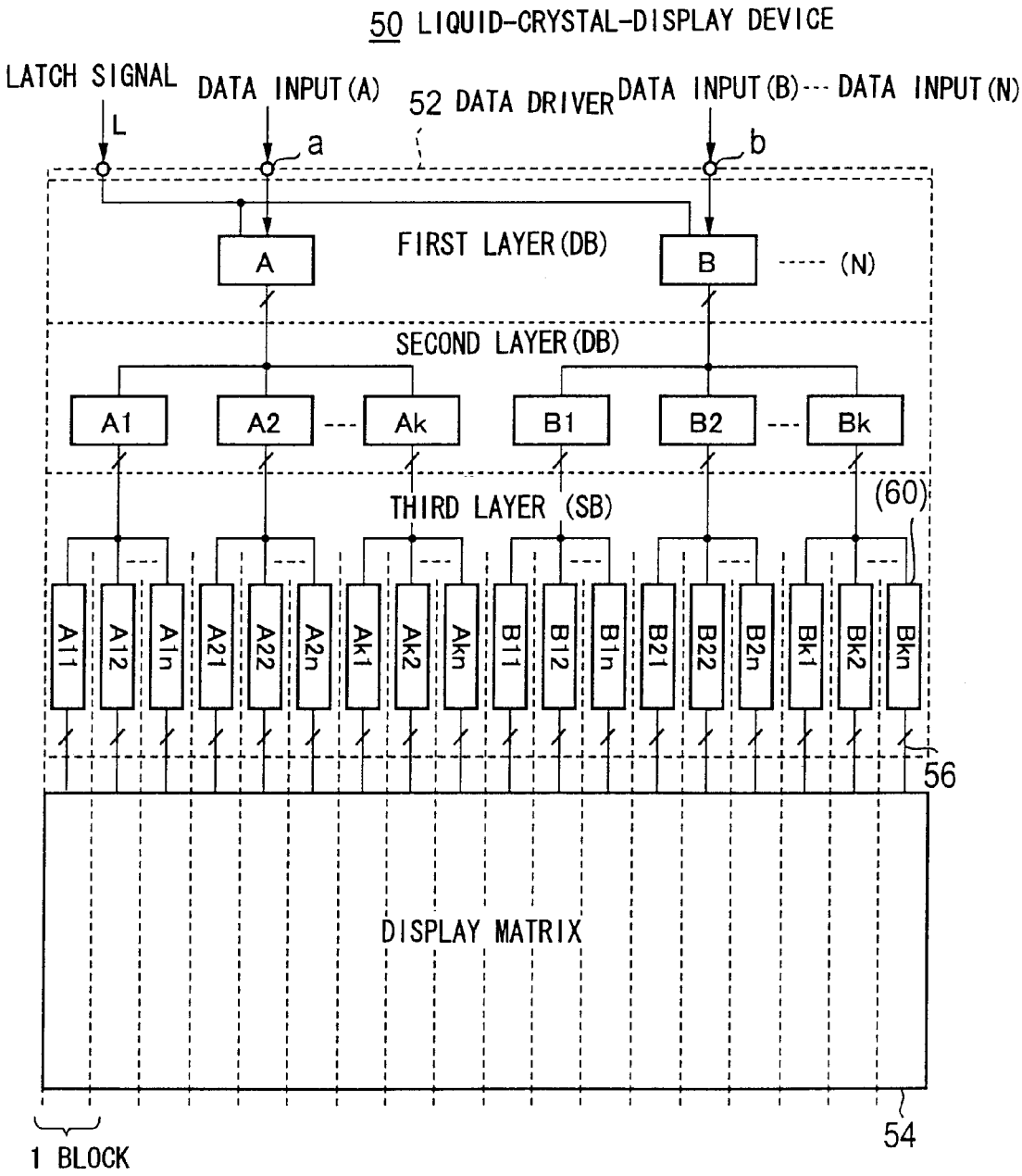
FIG. 3 is an illustrative drawing for explaining a basic configuration of the present invention.

FIG. 3 is an illustrative drawing for explaining the basic configuration of the present invention.

As shown in FIG. 3, a liquid-crystal-display device 50 of the present invention includes a data driver 52 and a display matrix 54. The data driver 52 has a hierarchical structure which includes a first layer DB, a second layer CB, and a third layer SB.

The first layer DB has N digital driver ICs A, B, . . . provided therein. Hereinafter, these digital driver ICs will be referred to simply as drivers. The second layer CB has N×k common-signal lines A1, A2, . . . provided therein. Further, the third layer SB has N×K×n switch blocks A11, A12, . . . provided therein. Here, N, k, and n are integers.

The drivers A, B, . . . are controlled by a latch signal L supplied from a control circuit (not shown) externally provided. Further, the drivers A, B, . . . receive data for liquid-crystal display at data-input nodes a, b, . . . , respectively, where the data is supplied from a data-supply device (not shown) externally provided.

The N drivers A, B, . . . provided in the first layer DB are each connected to k common-signal lines provided in the second layer CB. For example, the driver A is connected to common-signal lines A1 through Ak, and the driver B is connected to common-signal lines B1 through Bk. Further, N×k common-signal lines A1 through Ak, B1 through Bk, . . . are each connected to n switch blocks provided in the third layer SB. For example, the common-signal line A1 is connected to switch blocks A11 to A1n, and the common-signal line A2 is connected to switch blocks A21 to A2n. By the same token, the common-signal line Ak is connected to switch blocks Ak1 to Akn.

The switch blocks A11, A12, . . . are comprised of a predetermined number of selection switches 60 as will be described later. The selection switches 60 are each connected to signal lines 56 extending in the display matrix 54. The display matrix 54 is divided into N×k×n blocks corresponding to the respective switch blocks A11, A12, . . . .

Figure 4:
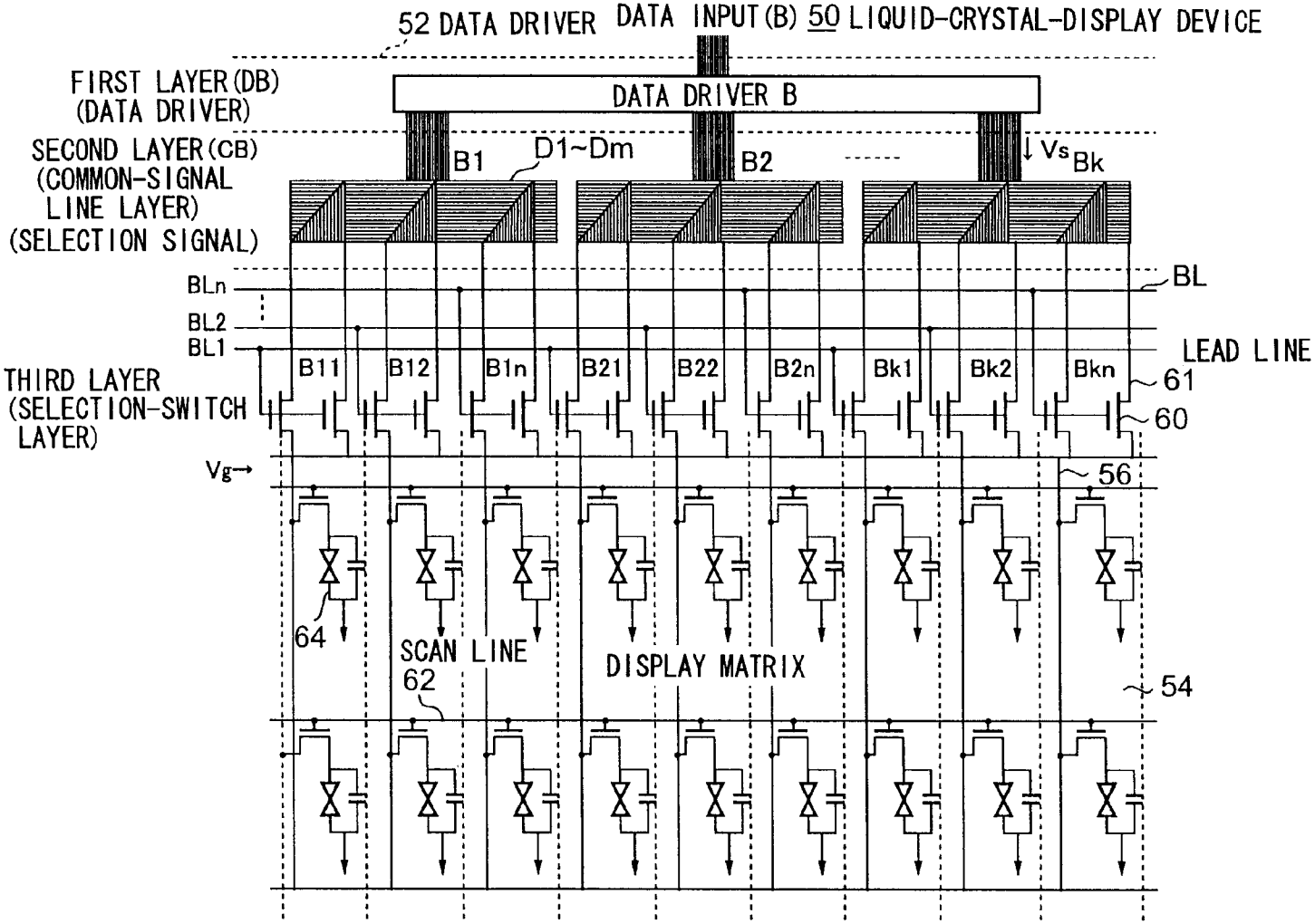
FIG. 4 is an illustrative drawing showing a configuration of a driver of the liquid-crystal-display device shown in FIG. 3.

FIG. 4 is an illustrative drawing showing a configuration of the driver B of the liquid-crystal-display device 50.

As shown in FIG. 4, the driver B is connected to the common-signal lines B1 through Bk, and supplies video signals Vs to the common-signal lines B1 through Bk at predetermined timings. The common-signal lines B1 through Bk are each comprised of m signal lines D1 through Dm. Each of the switch blocks B11, B12, . . . , and Bkn is provided with the selection switches 60 as many as there are m signal lines D1 through Dm, which constitute each of the common-signal lines B1 through Bk. Within each of the switch blocks B11, B12, . . . , and Bkn, each of the selection switches 60 is connected to a corresponding one of the signal lines D1 through Dm via a lead line 61. For example, the selection switches 60 of any given one of the switch blocks B11 through B1n are connected to the respective signal lines D1 through Dm of the common-signal line B1, and the selection switches 60 of any given one of the switch blocks B21 through B2n are connected to the respective signal lines D1 through Dm of the common-signal line B2. Within each of the switch blocks B11, B12, . . . , and Bkn, the selection switches 60 are connected to different signal lines D1 through Dm.

The selection switches 60 are connected to one of n control lines (switch-block-control lines) BL. A control circuit externally provided supplies control signals BL1 through BLn via the control lines BL to control an on/off state of the selection switches 60. For example, the selection switches 60 in each of the switch blocks B11, B21, . . . , and Bk1 are controlled by the control signal BL1, and the selection switches 60 in each of the switch blocks B12, B22, . . . , and Bk2 are controlled by the control signal BL2. By the same taken, the selection switches 60 in each of the switch blocks B1n, B2n, . . . , and Bkn are controlled by the control signal BLn.

The display matrix 54 includes a plurality of scan lines 62 and N×k×n×m signal lines 56 which are as many as there are the selection switches 60. Each scan line 62 is connected to a gate driver (not shown), and each signal line 56 is connected to a corresponding one of the selection switches 60. At each intersection of the scan lines 62 and the signal lines 56, a pixel cell 64 is provided. The pixel cell 64 receives a scan signal Vg, and is activated on a row-wise basis when the scan signal Vg becomes high.

Other drivers other than the driver B provided in the liquid-crystal-display device 50 have the same configuration as shown in FIG. 4, and a description thereof will be omitted.

In what follows, operation of the liquid-crystal-display device 50 will be described with reference FIG. 3, FIG. 4, and FIG. 5.

FIG. 5 is a table showing control timings of switch blocks during a horizontal scan period Th in the liquid-crystal-display device 50.

In the liquid-crystal-display device 50, the control signals BL1 through BLn are successively supplied during one horizontal scan period Th, so that the selection switches 60 in the respective switch blocks are switched on. In the following description, time periods during which the control signals BL1 through BLn are supplied are respectively referred to as timing blocks BL1 through BLn. Namely, the horizontal scan period Th is divided evenly into timing blocks BL1 through BLn.

AS shown in FIG. 5, during the first timing block BL1 of the horizontal scan period Th, the switch blocks A11, A21, . . . , Ak1, the switch blocks B11, B21, . . . , Bk1, and the switch blocks N11, N21, . . . , Nk1 are selected, resulting in a total of N×k switch blocks being selected. Within the selected switch blocks, the selection switches 60 are switched on by the control signal BL1.

During the second timing block BL2 following the timing block BL1, the switch blocks A12, A22, . . . , Ak2, the switch blocks B12, B22, . . . , Bk2, and the switch blocks N12, N22, . . . , Nk2 are selected, resulting in a total of N×k switch blocks being selected. Within the selected switch blocks, the selection switches 60 are switched on by the control signal BL2.

Control operation as described above is repeated until the operation reaches the last timing block BLn. During the last timing block BLn, the switch blocks A1n, A2n, . . . , Akn, the switch blocks B1n, B2n, . . . , Bkn, and the switch blocks N1n, N2n, . . . , Nkn are selected. As the selection switches 60 provided in the selected switch blocks are switched on, the horizontal scan period Th comes to an end. During the timing blocks BL1 through BLn, the video signals Vs are successively supplied from the drivers A, B, . . . to the activated pixel cells 64 via the selection switches 60, thereby effecting liquid-crystal display.

As described above, the present invention has a hierarchical structure, and N×k switch blocks are selected during each of the timing blocks BL1 through BLn. Selection of N×k switch blocks is repeated n times, so that all the N×k×n switch blocks are selected during one horizontal scan period Th. Hereinafter, this driving method is referred to as a hierarchical block-succession method.

It should be noted that, in the configuration described above, signals such as the scan signals Vg and the video signals Vs are supposed to be supplied at such optimal timings as to enable the liquid-crystal-display device 50 to display high quality images. Such timings can be achieved by taking into consideration delay times of the scan signals Vg, the control signals BL1 through BLn, and the video signals Vs.

As described above, each of the drivers A, B, . . . in the liquid-crystal-display device 50 has k common-signal lines connected thereto. In this configuration, the number m of signal lines within each of the common-signal lines is 1/k of this number of the related-art liquid-crystal-display device 10 shown in FIG. 1 and FIG. 2. This makes width of the wiring space approximately 1/k of that of the related art.

In the liquid-crystal-display device 50, further, the number m of the signal lines within each of the common-signal lines is 1/k of that of the related-art liquid-crystal-display device 10, so that the number of intersections of the common-signal lines and the lead lines 61 as shown in FIG. 4 becomes also 1/k. As a result, intersection capacitance of each of the common-signal lines is also decreased. Since the drivers A, B, . . . in the liquid-crystal-display device 50 each have k common-signal lines, the horizontal length of the common-signal lines becomes 1/k of that of the related art as is apparent from FIG. 1 and FIG. 4. Thus, the wiring resistance of the common-signal lines is also decreased.

As described above, the liquid-crystal-display device 50 has the reduced intersection capacitance and reduced wiring resistance of the common-signal lines compared with that of the related art, so that a RC time constant is significantly decreased. Accordingly, with the improved time constant, the present invention can enhance image quality of liquid-crystal-display device.

Further, during each of the timing blocks BL1 through BLn, a plurality of blocks are selected each from a corresponding one of the common-signal lines. Because of this, the wiring width of the common-signal lines can be widened without increasing the capacitance load or the resistance load, thereby making it possible to write the video signals Vs by utilizing a wide data width. The data width and the speed of signal writing can be further improved by increasing the number N of the drivers A, B, . . . .

Further, the plurality of drivers A, B, . . . are provided in the data driver 52 as drivers each having a small number of outputs. This configuration makes it possible to reduce the cost of the drivers A, B, . . . .

In the following, a liquid-crystal-display device 100 of the XGA type according to a first embodiment of the present invention will be described with reference to FIG. 6 through FIG. 12.

Figure 6:
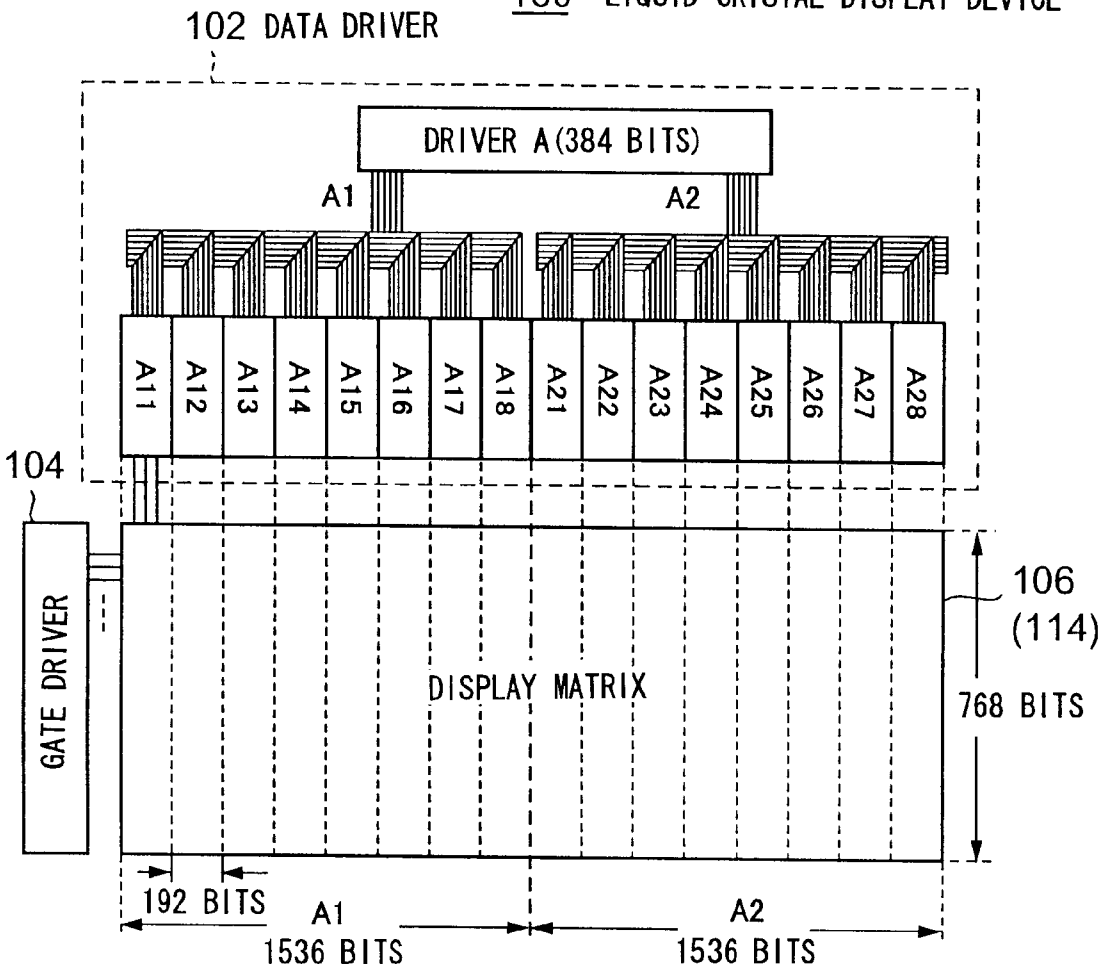
FIG. 6 is a block diagram showing a configuration of a liquid-crystal-display device according to a first embodiment.

FIG. 6 is a block diagram showing a configuration of a liquid-crystal-display device 100.

As shown in FIG. 6, the liquid-crystal-display device 100 includes a data driver 102, a gate driver 104, and a display matrix 106. The liquid-crystal-display device 100 is an embodiment of the liquid-crystal-display device 50 shown in FIG. 3, with N=1, k=2, n=8, and m=192. Namely, the data driver 102 includes the driver A having 384-bit outputs, 192-bit common-signal lines A1 and A2, and 16 switch blocks A11 through A18 and A21 through A28. The display matrix 106 includes pixel cells 114 arranged in a 3072-bit× 768-bit matrix.

Figure 7:
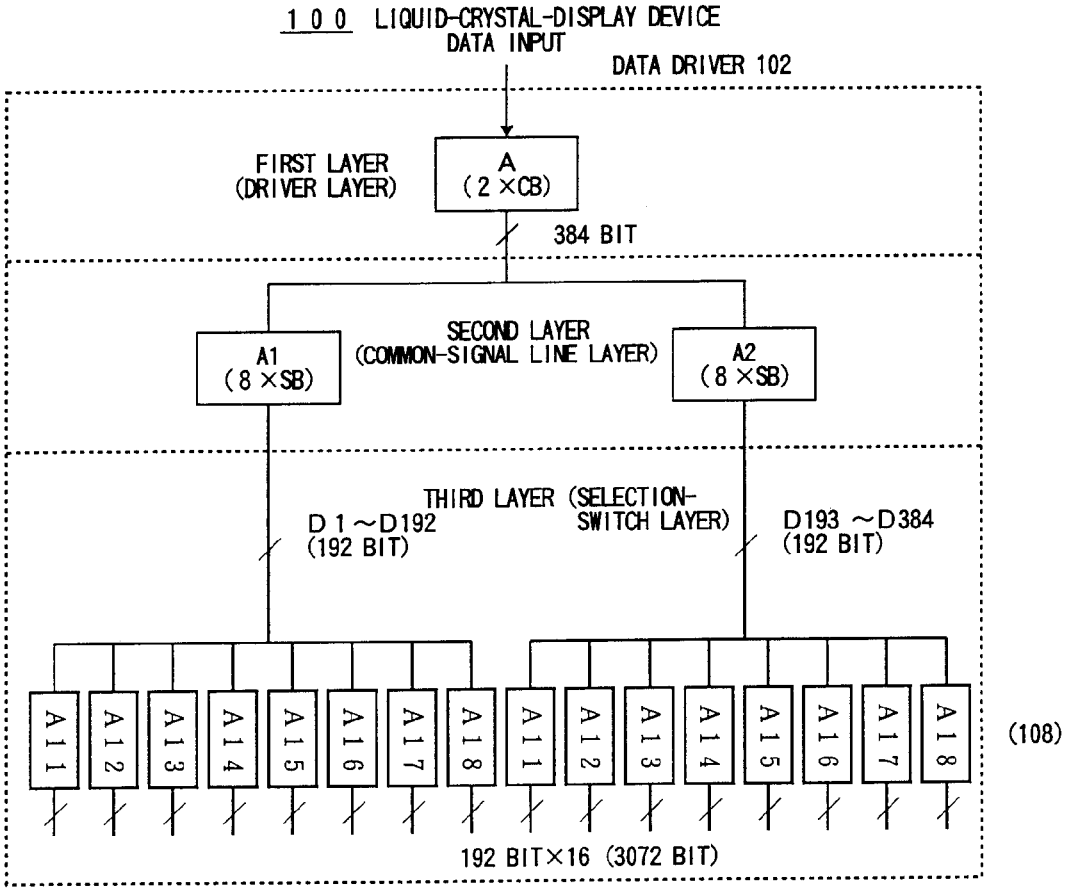
FIG. 7 is a block diagram of a data driver provided in the liquid-crystal-display device of FIG. 6.

FIG. 7 is a block diagram of the data driver 102 provided in the liquid-crystal-display device 100.

As shown in FIG. 7, the data driver 102 has the driver A provided in the first layer DB, the common-signal line A1 including D1 through D192, the common-signal line A2 including D193 through D384, and the 16 switch blocks A11 through A18 and A21 through A28. The switch blocks A11 through A18 and A21 through A28 each include 192 analog switches (selection switches) 108, which may be of a CMOS type comprised of an N channel transistor and a P channel transistor. In total, the data driver 102 includes 3072 analog switches 108 where 3072 is 16×192. It should be noted that the analog switches 108 may be of an NMOS type or a PMOS type rather than the CMOS type.

Half the 384-bit outputs of the driver A are connected to the common-signal line A1, and the other half are connected to the common-signal line A2. The signal lines D1 through D192 of the common-signal line A1 are connected to the respective analog switches 108 in each of the switch blocks A11 through A18. The signal lines D193 through D384 of the common-signal line A2 are connected to the respective analog switches 108 in each of the switch blocks A21 through A28.

Figure 8:
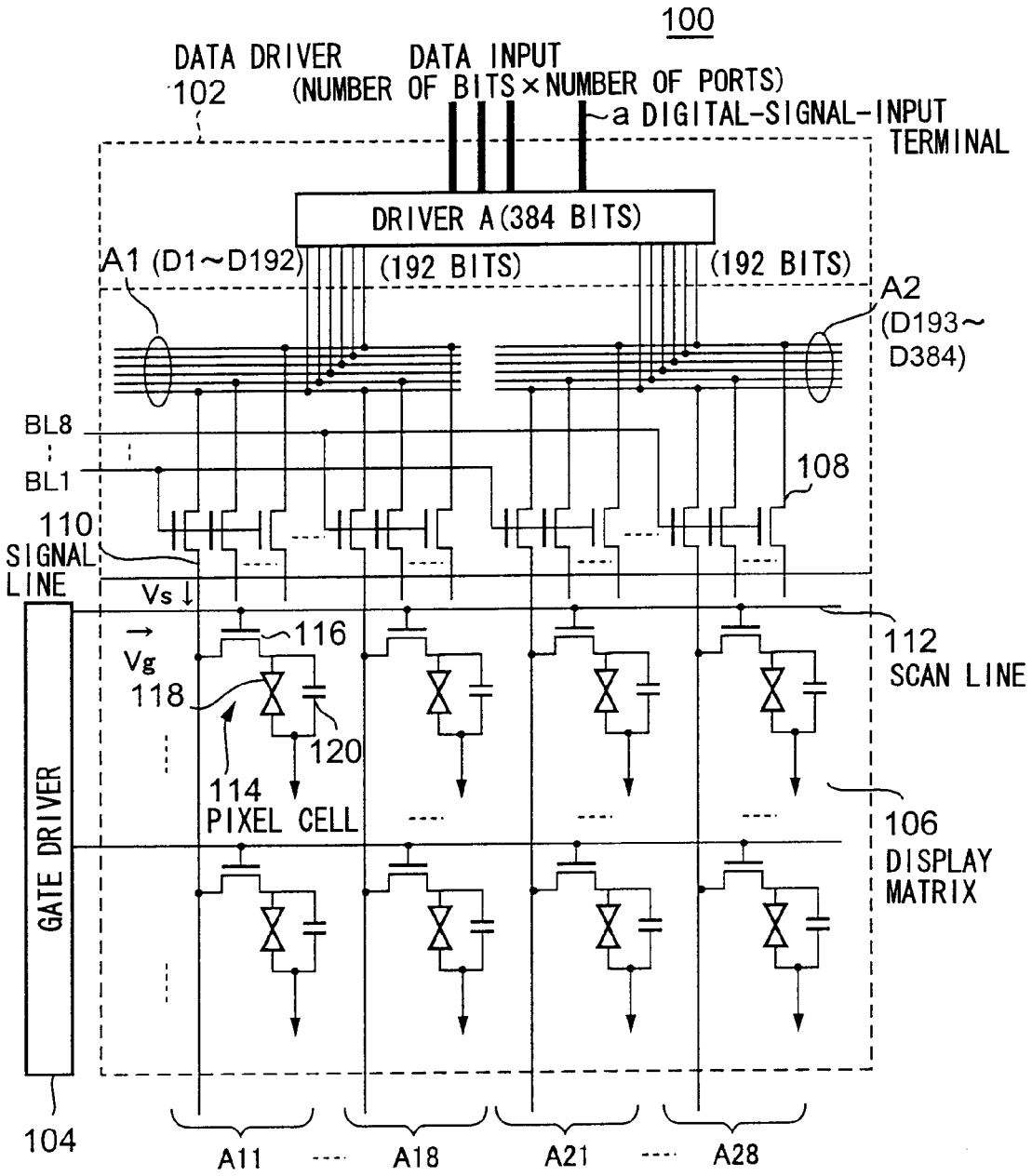
FIG. 8 is a circuit diagram of the liquid-crystal-display device of FIG. 6.

FIG. 8 is a circuit diagram of the liquid-crystal-display device 100.

As shown in FIG. 8, the driver A has a digital-signal-input terminal a of 8 bits (or 6 bits)×6 ports. The 384-bit outputs of the driver A are comprised of 192 bits connected to the signal lines D1 through D192 of the common-signal line A1 and the other 192 bits connected to the signal lines D193 through D384 of the common-signal line A2. Gates of the analog switches are connected to the control lines BL, and are controlled by control signals BL1 through BL8 supplied through the control lines BL. Further, the analog switches 108 are connected to the display matrix 106 via signal lines 110.

The display matrix 106 includes the signal lines 110 and the scan lines 112. Each of the scan lines 112 is connected to the gate driver 104. At each intersection of the signal lines 110 and the scan lines 112, a pixel cell 114 is provided. The pixel cell 114 includes a pixel TFT 116, a liquid crystal cell 118, and a capacitor 120.

The driver A is implemented as an LSI chip with the TAB implementation, and is attached as an external attachment. The gate driver 104 may be a built-in gate driver comprised of a low temperature p-SiTFT.

Figure 9:
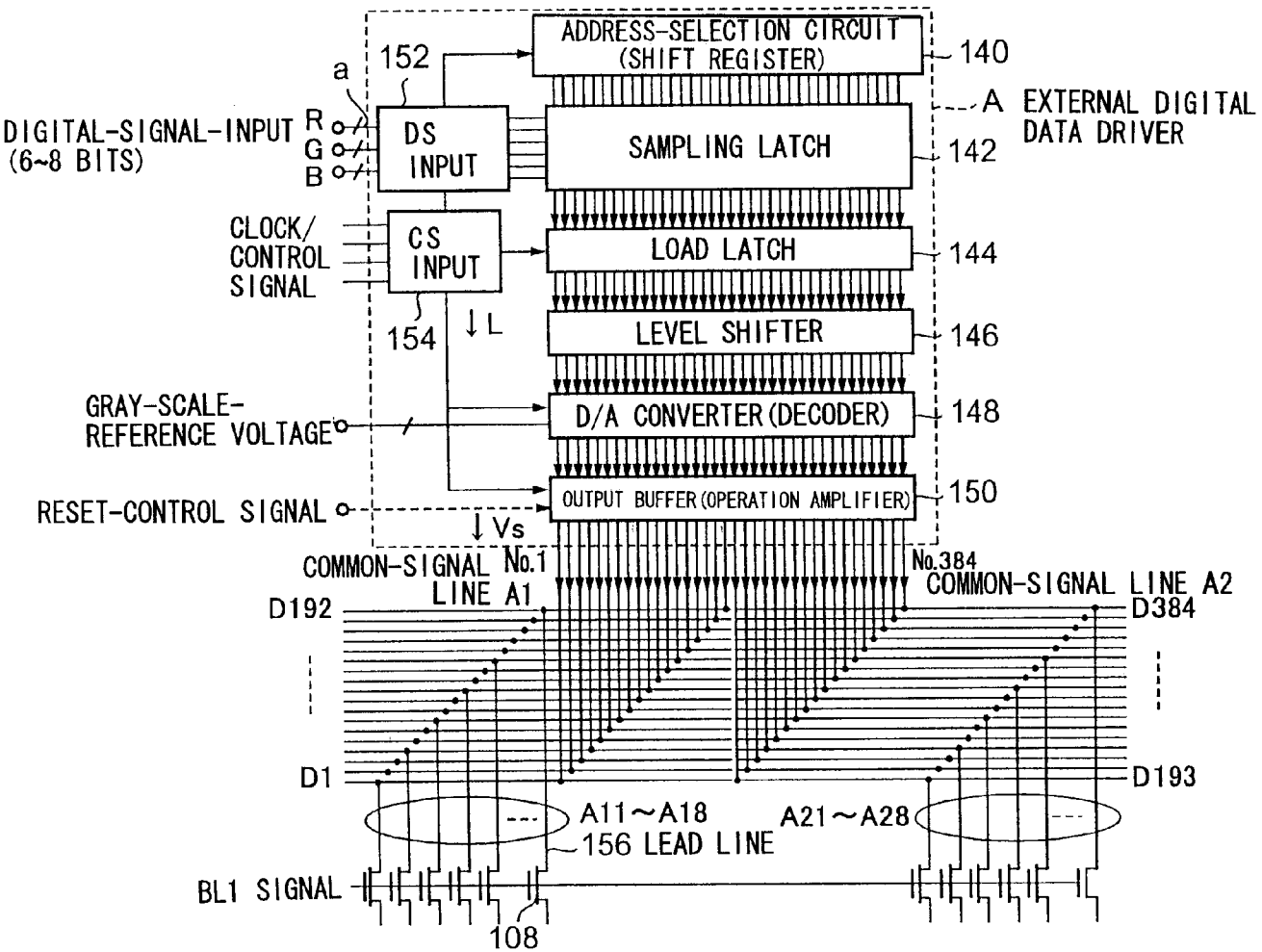
FIG. 9 is a block diagram showing an internal structure of a driver provided as an external attachment to the liquid-crystal-display device of FIG. 6.

FIG. 9 is a block diagram showing an internal structure of the driver A provided as an external attachment to the liquid-crystal-display device 100.

As shown in FIG. 9, the driver A includes an address-selection circuit 140 comprised of a shift register, a sampling latch 142, a load latch 144, a level shifter 146, a D/A converter 148 comprised of a decoder, an output buffer 150 comprised of an operation amplifier, a digital-signal-input unit 152, and a control-signal-input unit 154.

The digital-signal-input unit 152 receives display-digital signals of 8 bits or 6 bits supplied from an external signal-supply circuit. The D/A converter 148 receives a gray-scale reference voltage from an external source. The control-signal-input unit 154 receives control signals from an external control circuit.

Based on the received control signals, the control-signal-input unit 154 attends to control of the load latch 144, the D/A converter 148, and the output buffer 150 by using a latch-control signal L. The digital signals supplied to the digital-signal-input unit 152 are processed by the sampling latch 142, the load latch 144, the level shifter 146, the D/A converter 148, and the output buffer 150 so as to be converted into 256-level analog-gray-scale signals for driving the liquid-crystal display. The converted signals are supplied to the common-signal lines A1 and A2 as the video signals Vs.

In FIG. 9, the signal lines D1 through D192 of the common-signal line A1 and the signal lines D193 through D384 of the common-signal line A2 are laid out in a horizontal direction, and are coupled to the analog switches 108 via lead lines 156 extending in a vertical direction. The common-signal lines A1 and A2 are connected to the switch blocks A11 through A18 and the switch blocks A21 through A28, respectively. In this configuration, either one of the signal lines D1 through D192 and the signal lines D193 through D384 has the maximum connections of (192−1)×8 with the lead lines 156. The intersections of the lead lines 156 and the signal lines D1 through D192 or D193 through D384 are preferably as few as possible because they constitute the capacitance load.

The built-in gate driver 104 formed by using a low temperature p-SiTFT shown in FIG. 8 may have a configuration as in the following.

Figure 10:
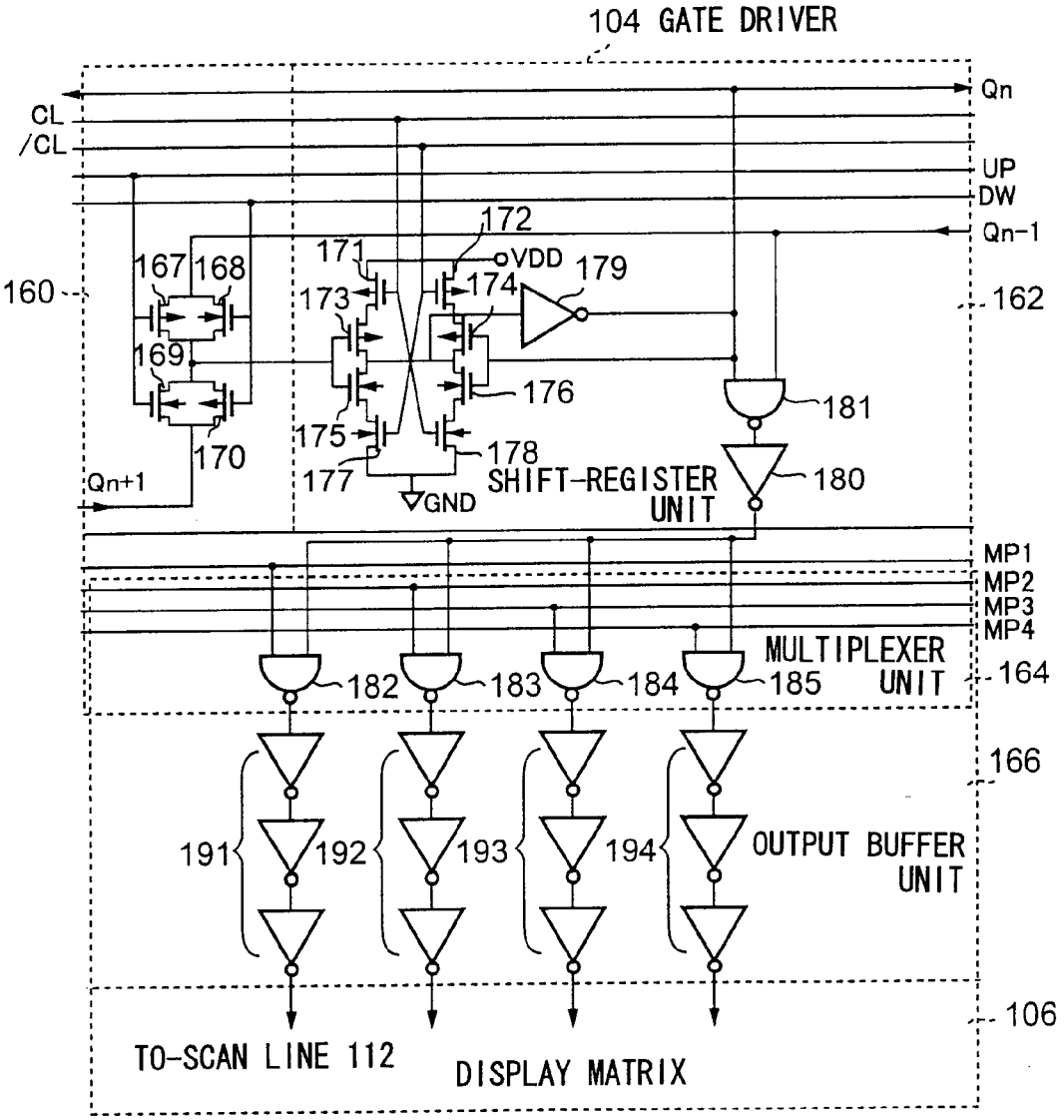
FIG. 10 is a block diagram of a gate driver provided in the liquid-crystal-display device of FIG. 3.

FIG. 10 is a block diagram of the gate driver 104 provided in the liquid-crystal-display device 100.

As shown in FIG. 10, the gate driver 104 includes a bi-directional-switch unit 160, a shift-register unit 162, a multiplexer unit 164, and an output-buffer unit 166.

The bi-directional-switch unit 160 includes four transistors 167 through 170. The shift-register unit 162 includes 8 transistors 171 through 178, inverters 179 and 180, and an NAND circuit 181. The multiplexer unit 164 includes four NAND circuits 182 through 185.

One input of each of the NAND circuits 182 through 185 is connected to the inverter 180 provided at the output of the shift-register unit 162, and the other inputs of the NAND circuits 182 through 185 receive signals MP1 through MP4, respectively. The output-buffer unit 166 includes inverters 191 through 194. Inputs of the inverters 191 through 194 are connected to the NAND circuits 182 through 185, respectively, of the multiplexer unit 164. Outputs of the inverters 191 through 194 are connected to the scan lines 112 of the display matrix 106.

The gate driver 104 receives the signals MP1 through MP4, and further receives clock signals CL and /CL, signals UP and DOWN, etc., supplied from a control-signal-generation unit (not shown).

In the gate driver 104 shown in FIG. 10, when the shift-register unit 162 outputs a high-level signal, and when the signal MP1 being high is supplied to the NAND circuit 182, a high-level scan signal Vg is supplied to a scan line 112 of the display matrix 106.

Use of the 4-bit multiplexer unit 164 in the gate driver 104 makes it possible to reduce the number of stages of the shift-register unit 162 to 192 stages. Compared with 768 stages of a shift register that is typically used in a conventional gate driver, the present invention provides a significantly lower number of shift-register stages.

FIG. 11 is a table showing control timings of switch blocks during one horizontal scan period Th of the liquid-crystal-display device 100.

In the liquid-crystal-display device 100, one horizontal scan period Th is comprised of 8 timing blocks BL1 through BL8. As the control signals BL1 through BL8 are successively supplied, analog switches 108 are switched on in a corresponding one of the switch blocks A11 through A18 and another corresponding one of the switch blocks A21 through A28. In detail, for example, during the first timing block BL1 of the horizontal scan period Th, a total of 384 analog switches 108 are switched on by the control signal BL1 in the switch blocks A11 and A21.

In what follows, operation of the liquid-crystal-display device 100 will be described with reference to the accompanying drawings. The liquid-crystal-display device 100 operates based on the hierarchical-block-succession method in the same fashion as does the liquid-crystal-display device 50.

Figure 12:
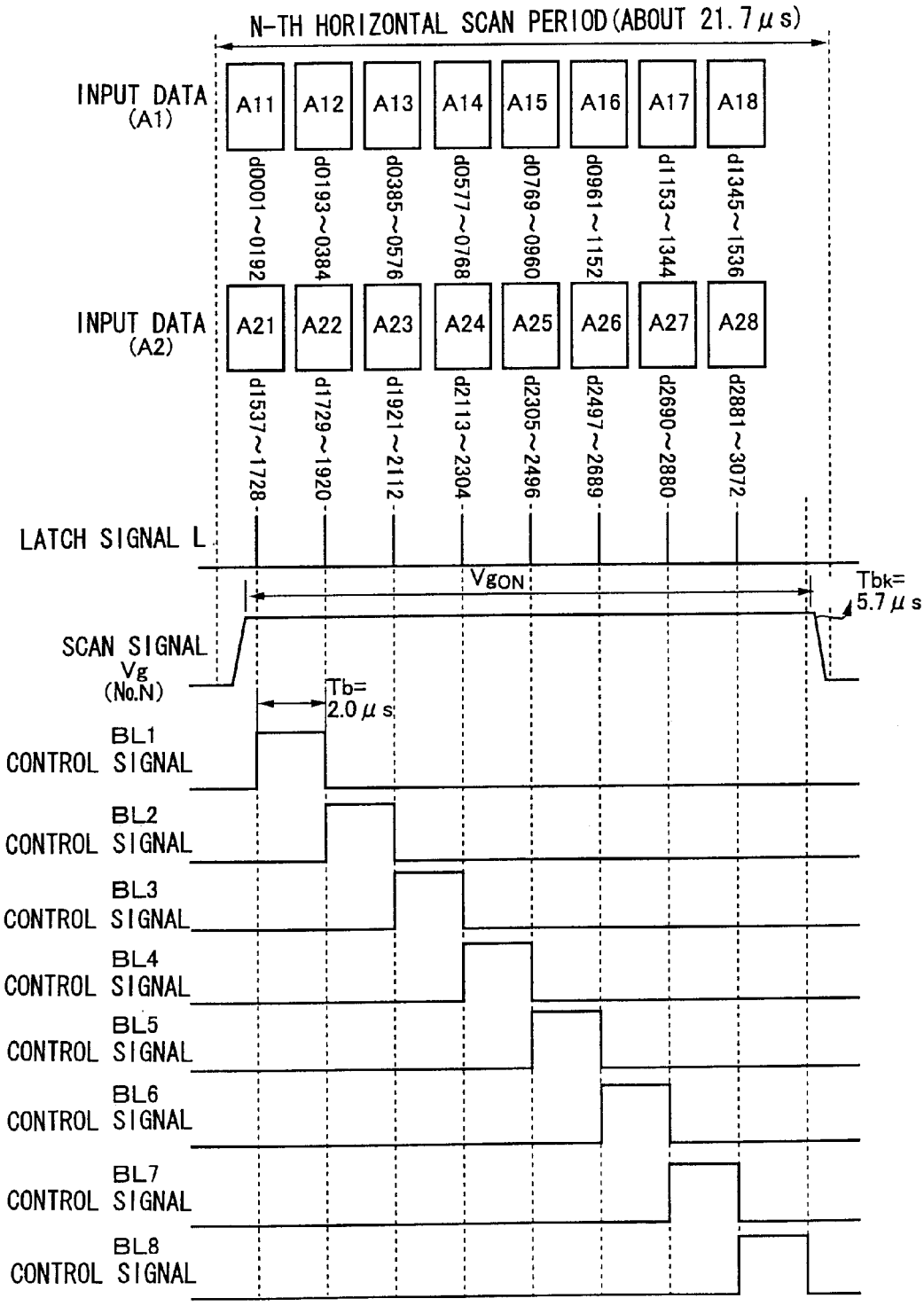
FIG. 12 is timing charts showing operation of the liquid-crystal-display device of FIG. 6.

FIG. 12 is timing charts showing operation of the liquid-crystal-display device 100.

As shown in FIG. 12, the timing blocks BL1 through BL8 during one horizontal scan period Th correspond to the respective control signals BL1 through BL8. On both sides of the horizontal scan period Th is provided a blanking interval Tbk, which is comprised of a rise time and a fall time of the scan signals Vg. For example, the horizontal scan period Th is approximately 21.7 $\mu$s, and each of the timing blocks BL1 through BL8 has a time length Tb of about 2.0 $\mu$s. Further, one blanking interval Tbk is approximately 5.7 $\mu$s.

In the liquid-crystal-display device 100, the video signals Vs are transferred at once from the driver A to the common-signal lines A1 and A2 at timings indicated by the latch signal L. In order to transfer one scan-line's worth of video signals Vs, the latch signal L is supplied to the relevant circuit of FIG. 9 as many as 8 times during one horizontal scan period Th.

For the sake of explanation, the signal lines 110 laid out from the first row to the 3072$^{nd}$ row in the display matrix 106 are referred to as d0001 through d3072.

When the gate driver 104 supplies a high-level scan signal Vg to the first row of the scan lines 112 in the display matrix 106, the control signal BL1 is supplied to the analog switches 108 of the switch blocks A11 and A21 during the first timing block BL1. As a result, a total of 384 analog switches 108 are switched on in the switch blocks A11 and A21. When this happens, the video signals Vs are supplied from the driver A to the pixel cells 114 as connections therebetween are established via the switched-on analog switches 108, the signal lines d0001 through d0192, and the signal lines d1537 through d1728. The video signals Vs are then written in the liquid-crystal cells 118 and the capacitors 120 via the pixel TFTs 116.

During the second timing block BL2, the control signal BL2 is supplied to the analog switches 108 of the switch blocks A12 and A22. As a result, a total of 384 analog switches 108 are switched on in the switch blocks A12 and A22. When this happens, the video signals Vs are supplied from the driver A to the pixel cells 114 as connections therebetween are established via the switched-on analog switches 108, the signal lines d0193 through d0384, and the signal lines d1729 through d1920. The video signals Vs are then written in the liquid-crystal cells 118 and the capacitors 120 via the pixel TFTs 116.

The operation as described above is repeated until the control signal BL8 is supplied to the analog switches 108 of the switch blocks A18 and A28 during the eighth timing block BL8, resulting in the video signals Vs being written in the corresponding 384 pixel cells 114, which brings the horizontal scan period Th to an end. The pixel cells 114 having the video signals Vs written therein hold the written signals until next scan signals Vg are supplied. Such a signal writing operation and a signal holding operation are repeated at frame intervals such as 60 Hz.

In the following, a liquid-crystal-display device 200 of the SXGA type according to a second embodiment of the present invention will be described with reference to FIG. 13 and FIG. 14.

Figure 13:
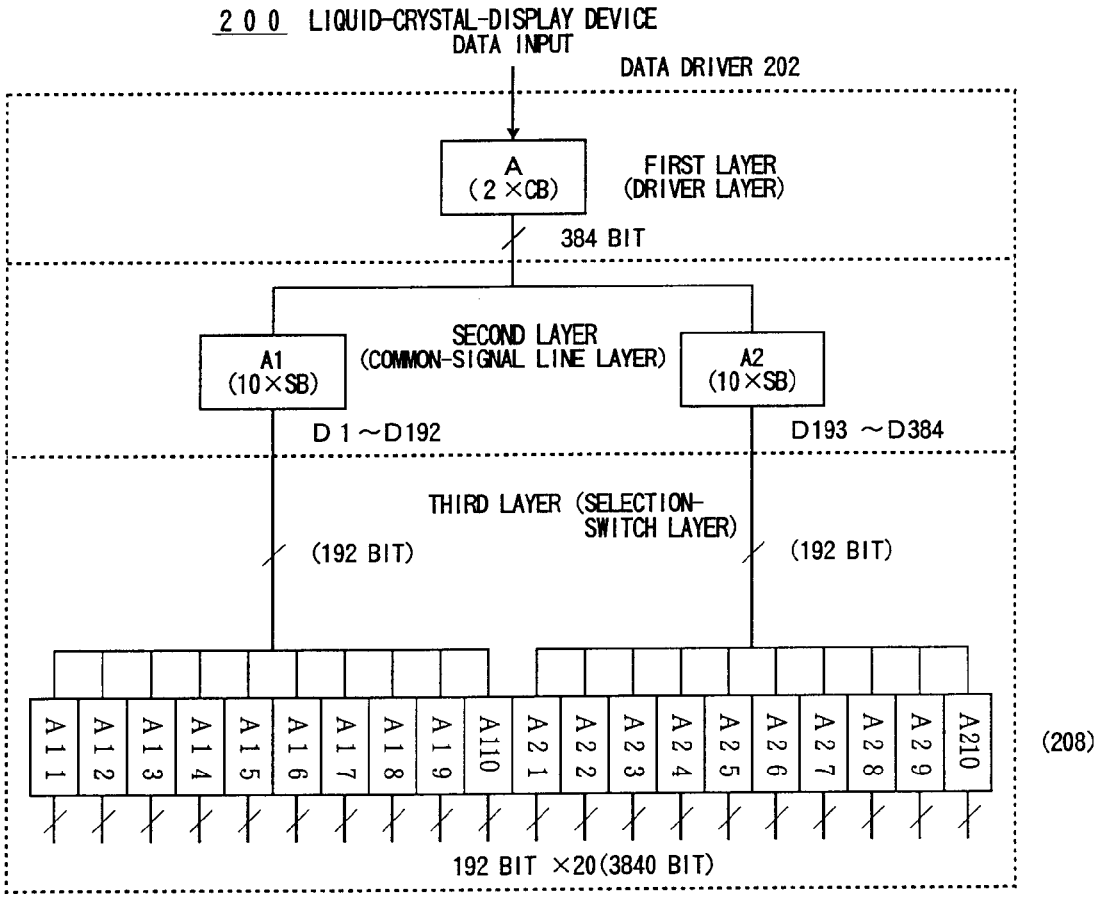
FIG. 13 is a block diagram of a data driver provided in a liquid-crystal-display device of a second embodiment.

FIG. 13 is a block diagram of a data driver 202 provided in the liquid-crystal-display device 200. As shown in FIG. 13, the data driver 202 includes the driver A formed in the first layer DB by TAB implementation, the common-signal line A1 including D1 through D192 and the common-signal line A2 including D193 through D384 in the second layer CB, and 20 switch blocks A11 through A110 and A21 through A210 in the third layer SB. The switch blocks A11 through A110 and A21 through A210 each include 192 analog switches 208, which may be of a CMOS type.

Namely, the liquid-crystal-display device 200 is an embodiment of the liquid-crystal-display device 50 shown in FIG. 3, with N=1, k=2, n=10, and m=192. In total, the data driver 102 includes 3840 analog switches 208 where 3840 is 20×192. It should be noted that the analog switches 208 may be of an NMOS type or a PMOS type rather than the CMOS type.

Half the 384-bit outputs of the driver A are connected to the common-signal line A1, and the other half are connected to the common-signal line A2. The signal lines D1 through D192 of the common-signal line A1 are connected to the respective analog switches 208 in each of the switch blocks A11 through A110. The signal lines D193 through D384 of the common-signal line A2 are connected to the respective analog switches 208 in each of the switch blocks A21 through A210.

Other details of the configuration of the liquid-crystal-display device 200 are the same as those of the liquid-crystal-display device 100 shown in FIG. 5, and a description thereof will be omitted.

In what follows, operation of the liquid-crystal-display device 200 will be described with reference to the accompanying drawings.

FIG. 14 is a table showing control timings of switch blocks during one horizontal scan period Th of the liquid-crystal-display device 200.

In the liquid-crystal-display device 200, one horizontal scan period Th is comprised of 10 timing blocks BL1 through BL10. As the control signals BL1 through BL10 are successively supplied, analog switches 208 are switched on in a corresponding one of the switch blocks A11 through A110 and in another corresponding one of the switch blocks A21 through A210. In detail, for example, during the first timing block BL1 of the horizontal scan period Th, a total of 384 analog switches 208 are switched on by the control signal BL1 in the switch blocks A11 and A21.

During the timing block BL2 following the timing block BL1, a total of 384 analog switches 208 are switched on by the control signal BL2 in the switch blocks A12 and A22.

The operation as described above is repeated until the control signal BL10 activates a total of 384 analog switches 208 in the switch blocks A110 and A210 during the last timing block BL10, which marks an end of the horizontal scan period Th. The video signals Vs are written in the activated pixel cells via the activated analog switches 208 during each of the timing blocks BL1 through BL10.

As described above, the liquid-crystal-display device 100 or 200 of the first or second embodiment has the driver A connected to the common-signal lines A1 and A2, which are each comprised of 192 signal lines such as D1 through D192 and D193 through D384. Because of this configuration, the number of signal lines that exist in the common-signal line A1 or A2 is about half of that of the related-art liquid-crystal-display device 10 shown in FIG. 1 and FIG. 2, so that the wiring width of the common-signal line is also reduced to half. When the wiring pitch of the common-signal line is 16 $\mu$m, for example, the common-signal lines D1 through D384 of the related art require the wiring width of 6.14 mm (16 $\mu$m×384). On the other hand, the common-signal line A1 or A2 of the liquid-crystal-display device 100 or 200 requires only the wiring width of 3.07 mm (16 $\mu$m×192). Accordingly, the present embodiments achieve a light-weight structure and miniaturization of panel-frame size by reducing the wiring width of common-signal lines.

Further, since the first and second embodiments have half the number of signal lines in the common-signal lines A1 and A2 compared with the related-art configuration, the number of intersections of the control lines BL and the common-signal lines A1 and A2 is also reduced in the data driver 102. This contributes to shortening of the rising time and the falling time of the control signals BL1 through BL8 shown in FIG. 12.

Figure 1:
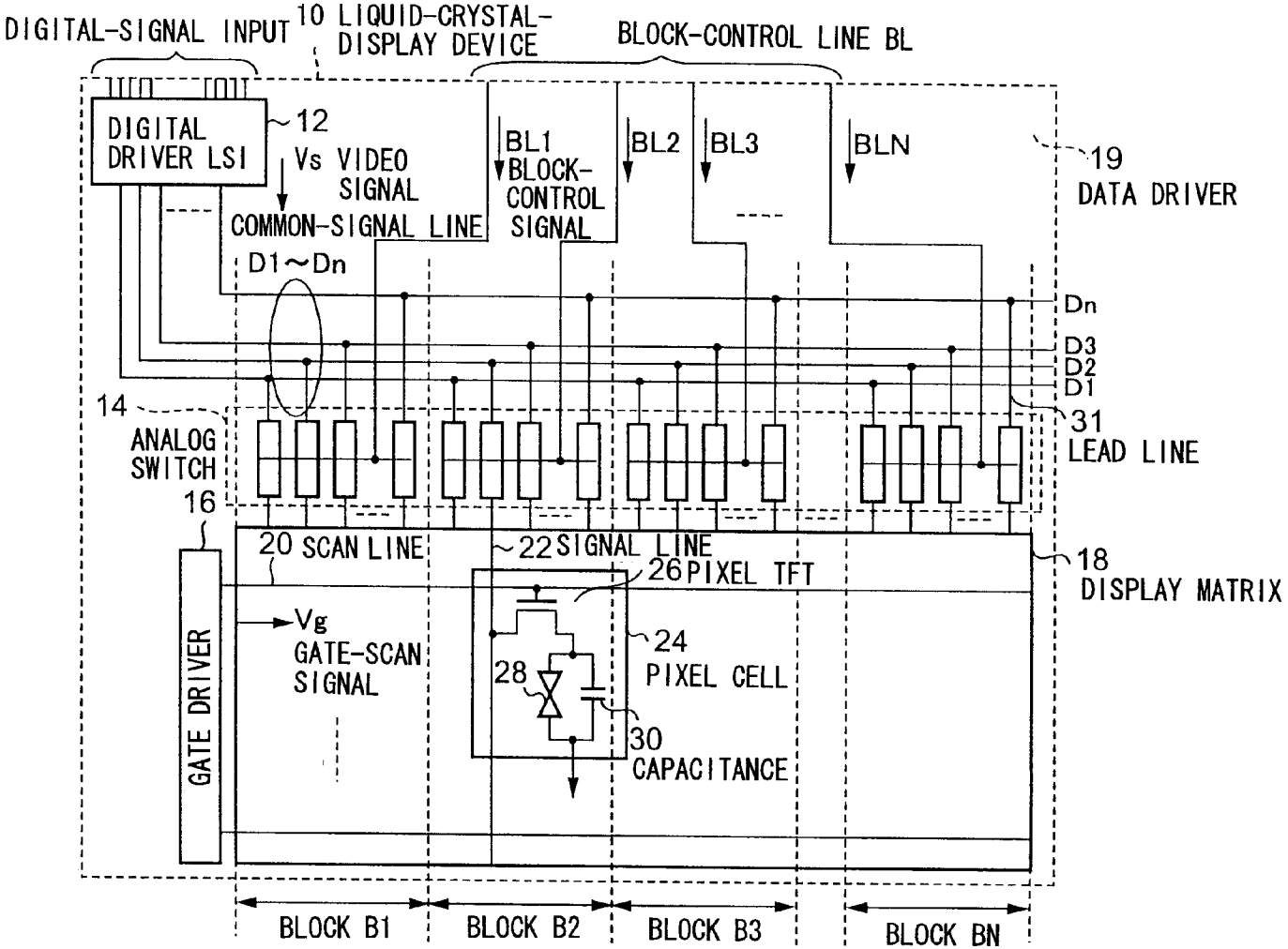
FIG. 1 is a block diagram of a related-art liquid-crystal-display device shown as an example of a liquid-crystal-display device driven by a simple-block-succession method.
Figure 2:
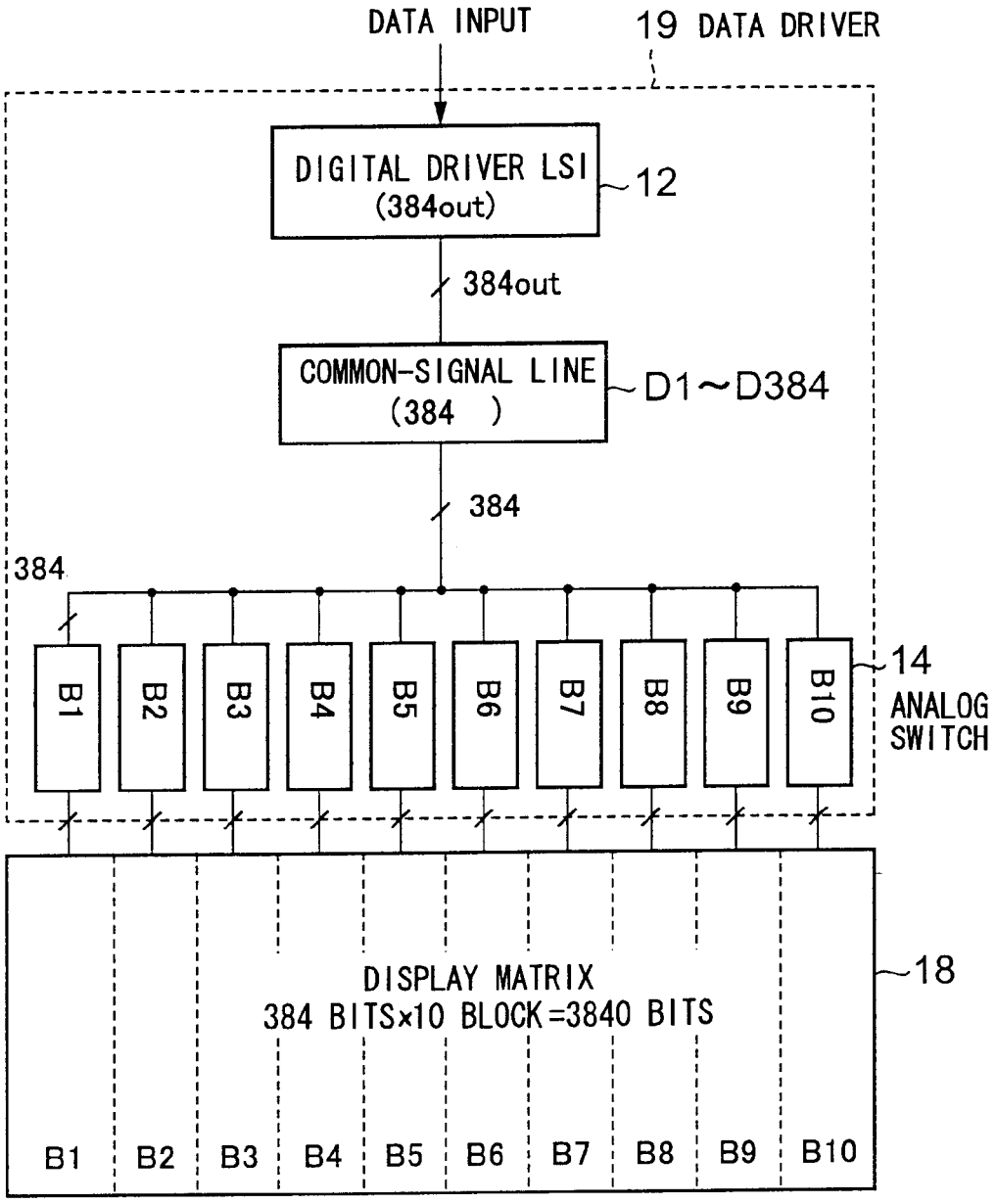
FIG. 2 is a block diagram for explaining configurations of a data driver and a display matrix provided in the liquid-crystal-display device of FIG. 1.

In order to achieve a signal-writing speed of 2.0 $\mu$s/block in the related-art liquid-crystal-display device 10 of the XGA type shown in FIG. 1, the display matrix 18 needs to be comprised of 8 blocks, and the data width of each block needs to be 384 bits. In this case, the common-signal lines D1 through D384 intersect with the lead lines 31 at 3064 (=(384−1)×8) locations at the maximum.

On the other hand, the common-signal lines D1 through D192 of the liquid-crystal-display device 100 of the first embodiment, for example, intersect with the lead lines 156 at 1528 (=(192−1)×8) locations at the maximum. Assuming that capacitance per intersection is 5 fF, the total capacitance of the common-signal lines is 15.3 pF in the related-art configuration. Under the same assumption, the common-signal lines D1 through D192 of the first embodiment have the capacitance of 7.6 pF. In this manner, the first and second embodiments described above can reduce the intersection capacitance of the common-signal lines A1 and A2 by a significant margin.

Further, the liquid-crystal-display device of the first or second embodiment has the common-signal lines A1 and A2 as two sets of common-signal lines so that their horizontal extension becomes half of that of the related art. Because of this, the first and second embodiments can reduce the wiring resistance of the common-signal lines A1 and A2. For example, if a 12.1-inch XGA panel has a pixel pitch of 0.24 $\mu$m, a horizontal extension of the display matrix being 245.76 mm (0.24 $\mu$m×1024), a wiring pitch of the common-signal lines being 16 $\mu$m, and a unit-length wiring-sheet resistance being 0.2 Ω, the total resistance would be 6.14 kΩ in the case of the related art. In contrast, the total resistance would be 3.07 kΩ in the case of the first embodiment, and this figure is half that of the related art.

In this manner, the liquid-crystal-display device of the first or second embodiment has the intersection capacitance and wiring resistance of the common-signal lines A1 and A2 reduced in comparison with the related-art configuration, thereby achieving a significantly reduced RC time constant. For example, the time constant RC of the first embodiment is 23.3 ns (=3.07 kΩ×7.6 pF). This is one quarter of the time constant RC of the XGA-type related-art configuration in which the time constant RC is 93.9 ns (=6.14 kΩ×15.3 pF).

In the first and second embodiments, with the improved time constant, the liquid-crystal display has an enhanced image quality. In these embodiments, halftone representation is especially improved in a 256-level full-color display.

In the following, a liquid-crystal-display device 300 of the XGA type according to a third embodiment of the present invention will be described with reference to the accompanying drawings.

Figure 15:
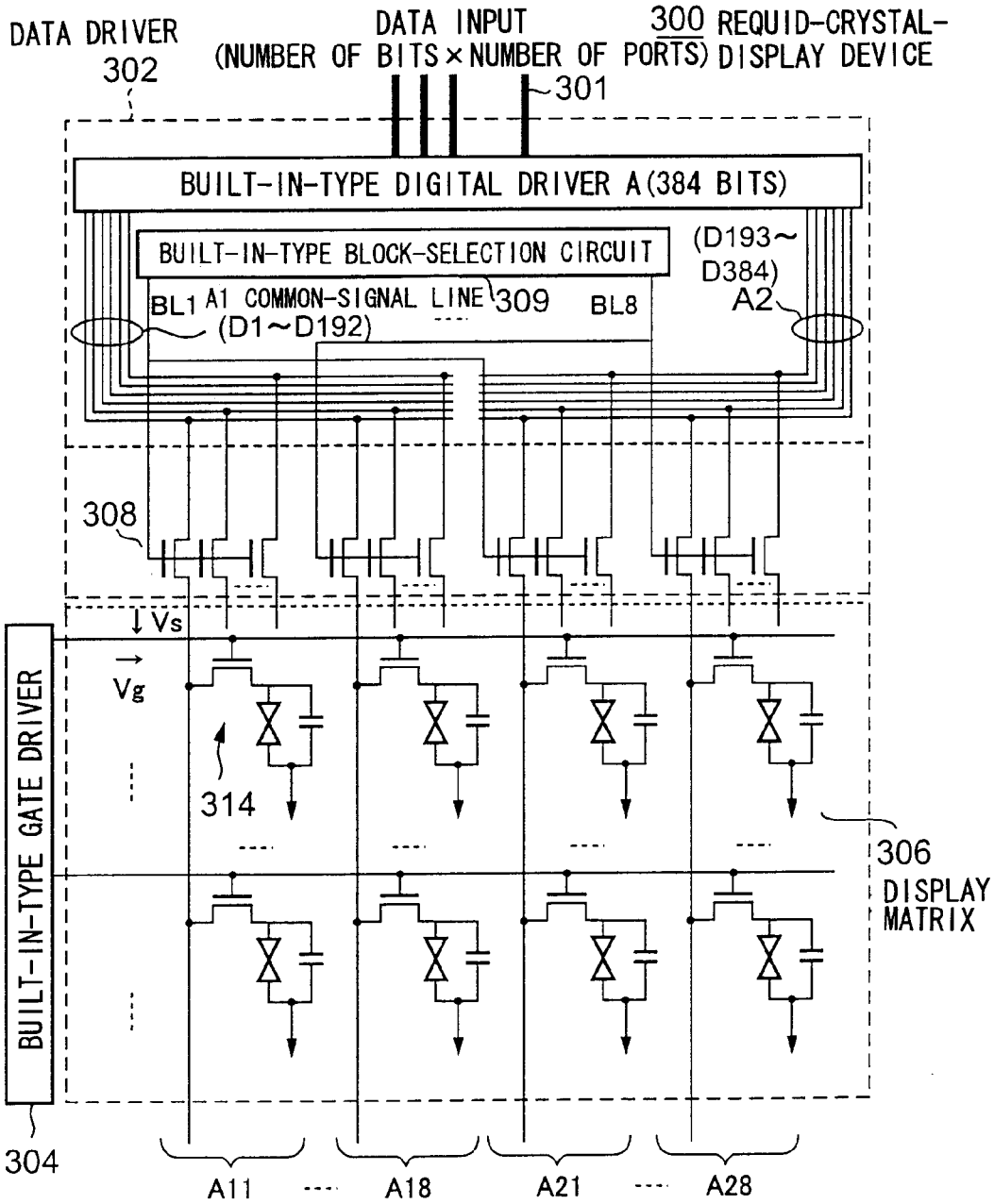
FIG. 15 is a circuit diagram of a liquid-crystal-display device according to a third embodiment.

FIG. 15 is a circuit diagram of the liquid-crystal-display device 300.

As shown in FIG. 15, the liquid-crystal-display device 300 includes a data driver 302, a gate driver 304, and a display matrix 306. The liquid-crystal-display device 300 is an embodiment of the liquid-crystal-display device 50 shown in FIG. 3, with N=1, k=2, n=8, and m=192. Namely, the data driver 302 includes the driver A having 384-bit outputs, the 192-bit common-signal lines A1 and A2, and the 16 switch blocks A11 through A18 and A21 through A28. Each switch block includes 192 analog switches 308.

The liquid-crystal-display device 300 further includes a block-selection circuit 309 that is of a panel-built-in type. The display matrix 306 includes pixel cells 314 arranged in a 3072-bit×768-bit matrix.

The driver A provided in the data driver 302 of the liquid-crystal-display device 300 is not an external attachment, but is a panel-built-in driver that is formed as an integral part of the display matrix 306 by use of the low temperature p-SiTFT. Further, the block-selection circuit 309 is formed by use of p-SiTFT inside the data driver 302. These are some of the features of this embodiment.

The driver A is of the panel-built-in type, so that the number of terminals for receiving input signals in the data driver 302 can be reduced significantly. The number of the input signal lines 301 is represented by a product of the number of bits and the number of ports.

The block-selection circuit 309 of the built-in type is connected via the control lines BL to the gates of the analog switches 308 which are provided as many as 3072. The data driver 302 supplies the control signals BL1 through BL8 via the control lines BL to control the analog switches 308. The control signals BL1 through BL8 need to have a frequency that is in the range of 0.5 MHz, for example. Accordingly, the block-selection circuit 309 is easily implemented by use of p-SiTFT if the p-SiTFT has a mobility of 20 $cm^2/Vs$ or more.

Other details of the liquid-crystal-display device 300 in terms of its structure are the same as those of the liquid-crystal-display device 100 shown in FIG. 5, and a description thereof will be omitted.

Figure 16:
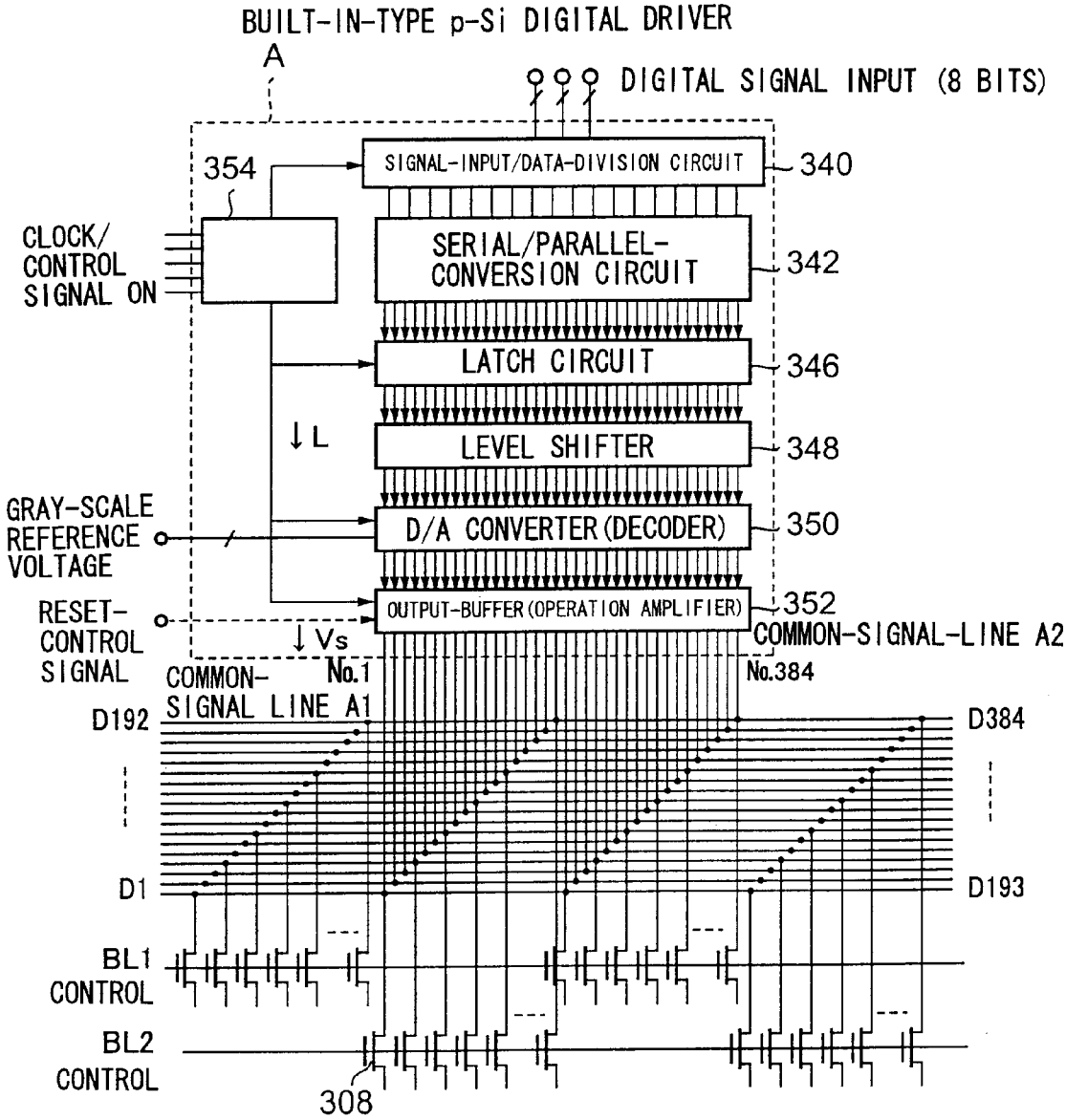
FIG. 16 is a block diagram showing an internal configuration of a digital driver provided in the liquid-crystal-display device of FIG. 15.

FIG. 16 is a block diagram showing an internal configuration of the digital driver A provided in the liquid-crystal-display device 300.

As shown in FIG. 16, the driver A includes a signal-input/data-division circuit 340, a serial/parallel-conversion circuit 342, a latch circuit 346, a level shifter 348, a D/A converter 350 comprised of a decoder, an output buffer 352 comprised of an operation amplifier, and a clock-control circuit 354.

The signal-input/data-division circuit 340 receives 8-bit display-digital signals, for example, supplied from an external signal-supply circuit (not shown). The D/A converter 350 receives a gray-scale reference voltage from an external source. The clock-control circuit 354 receives control signals from an external control circuit. Based on the received control signals, the clock-control circuit 354 attends to control of the signal-input/data-division circuit 340, the latch circuit 346, the D/A converter 350, and the output buffer 352 by using a latch-control signal L.

The driver A, which is formed of p-SiTFT as an integral part of the display matrix 306, has an operation frequency that is lower than that of the semiconductor-LSI driver that would be provided as an external attachment. Because of this, the received display data needs to be converted into data of an optimal transfer rate (frequency) in order to conform to the TFT characteristics. To this end, the signal-input/data-division circuit 340 divides the 8-bit display-digital signals supplied to the data driver 302, with an aim of lowing the operation frequency. Since the lower temperature p-SiTFT has a mobility of 150 $cm^2/Vs$ or less, a wider margin can be obtained if the clock frequency is set to 10 MHz or less.

The serial/parallel-conversion circuit 342 converts serial signals of a plurality of channels into parallel signals, and supplies the parallel signals to the latch circuit 346. The latch circuit 346 temporarily stores therein the received parallel signals, and supplies same to the level shifter 348 and the D/A converter 350 at predetermined timings. The level shifter 348 converts a logic level ranging approximately between 5 V and 10 V into a liquid-crystal-driving-voltage level that ranges from 10 V to 15 V. The D/A converter 350 generates 256-level gray-scale signals based on the gray-scale reference voltage, and converts a digital gray-scale-level code into a corresponding voltage representing one of the 256 levels. The output-buffer circuit 352 receives the gray-scale-level voltage from the D/A converter 350, and supplies the voltage to the common-signal lines A1 and A2 at predetermined timings.

If a well-known technology such as a CGS technology achieving a high mobility p-SiTFT is employed, a built-in-p-SiTFT driver A having a clock frequency in the range of tens of megahertz can be implemented. The driver A of this embodiment has output bits as many as to correspond to the block width, so that the circuitry size can be reduced compared to the related-art liquid-crystal-display device operating based on a line-succession-drive method, in which drivers are each provided for a corresponding bit. Further, power consumption can be also reduced.

A liquid-crystal-display device having a built-in-type data driver A may be implemented as follows.

Figure 17:
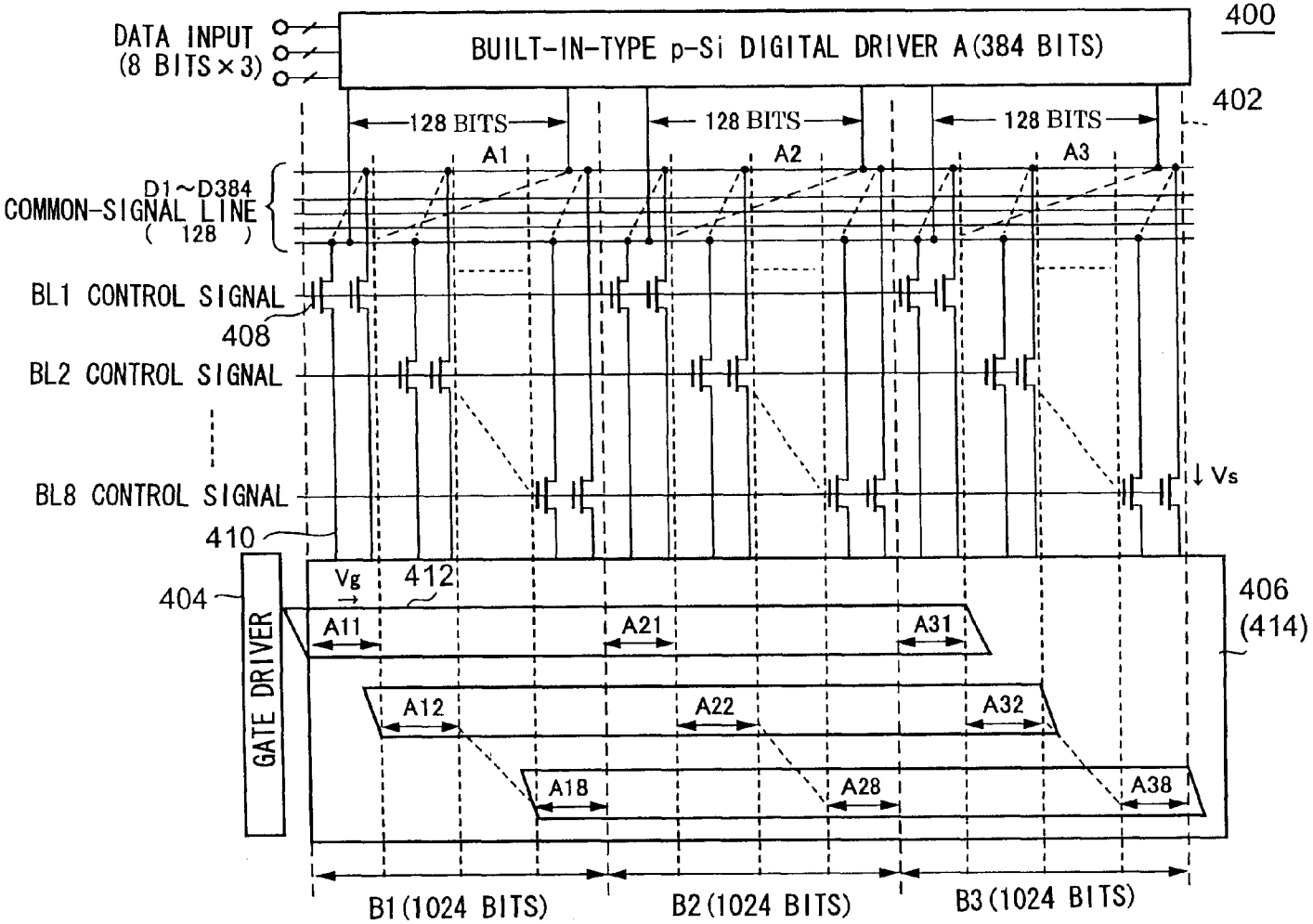
FIG. 17 is a circuit diagram showing a liquid-crystal-display device of the XGA type according to a fourth embodiment of the present invention.

FIG. 17 is a circuit diagram showing a liquid-crystal-display device 400 of the XGA type according to a fourth embodiment of the present invention.

As shown in FIG. 17, the liquid-crystal-display device 400 includes a data driver 402, a gate driver 404, and a display matrix 406. The liquid-crystal-display device 400 is an embodiment of the liquid-crystal-display device 50 shown in FIG. 3, with N=1, k=3, n=8, and m=128. Namely, the data driver 402 includes the driver A having 384-bit outputs, 128-bit common-signal lines A1 through A3, and 24 switch blocks A11 through A18, A21 through A28, and A31 through A38. Each switch block includes 128 analog switches 408. Gates of the analog switches 408 are connected to the control lines BL. The control signals BL1 through BL8 supplied through the control lines BL control the analog switches 408.

The display matrix 406 includes pixel cells 414 arranged in a 3072-bit×768-bit matrix.

As a characteristic nature, the liquid-crystal-display device 400 includes the built-in-type-p-SiTFT driver A as does the liquid-crystal-display device 300, and the driver A is connected to 3 sets of common-signal lines A1, A2, and A3, each of which is comprised of 128 bits. Use of three sets of common-signal lines provides advantages over the liquid-crystal-display device 300 in terms of miniaturization of panel-frame size and reduction of the time constant.

Other details of the liquid-crystal-display device 400 in terms of its structure are the same as those of the liquid-crystal-display device 300 shown in FIG. 15, and a description thereof will be omitted.

In the following, operation of the liquid-crystal-display device 400 will be described.

Figure 18:
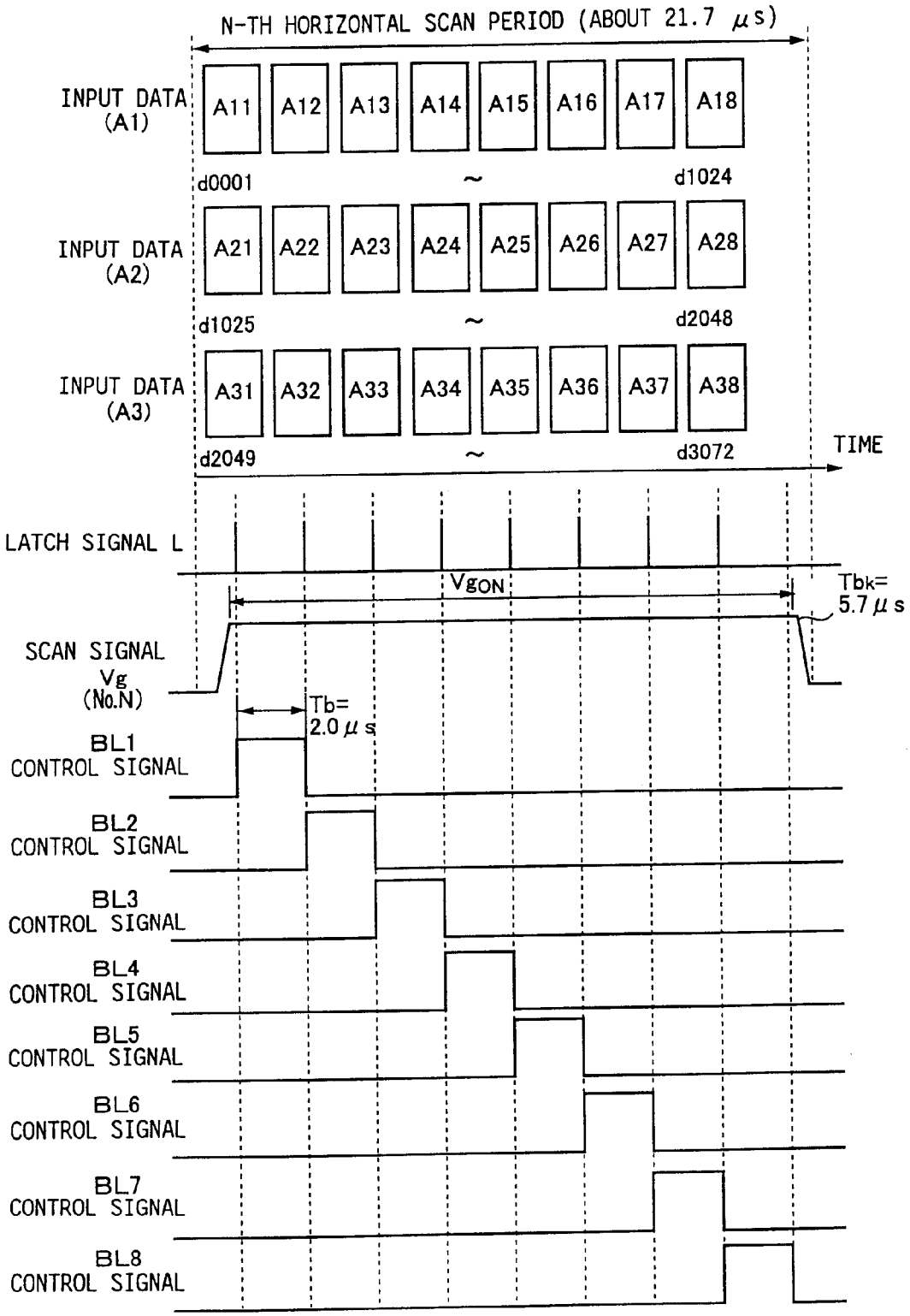
FIG. 18 is timing charts showing operation of the liquid-crystal-display device of FIG. 17.

FIG. 18 is timing charts showing operation of the liquid-crystal-display device 400.

As shown in FIG. 18, one horizontal scan period Th includes eight timing blocks BL1 through BL8. On both sides of the horizontal scan period Th is provided a blanking interval Tbk, which is comprised of a rise time and a fall time of the scan signals Vg. For example, the horizontal scan period Th is approximately 21.7 $\mu$s, and each of the timing blocks BL1 through BL8 has a time length Tb of about 2.0 $\mu$s. Further, one blanking interval Tbk is approximately 5.7 $\mu$s. For the sake of explanation, the signal lines 410 laid out from the first row to the $3072^{nd}$ row in the display matrix 406 are referred to as d0001 through d3072.

In FIG. 17, when the gate driver 404 supplies a high-level scan signal Vg to the first row of the scan lines 412 in the display matrix 406, the control signal BL1 is supplied to the analog switches 408 of the switch blocks A11, A21, and A31 during the first timing block BL1. As a result, a total of 384 analog switches 408 are switched on in the switch blocks A11, A21, and A31. When this happens, the video signals Vs are supplied from the driver A to the pixel cells 414 as connections therebetween are established via the switched-on analog switches 408 and the signal lines d0001 through d0128, d1025 through d1152, and d2049 through d2176, thereby effecting liquid-crystal display.

During the second timing block BL2, the control signal BL2 is supplied to the analog switches 408 of the switch blocks A12, A22, and A32. As a result, a total of 384 analog switches 408 are switched on in the switch blocks A12, A22, and A32. When this happens, the video signals Vs are supplied from the driver A to the pixel cells 414 as connections therebetween are established via the switched-on analog switches 408 and the signal lines d0129 through d0256, d1153 through d1280, and d2177 through d2304, thereby effecting liquid-crystal display.

The operation as described above is repeated until the control signal BL8 is supplied to the analog switches 408 of the switch blocks A18, A28, and A38 during the eighth timing block BL8, resulting in the video signals Vs being written in the corresponding 384 pixel cells 414, which marks an end of the horizontal scan period Th. The pixel cells 414 having the video signals Vs written therein hold the written signals until next scan signals Vg are supplied. Such a signal writing operation and a signal holding operation are repeated at frame intervals such as 60 Hz.

As described above, during each of the timing blocks BL1 through BL8 in the third and fourth embodiments, a plurality of blocks are successively selected in each of the common-signal lines A1 and A2 (or A1 through A3), so that the video signals Vs can be written as data having a wide data width without widening the wiring width of the common-signal lines. For example, the liquid-crystal-display device 400 uses a built-in-type driver A having ⅛ the size of the related-art device of the digital-line-succession-drive method, and can write the video signals Vs at a rate of 2.0 μs in the display matrix 406 having 3072 bits in a horizontal direction.

Further, use of the built-in-type p-SiTFT driver A having a small circuitry size makes it possible to reduce power consumption in the third and fourth embodiments. Since the number of TFTs that make up the driver A is reduced, a yield in the manufacturing process is improved.

The number of output bits of the driver A in the third and fourth embodiments is ⅛ as many as the number of pixels in the horizontal direction in the display matrix, so that the pitch of the output terminals of the driver A can be widened 8 times as wide as the pitch of the horizontally arranged pixels. When the third and fourth embodiments are applied to a 12.1-inch XGA panel having a pixel pitch of 0.24 mm, for example, the output terminals of the driver A can have a pitch of 1.92 mm (=0.24 mm×8). That is, size of the circuitry is significantly reduced compared with the related-art line-succession driver. The third and fourth embodiments are particularly effective when used for a small panel having a small pixel pitch.

Further, since the driver A provides great latitude in designing the pitch of output terminals in the third and fourth embodiments, there is also latitude in designing the number of sets of common-signal lines. When 8 sets of 48-bit common-signal lines A1 through A8 are provided in the second layer CB in the data driver 302 or 402, both the capacitance load and the resistance load are ⅛ of those of the 384-bit common-signal lines D1 through D384. In this case, the RC time constant is 1/16 as shorter.

In what follows, a liquid-crystal-display device 500 of the QXGA type according to a fifth embodiment of the present invention will be described with reference to FIG. 19 through FIG. 22.

Figure 19:
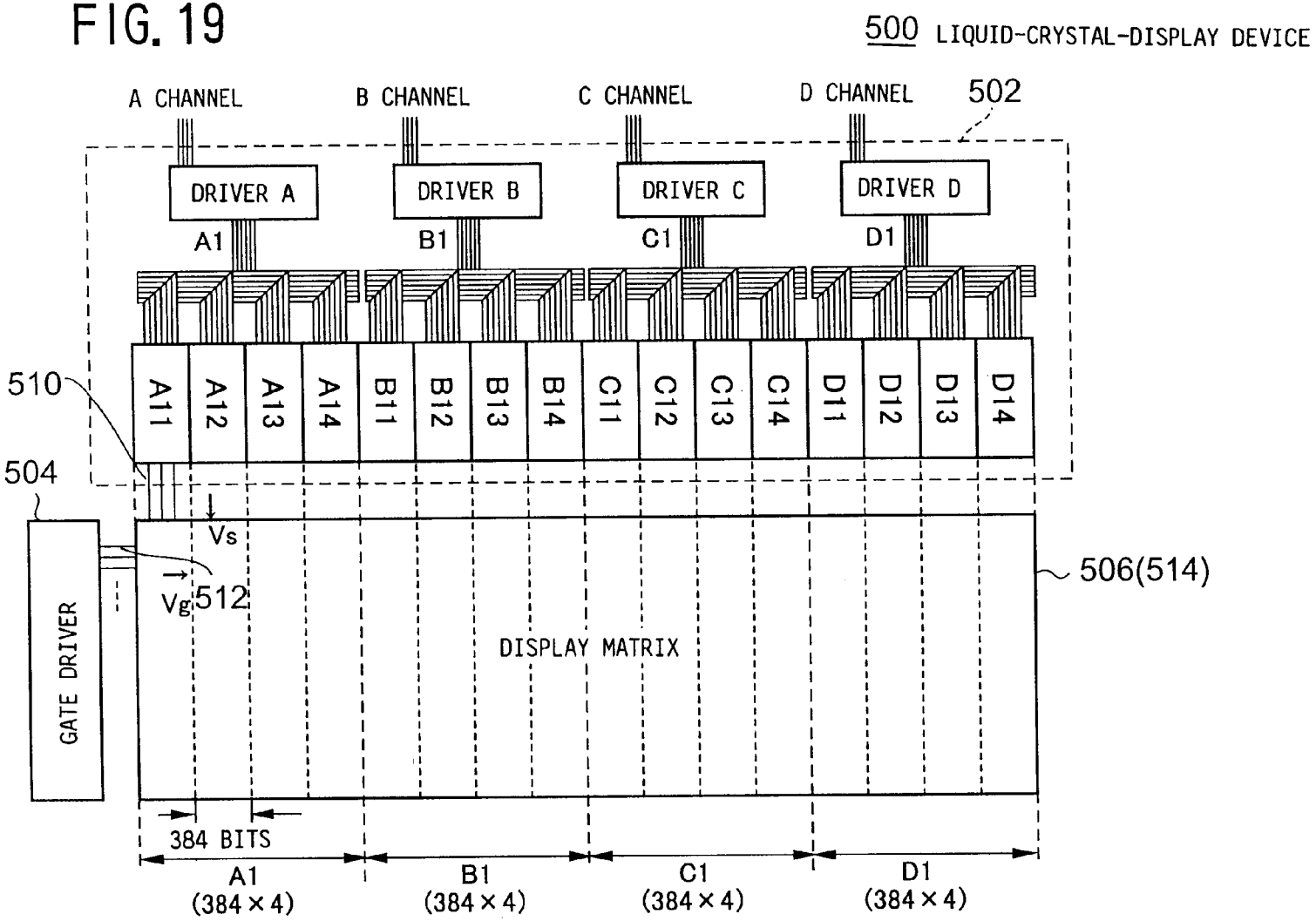
FIG. 19 is a block diagram showing an entire configuration of a liquid-crystal-display device according to a fifth embodiment.

FIG. 19 is a block diagram showing an entire configuration of the liquid-crystal-display device 500.

As shown in FIG. 19, the liquid-crystal-display device 500 includes a data driver 502, a gate driver 504, and a display matrix 506. The liquid-crystal-display device 500 is an embodiment of the liquid-crystal-display device 50 shown in FIG. 3, with N=4, k=1, n=4, and m=384. Namely, the data driver 502 includes drivers A, B, C, and D each having 384-bit outputs and implemented via TAB implementation, 384-bit common-signal lines A1, B1, C1, and D1, and 16 switch blocks A11 through A14, B11 through B14, C11 through C14, and D11 through D14. The display matrix 506 includes pixel cells 514 arranged in a 6144-bit×1536-bit matrix.

The liquid-crystal-display device 500 is characterized in that it is of a multi-driver type provided with the plurality of drivers A, B, C, and D.

Other details of the liquid-crystal-display device 500 are the same as those of the liquid-crystal-display device 100 shown in FIG. 6, and a description thereof will be omitted.

Figure 20:
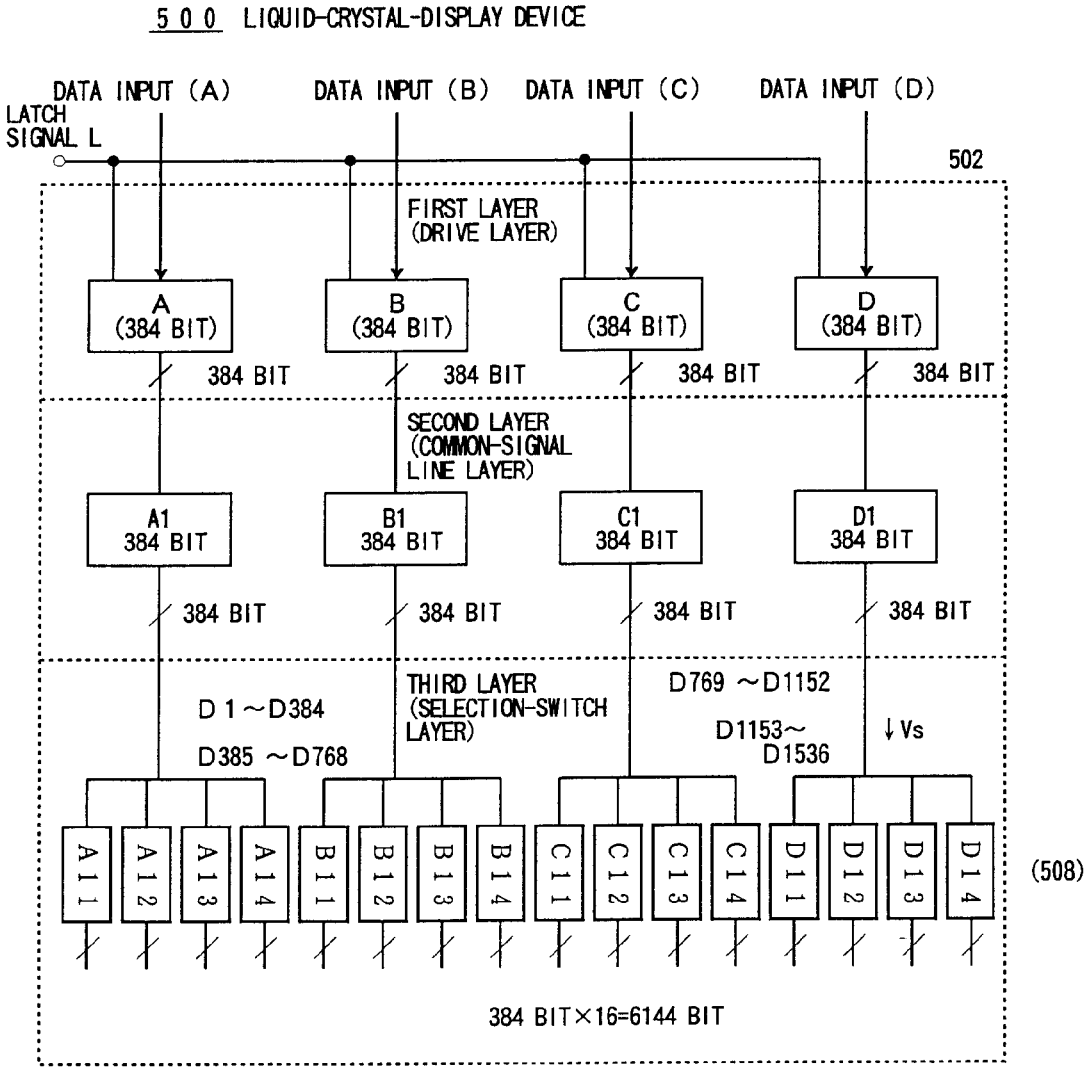
FIG. 20 is a block diagram of a data driver provided in the liquid-crystal-display device of FIG. 19.

FIG. 20 is a block diagram of the data driver 502 provided in the liquid-crystal-display device 500.

As shown in FIG. 20, the data driver 502 has the drivers A, B, C, and D provided in the first layer DB, the 384-bit common-signal lines A1, B1, C1, and D1 in the second layer CB, and the 16 switch blocks A11 through A14, B11 through B14, C11 through C14, and D11 through D14 in the third layer SB. The switch blocks A11 through A14, B11 through B14, C11 through C14, and D11 through D14 each include 384 analog switches 508, which may be of a CMOS type. Namely, the data driver 502 is provided with the analog switches 508 as many as 6144 (=16×384). It should be noted that the analog switches 508 may be of an NMOS type or a PMOS type rather than the CMOS type.

The 384-bit outputs of the driver A are connected to the common-signal line A1. The signal lines D1 through D384 of the common-signal line A1 are connected to the respective analog switches 508 in each of the switch blocks A11 through A14. Configurations of the drivers B, C, and D in the liquid-crystal-display device 500 are the same as that of the driver A, and a description thereof will be omitted.

FIG. 21 is a table showing control timings of switch blocks during one horizontal scan period Th of the liquid-crystal-display device 500.

In the liquid-crystal-display device 500, one horizontal scan period Th is comprised of 4 timing blocks BL1 through BL4. As the control signals BL1 through BL4 are successively supplied, the analog switches 508 are switched on in the corresponding blocks selected from the switch blocks A11 through A14, B11 through B14, C11 through C14, and D11 through D14.

In the following, operation of the liquid-crystal-display device 500 will be described with reference to FIG. 19 through FIG. 22.

Figure 22:
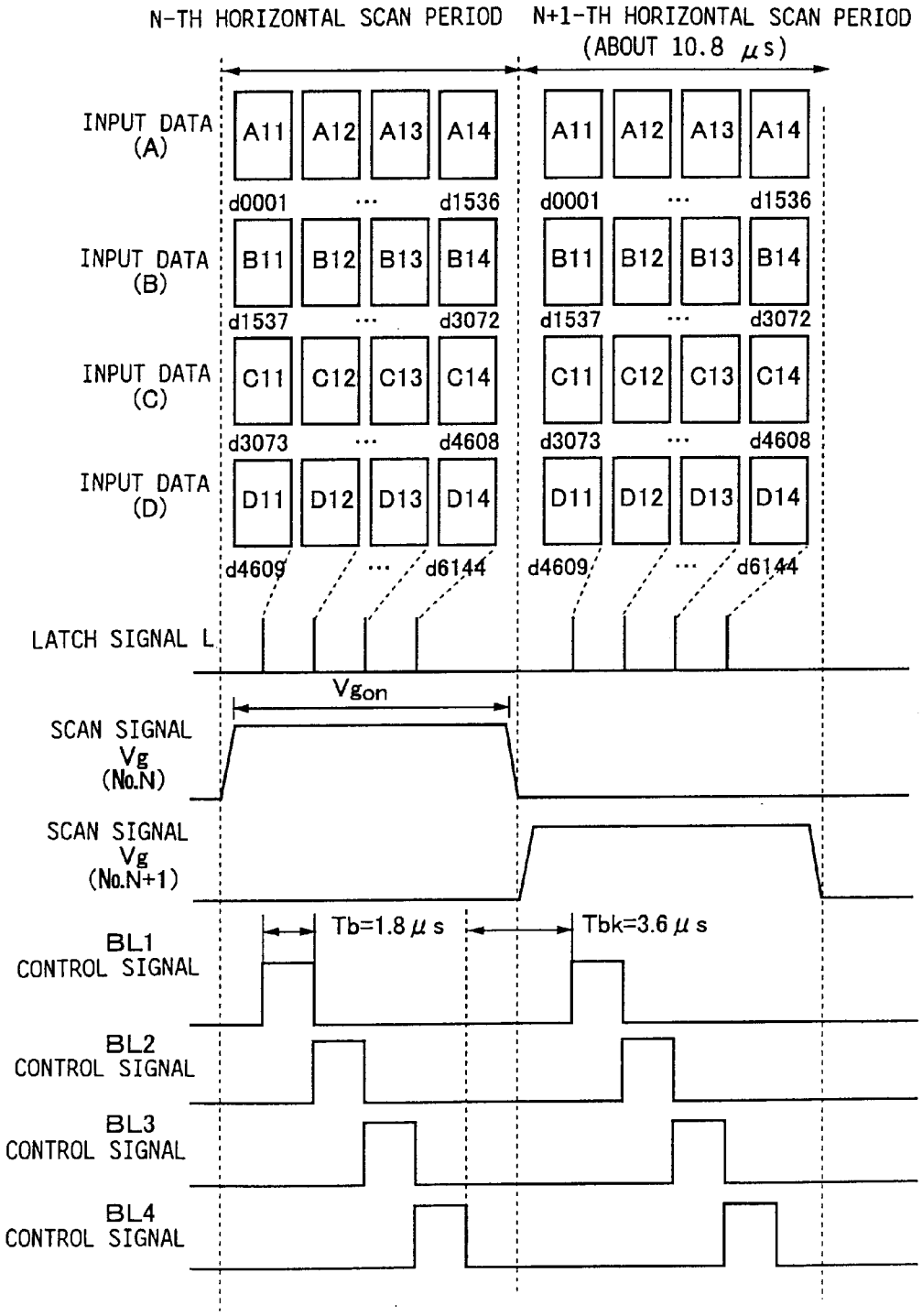
FIG. 22 is timing charts showing operation of the liquid-crystal-display device of FIG. 19.

FIG. 22 is timing charts showing operation of the liquid-crystal-display device 500.

As shown in FIG. 22, one horizontal scan period Th includes 4 timing blocks BL1 through BL4. On both sides of the horizontal scan period Th is provided a blanking interval Tbk, which is comprised of a rise time and a fall time of the scan signals Vg. For example, the horizontal scan period Th is approximately 10.8 μs, and each of the timing blocks BL1 through BL4 has a time length Tb of about 1.8 μs. Further, one blanking interval Tbk is approximately 3.6 μs. For the sake of explanation, the signal lines 510 laid out from the first row to the $6144^{th}$ row in the display matrix 506 are referred to as d0001 through d6144.

When the gate driver 104 as shown in FIG. 19 supplies a high-level scan signal Vg to the first row of the scan lines 512 in the display matrix 506, the control signal BL1 is supplied to the analog switches 508 of the switch blocks A11, B11, C11, and D11 during the first timing block BL1. As a result, a total of 1536 analog switches 508 are switched on in the switch blocks A11, B11, C11, and D11. When this happens, the video signals Vs are supplied from the drivers A, B, C, and D to the pixel cells 514 as connections therebetween are established via the switched-on analog switches 508 and the signal lines d0001 through d0384, d1537 through d1920, d3073 through d3456, and d4609 through d4992, thereby effecting liquid-crystal display.

During the second timing block BL2, the control signal BL2 is supplied to the analog switches 508 of the switch blocks A12, B12, C12, and D12. As a result, a total of 1536 analog switches 508 are switched on in the switch blocks A12, B12, C12, and D12. When this happens, the video signals Vs are supplied from the drivers A, B, C, and D to the pixel cells 514 as connections therebetween are established via the switched-on analog switches 508 and the signal lines d0385 through d0768, d1921 through d2304, d3457 through d3840, and d4993 through d5376, thereby effecting liquid-crystal display.

The operation as described above is repeated until the control signal BL4 is supplied to the analog switches 508 of the switch blocks A14, B14, C14, and D14, resulting in the video signals Vs being written in the corresponding 1536 pixel cells 514, which marks the end of the horizontal scan period Th.

It should be noted that the locations of the drivers A, B, C, and D are not limited to the locations as shown in FIG. 19, and that these drivers may be arranged as in a liquid-crystal-display device 600 described below.

Figure 23:
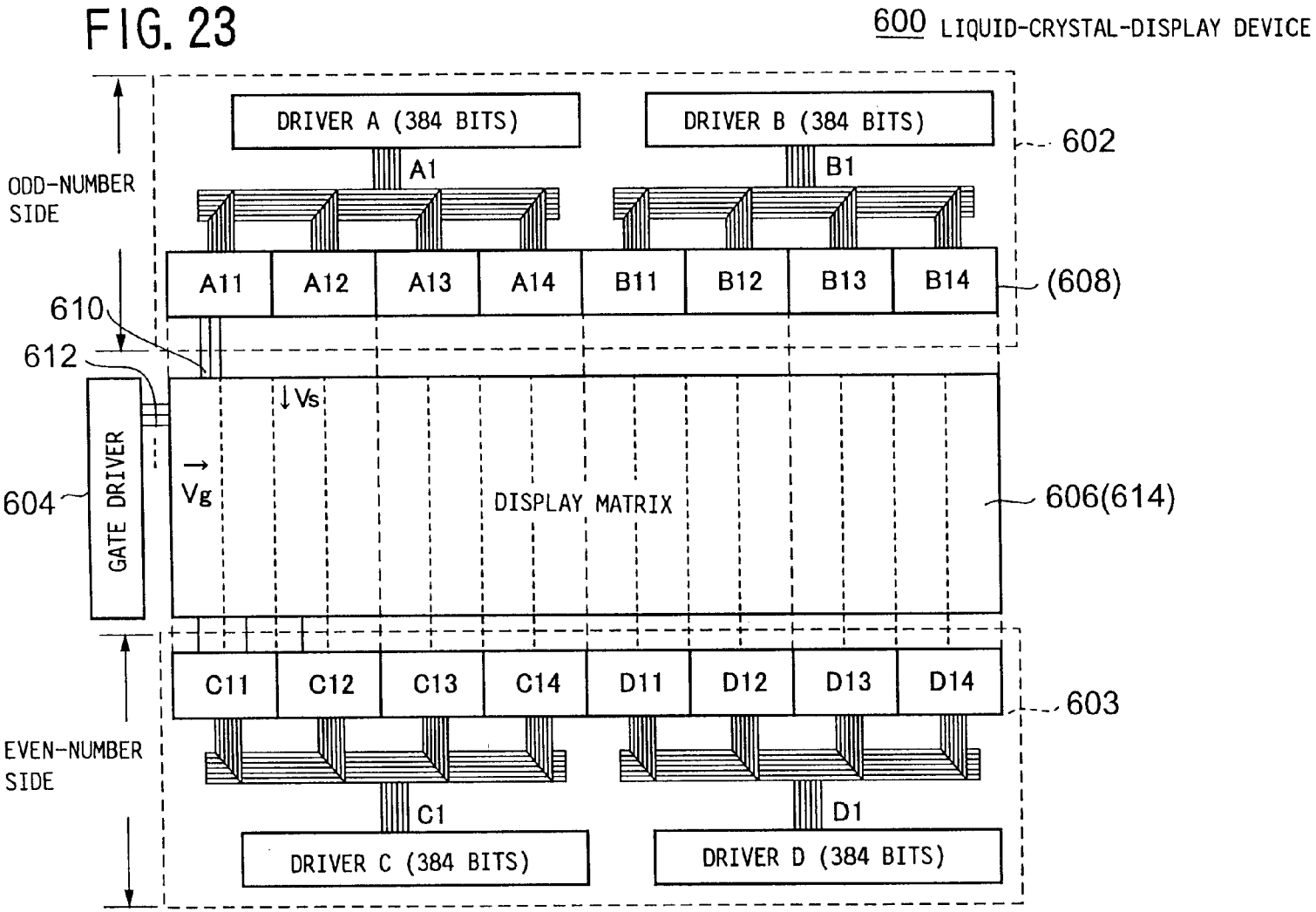
FIG. 23 is a block diagram of a liquid-crystal-display device according to a sixth embodiment.

FIG. 23 is a block diagram of the liquid-crystal-display device 600.

As shown in FIG. 23, the liquid-crystal-display device 600 includes data drivers 602 and 603, a gate driver 604, and a display matrix 606. The liquid-crystal-display device 600 is an embodiment of the liquid-crystal-display device 50 shown in FIG. 3, with N=4, k=1, n=4, and m=384, which are the same configuration as that of the liquid-crystal-display device 500 shown in FIG. 19.

The liquid-crystal-display device 600 is of a multi-driver type as is the liquid-crystal-display device 500, and may be characterized in that the two data drivers 602 and 603 are provided to face each other across the display matrix 606.

The 3072 analog switches 608 in the switch blocks A11 through A14 and B11 through B14 are connected to signal lines 612 arranged in odd-number rows in the display matrix 606. Further, the 3072 analog switches 608 in the switch blocks C11 through C14 and D11 through D14 are connected to signal lines 610 arranged in even-number rows in the display matrix 606.

Other details and operations of the liquid-crystal-display device 600 are the same as those of the liquid-crystal-display device 500 shown in FIG. 19, and a description thereof will be omitted.

In what follows, a liquid-crystal-display device 700 of the QSXGA type according to a seventh embodiment of the present invention will be described with reference to FIG. 24 through FIG. 25.

Figure 24:
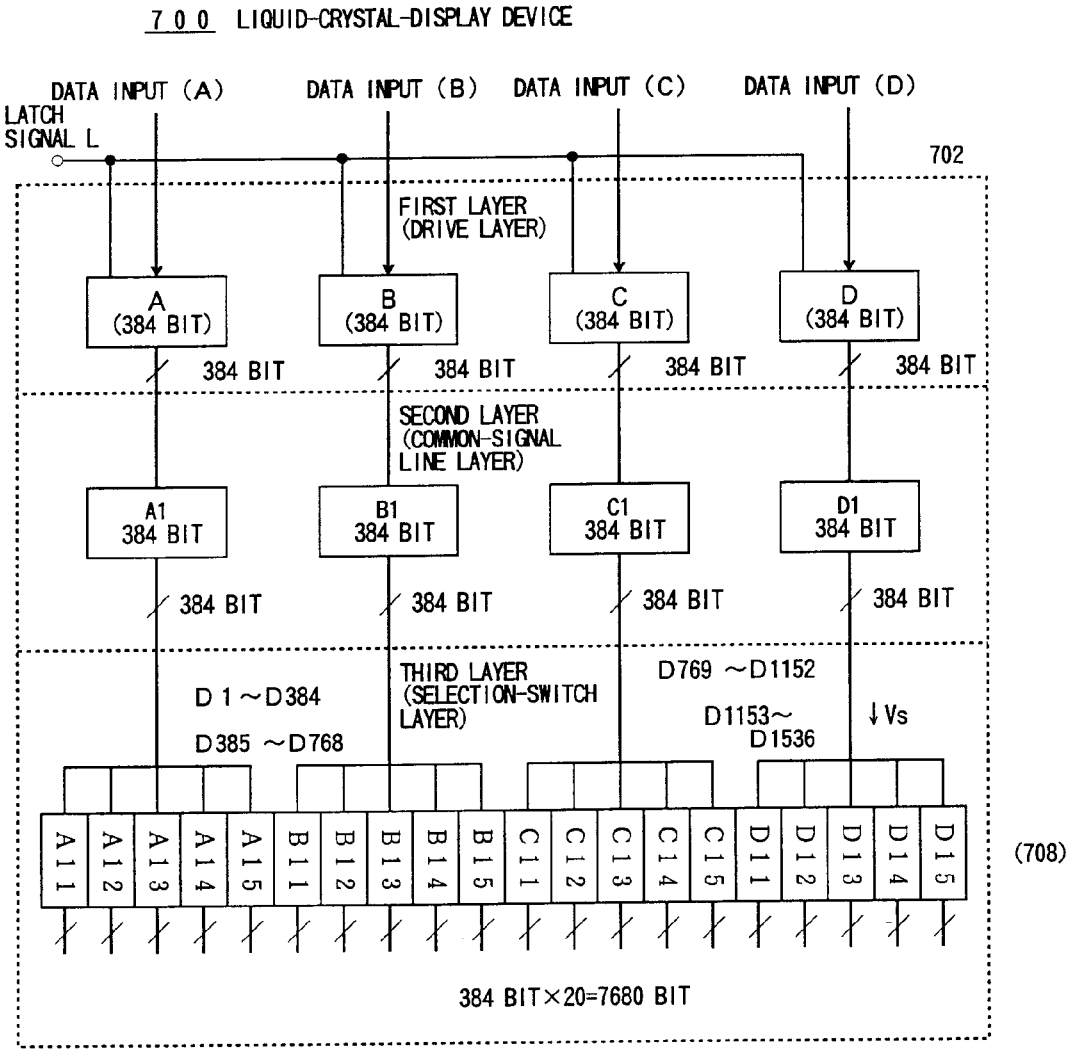
FIG. 24 is a block diagram of a data driver provided in a liquid-crystal-display device of a seventh embodiment.

FIG. 24 is a block diagram of a data driver 702 provided in the liquid-crystal-display device 700.

As shown in FIG. 24, the data driver 702 has the driver A, B, C, and D provided in the first layer DB via TAB implementation, the 384-bit common-signal lines A1, B1, C1, and D1 in the second layer CB, and the 20 switch blocks A11 through A15, B11 through B15, C11 through C15, and D11 through D15 in the third layer SB. The switch blocks A11 through A15, B11 through B15, C11 through C15, and D11 through D15 each include 384 analog switches 708, which may be of a CMOS type.

Namely, the liquid-crystal-display device 700 is an embodiment of the liquid-crystal-display device 50 shown in FIG. 3, with N=4, k=1, n=5, and m=384. The data driver 702 is provided with the analog switches 708 as many as 7680 (=20×384). It should be noted that the analog switches 708 may be of an NMOS type or a PMOS type rather than the CMOS type.

The liquid-crystal-display device 700 is of a multi-driver type as are the liquid-crystal-display devices 500 and 600, and may be characterized in that the five switch blocks are provided for each of the common-signal lines A1, B1, C1, and D1.

The 384-bit outputs of the driver A are connected to the common-signal line A1. The signal lines D1 through D384 of the common-signal line A1 are connected to the respective analog switches 708 in each of the switch blocks A11 through A15.

Configurations of the drivers B, C, and D in the liquid-crystal-display device 700 are the same as that of the driver A, and a description thereof will be omitted. Other details of the configuration of the liquid-crystal-display device 700 are the same as those of the liquid-crystal-display device 500 shown in FIG. 19, and a description thereof will be omitted.

FIG. 25 is a table showing control timings of switch blocks during one horizontal scan period Th of the liquid-crystal-display device 700.

In the liquid-crystal -display device 700 , one horizontal scan period Th such as 8.1 $\mu$s is comprised of 5 timing blocks BL1 through BL5. As the control signals BL1 through BL5 are successively supplied, the analog switches 708 are switched on as many as 1536 switches at a time in the corresponding blocks selected from the switch blocks A11 through A15, B11 through B15, C11 through C15, and D11 through D15.

As described above, the liquid-crystal-display devices 500, 600, and 700 of the fifth through seventh respective embodiments are provided with the common-signal lines A1, B1, C1, and D1. During each of the timing blocks, a plurality of blocks are successively selected in each of the common-signal lines A1 through D1, so that the video signals Vs can be written as data having a wide data width without widening the wiring width of the common-signal lines. For example, the liquid-crystal-display device 500 can write the video signals Vs in the display matrix 506 having 6144 pixels in the horizontal direction by use of the 384-bit common-signal lines A1 through D1. In this manner, the fifth through seventh embodiments use the common-signal lines A1 through D1 each comprised of a relatively small number of bits, thereby achieving a capacitance load, a resistance load, and a RC time constant that are each relatively small.

Since the fifth through seventh embodiments have a multi-driver configuration comprised of the four drivers A1 through D1, so that it suffices to use drivers having a small number of output bits. This contributes to a cost reduction of the liquid-crystal-display devices 500, 600, and 700.

In the case of a conventional a-Si panel, the number of total outputs of drivers is equal to the number of pixels arranged in the horizontal direction. In order to drive a QXGA panel (which has 6144 horizontally arranged bits), for example, drivers having 384-bit outputs need to be provided as many as 16. In the fifth through seventh embodiments, on the other hand, each driver outputs the video signals Vs four times in a horizontal scan period Th, so that the four drivers A1 through D1 are all that is necessary to drive the QXGA panel.

In what follows, a liquid-crystal-display device 800 of the XGA type according to an eighth embodiment of the present invention will be described with reference to FIG. 26 through FIG. 29.

Figure 26:
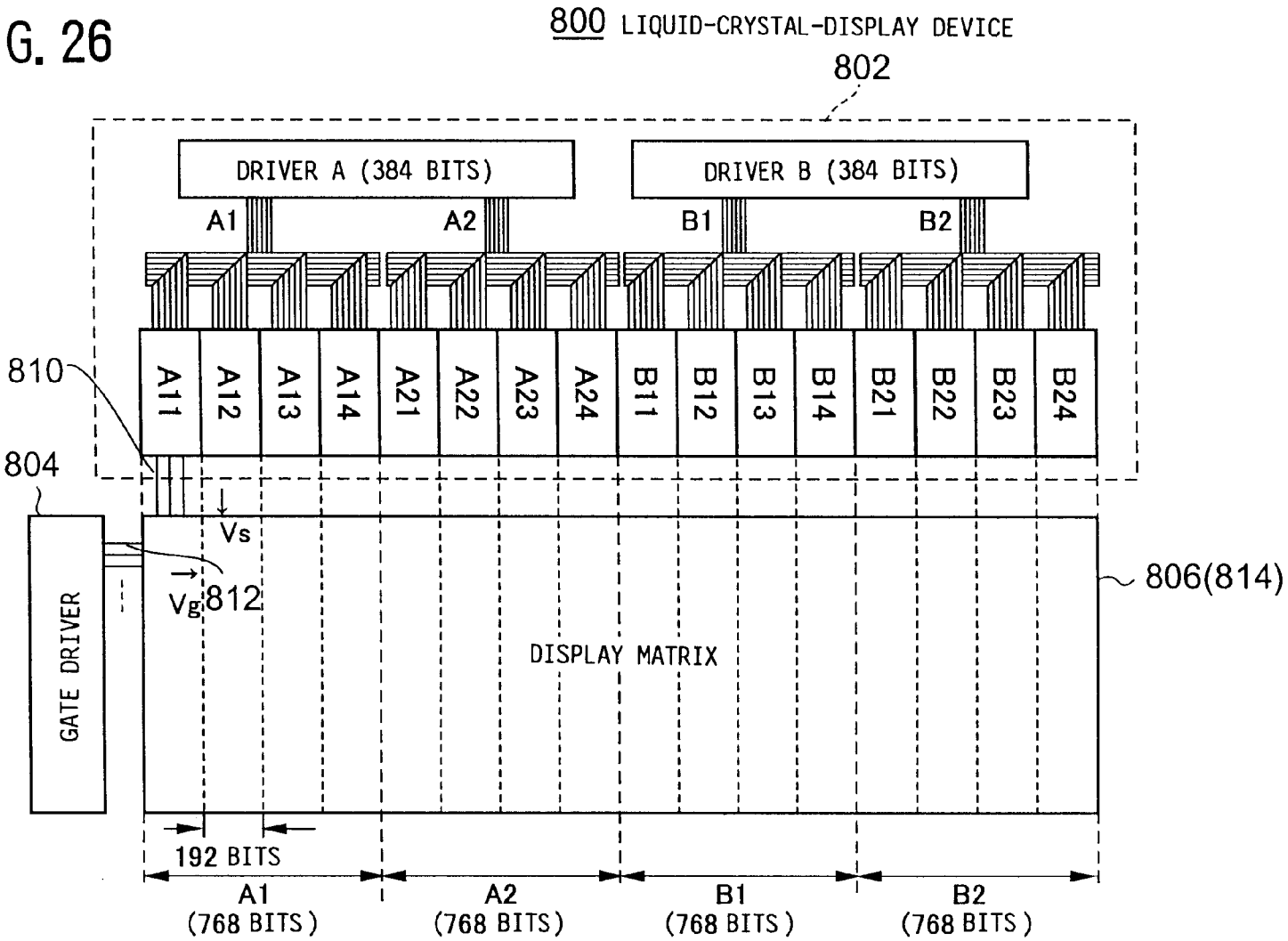
FIG. 26 is a block diagram showing an entire configuration of a liquid-crystal-display device according to an eighth embodiment.

FIG. 26 is a block diagram showing an entire configuration of the liquid-crystal-display device 800.

As shown in FIG. 26, the liquid-crystal-display device 800 includes a data driver 802, a gate driver 804, and a display matrix 806. The liquid-crystal-display device 800 is an embodiment of the liquid-crystal-display device 50 shown in FIG. 3, with N=2, k=2, n=4, and m=384. Namely, the data driver 802 includes two TAB-implemented drivers A and B each having 384-bit outputs, 384-bit common-signal lines A1, A2, B1, and B2, and 16 switch blocks A11 through A14, A21 through A24, B11 through B14, and B21 through B24. The display matrix 806 includes pixel cells 814 arranged in a 3072-bit×768-bit matrix.

The liquid-crystal-display device 800 is characterized in that it is of a multi-driver type as are the liquid-crystal-display devices 500, 600, and 700, and that each driver is connected to two sets of common-signal lines.

Other details of the liquid-crystal-display device 800 are the same as those of the liquid-crystal-display device 100 shown in FIG. 6, and a description thereof will be omitted.

Figure 27:
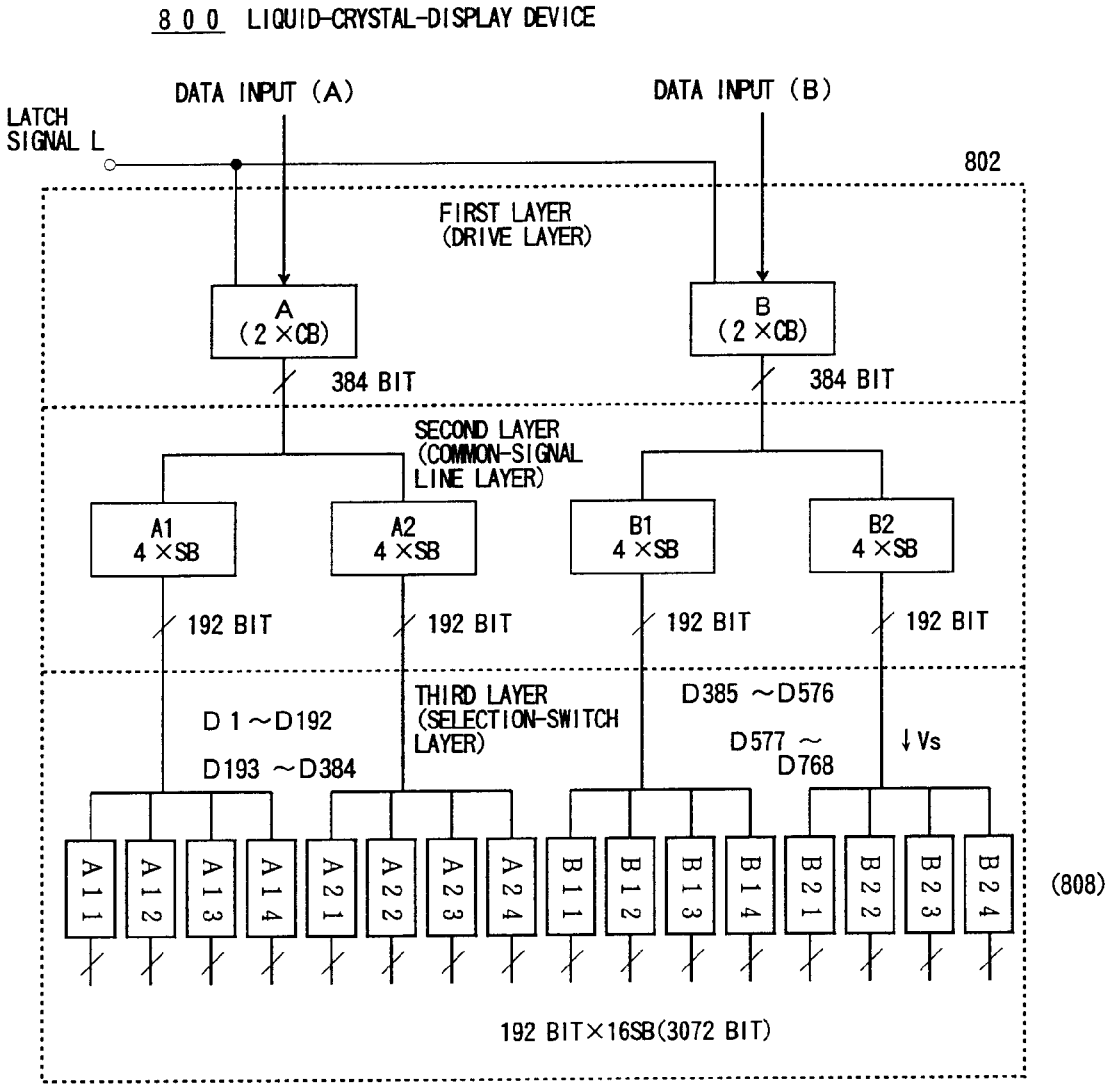
FIG. 27 is a block diagram of a data driver provided in the liquid-crystal-display device of FIG. 26.

FIG. 27 is a block diagram of the data driver 802 provided in the liquid-crystal-display device 800.

As shown in FIG. 27, the data driver 802 has the drivers A and B provided in the first layer DB, the 192-bit common-signal lines A1, A2, B1, and B2 in the second layer CB, and the 16 switch blocks A11 through A14, A21 through A24, B11 through B14, and B21 through B24 in the third layer SB. The switch blocks A11 through A14, A21 through A24, B11 through B14, and B21 through B24 each include 192 analog switches 808, which may be of a CMOS type. Namely, the data driver 802 is provided with the analog switches 808 as many as 3072 (=16×192).

It should be noted that the analog switches 808 may be of an NMOS type or a PMOS type rather than the CMOS type.

The 384-bit outputs of the driver A are connected to the common-signal lines A1 and A2. The signal lines D1 through D192 of the common-signal line A1 are connected to the respective analog switches 808 in each of the switch blocks A11 through A14. The 192 signal lines D193 through D384 of the common-signal line A2 are connected to the respective analog switches 808 in each of the switch blocks A21 through A24.

In the liquid-crystal-display device 800, a configuration associated with the driver B is the same as that of the driver A, and a description thereof will be omitted.

FIG. 28 is a table showing control timings of switch blocks during one horizontal scan period Th of the liquid-crystal-display device 800.

In the liquid-crystal -display device 800, one horizontal scan period Th is comprised of 4 timing blocks BL1 through BL4. As the control signals BL1 through BL4 are successively supplied, the analog switches 808 are switched on in the corresponding blocks selected from the switch blocks A11 through A14, A21 through A24, B11 through B14, and B21 through B24.

In the following, operation of the liquid-crystal-display device 800 will be described with reference to FIG. 26 through FIG. 29.

Figure 29:
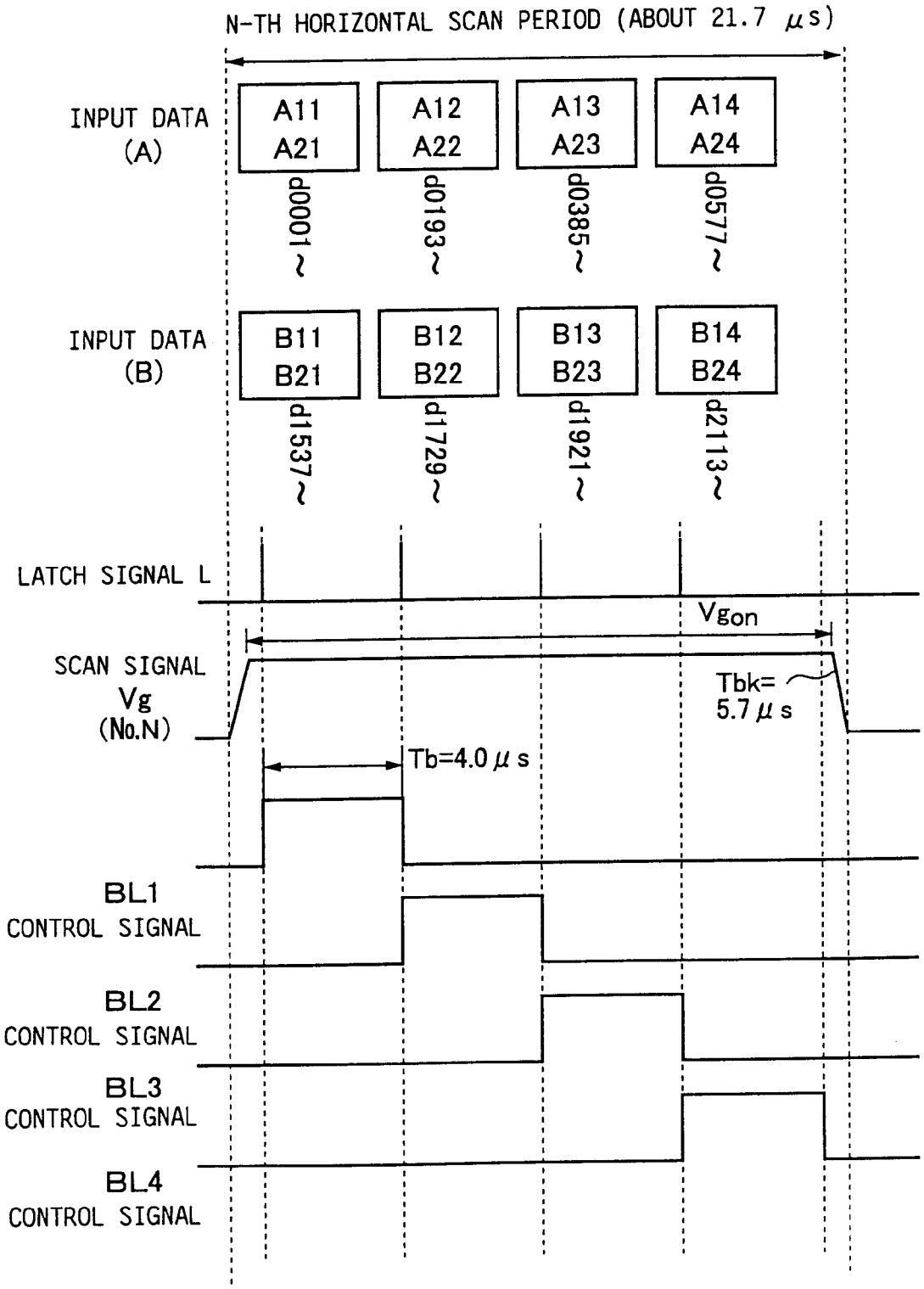
FIG. 29 is timing charts showing operation of the liquid-crystal-display device of FIG. 26.

FIG. 29 is timing charts showing operation of the liquid-crystal-display device 800.

As shown in FIG. 29, one horizontal scan period Th includes 4 timing blocks BL1 through BL4. On both sides of the horizontal scan period Th is provided a blanking interval Tbk, which is comprised of a rise time and a fall time of the scan signals Vg. For example, the horizontal scan period Th is approximately 21.7 μs, and each of the timing blocks BL1 through BL4 has a time length Tb of about 4.0 μs. Further, one blanking interval Tbk is approximately 5.7 μs. For the sake of explanation, the signal lines 810 laid out from the first row to the $3072^{nd}$ row in the display matrix 806 are referred to as d0001 through d3072.

When the gate driver 804 as shown in FIG. 26 supplies a high-level scan signal Vg to the first row of the scan lines 812 in the display matrix 806, the control signal BL1 is supplied to the analog switches 808 of the switch blocks A11, A21, B11, and B21 during the first timing block BL1. As a result, a total of 768 analog switches 808 are switched on in the switch blocks A11, A21, B11, and B21. When this happens, the video signals Vs are supplied from the drivers A and B to the pixel cells 814 as connections therebetween are established via the switched-on analog switches 808 and the signal lines d0001 through d0192, d0769 through d0960, d1537 through d1728, and d2305 through d2496, thereby effecting liquid-crystal display.

During the second timing block BL2, the control signal BL2 is supplied to the analog switches 808 of the switch blocks A12, A22, B12, and B22. As a result, a total of 768 analog switches 808 are switched on in the switch blocks A12, A22, B12, and B22. When this happens, the video signals Vs are supplied from the drivers A and B to the pixel cells 814 as connections therebetween are established via the switched-on analog switches 808 and the signal lines d0193 through d0384, d0961 through d1152, d1729 through d1920, and d2497 through d2689, thereby effecting liquid-crystal display.

The operation as described above is repeated until the control signal BL4 is supplied to the analog switches 808 of the switch blocks A14, A24, B14, and B24, resulting in the video signals Vs being written in the corresponding 768 pixel cells 814, which marks the end of the horizontal scan period Th.

In the following, a liquid-crystal-display device 900 of the SXGA type according to a ninth embodiment of the present invention will be described with reference to FIG. 30 and FIG. 31.

Figure 30:
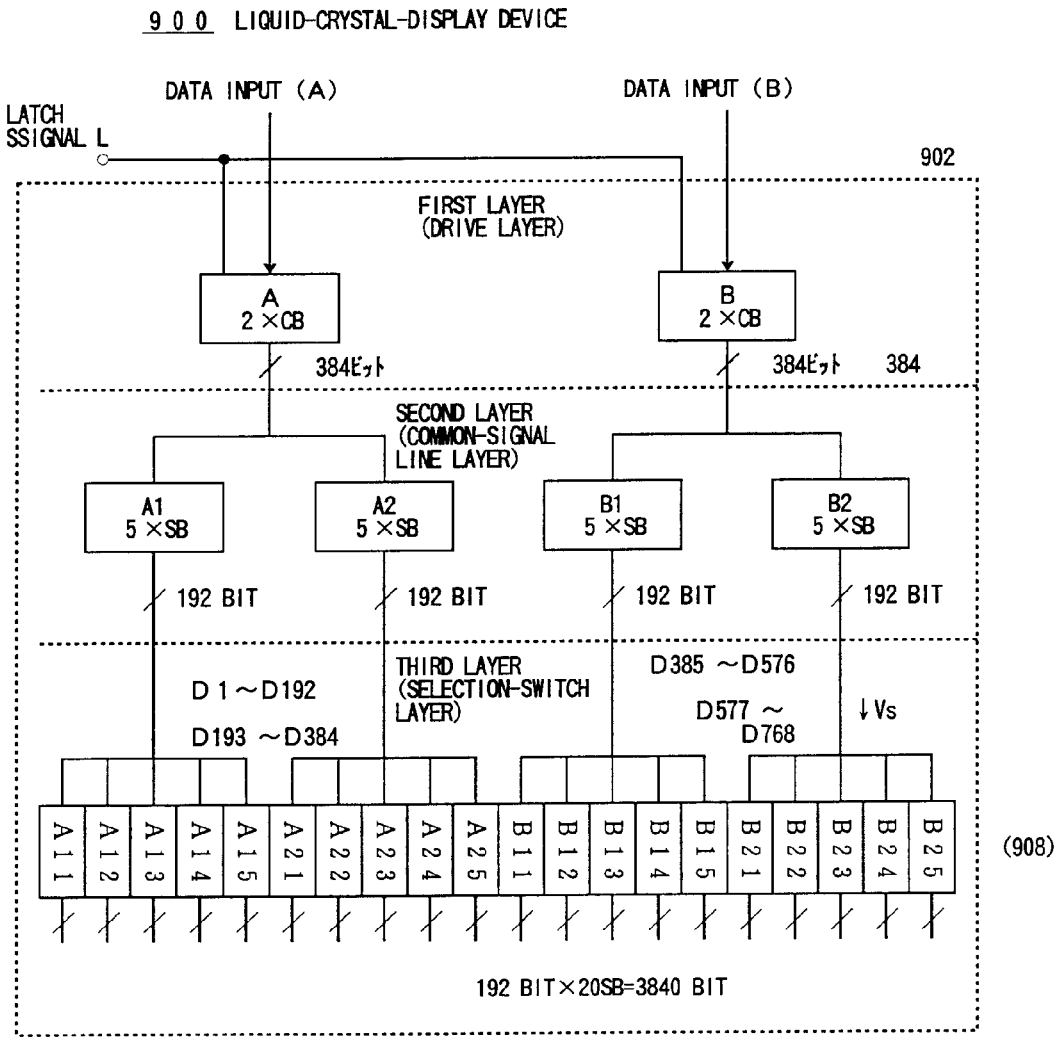
FIG. 30 is a block diagram of a data driver provided in a liquid-crystal-display device of a ninth embodiment.

FIG. 30 is a block diagram of a data driver 902 provided in the liquid-crystal-display device 900. As shown in FIG. 30, the data driver 902 includes the TAB-implemented drivers A and B in the first layer DB, the 192-bit common-signal lines A1, A2, B1, and B2 in the second layer CB, and 20 switch blocks A11 through A15, A21 through A25, B11 through B15, and B21 through B25 in the third layer SB. The switch blocks A11 through A15, A21 through A25, B11 through B15, and B21 through B25 each include 192 analog switches 908, which may be of a CMOS type.

Namely, the liquid-crystal-display device 900 is an embodiment of the liquid-crystal-display device 50 shown in FIG. 3, with N=2, k=2, n=5, and m=192. In total, the data driver 902 includes 3840 analog switches 908 where 3840 is 20×192. It should be noted that the analog switches 908 may be of an NMOS type or a PMOS type rather than the CMOS type.

The liquid-crystal-display device 900 is characterized in that it is of a multi-driver type as is the liquid-crystal-display device 800, and in that each driver is connected to two sets of common-signal lines, each of which is in turn connected to 5 switch blocks.

The 384-bit outputs of the driver A are connected to the common-signal lines A1 and A2. The signal lines D1 through D192 of the common-signal line A1 are connected to the respective analog switches 908 in each of the switch blocks A11 through A15. The signal lines D193 through D384 of the common-signal line A2 are connected to the respective analog switches 908 in each of the switch blocks A21 through A25. A configuration surrounding the driver B is the same as that of the driver A, and a description thereof will be omitted. Other details of the configuration of the liquid-crystal-display device 900 are the same as those of the liquid-crystal-display device 800 shown in FIG. 26, and a description thereof will be omitted.

FIG. 31 is a table showing control timings of switch blocks during one horizontal scan period Th of the liquid-crystal-display device 900.

In the liquid-crystal-display device 900, one horizontal scan period Th is comprised of 5 timing blocks BL1 through BL5. As the control signals BL1 through BL5 are successively supplied, analog switches 908 are switched on in corresponding switch blocks selected from the switch blocks A11 through A15, A21 through A25, B11 through B15, and B21 through B25.

As described above, the liquid-crystal-display device 800 or 900 of the first or second embodiment has the drivers A and B each connected to the two common-signal lines, which are each comprised of 192 signal lines such as D1 through D192 and D193 through D384. Because of this configuration, the number of signal lines that exist in each of the common-signal lines A1, A2, B1, and B2 is about half of that of the related-art liquid-crystal-display device 10 shown in FIG. 1 and FIG. 2, so that the wiring width of the common-signal line is also reduced to half. When the wiring pitch of the common-signal line is 16 μm, for example, the common-signal lines D1 through D384 of the related art require the wiring width of 6.14 mm (16 μm×384). On the other hand, the common-signal line A1, A2, B1, or B2 of the liquid-crystal-display device 800 or 900 requires only the wiring width of 3.07 mm (16 μm×192). Accordingly, the present embodiments achieve a light-weight structure and miniaturization of panel-frame size by reducing the wiring width of common-signal lines.

In order to achieve a signal-writing speed of 4.0 μs/block in the related-art liquid-crystal-display device 10 of the XGA type shown in FIG. 1, the display matrix 18 needs to be comprised of 4 blocks, and the data width of each block needs to be set to 768 bits. In this case, the common-signal lines D1 through D768 intersect with the lead lines 31 at 3068 (=(768−1)×4) locations at the maximum.

On the other hand, the common-signal lines D1 through D192 of the liquid-crystal-display device 800 of the eighth embodiment, for example, intersect with lead lines at 764 (=(192−1)×4) locations at the maximum where the lead lines connect between the common-signal lines D1 through D192 and the analog switches 908. Assuming that capacitance per intersection is 5 fF, the total capacitance of the common-signal lines D1 through D768 is 15.3 pF in the related-art configuration. Under the same assumption, the common-signal lines D1 through D192 of the eighth embodiment have the capacitance of 3.8 pF. This is half the capacitance of the common-signal lines D1 through D384 of the first embodiment since the capacitance of the first embodiment is 7.6 pF. In this manner, the eighth and ninth embodiments described above can reduce the intersection capacitance of the common-signal lines A1, A2, B1, and B2 by a significant margin.

Further, the liquid-crystal-display device of the eighth or ninth embodiment has the two sets of common-signal lines A1, A2, B1, and B2 so that their horizontal extension becomes half of that of the related art. Because of this, the eighth and ninth embodiments can reduce the wiring resistance of the common-signal lines A1, A2, B1, and B2. For example, if a 12.1-inch XGA panel has a pixel pitch of 0.24 μm, a horizontal extension of the display matrix being 245.76 mm (0.24 μm×1024), a wiring pitch of the common-signal lines being 16 μm, and a unit-length wiring-sheet resistance being 0.2 Ω, the total resistance would be 6.14 kΩ in the case of the related art. In contrast, the total resistance would be 1.5 kΩ in the case of the eighth embodiment, and this figure is half as large as that of the first embodiment.

In this manner, the liquid-crystal-display device of the eighth or ninth embodiment has the intersection capacitance and wiring resistance of the common-signal lines reduced in comparison with the related-art configuration, thereby achieving a significantly reduced RC time constant. For example, the time constant RC of the eighth embodiment is 5.7 ns (=1.5 kΩ×3.8 pF). This is 1/16 of the time constant RC of the XGA-type related-art configuration in which the time constant RC is 93.9 ns (=6.14 kΩ×15.3 pF), and is 1/4 of the time constant RC of the first embodiment in which the time constant RC is 23.3 ns (=3.07 kΩ×7.6 pF).

In this manner, the eighth and ninth embodiments of the present invention can further improve the time constant, thereby further enhancing image quality in the liquid-crystal-display device.

In the following, a liquid-crystal-display device 910 of the QXGA type according to a first embodiment of the present invention will be described with reference to FIG. 32 through FIG. 38.

Figure 32:
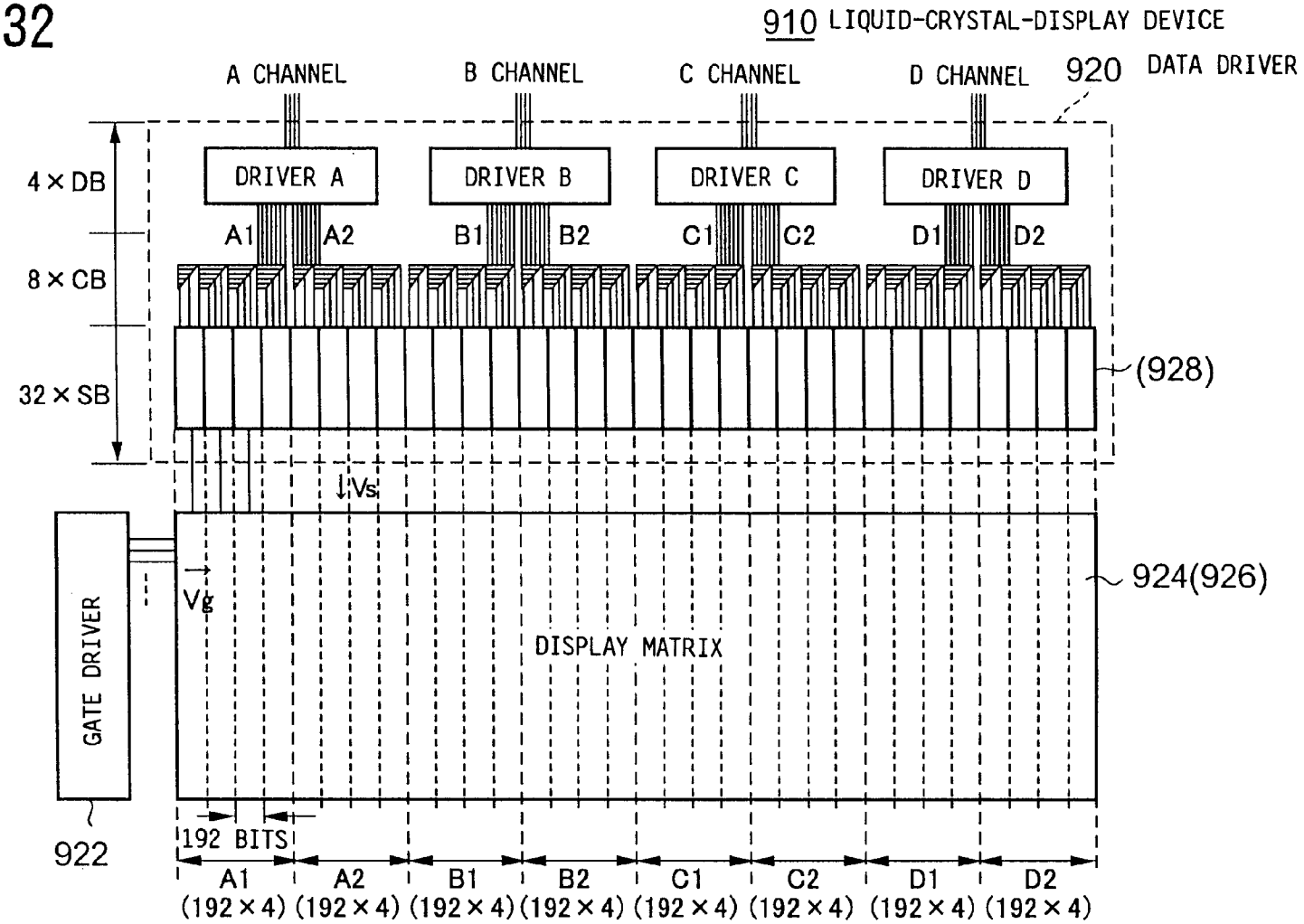
FIG. 32 is a block diagram showing a configuration of a liquid-crystal-display device of a tenth embodiment.

FIG. 32 is a block diagram showing a configuration of a liquid-crystal-display device 910.

As shown in FIG. 32, the liquid-crystal-display device 910 includes a data driver 920, a gate driver 922, and a display matrix 924. The liquid-crystal-display device 910 is an embodiment of the liquid-crystal-display device 50 shown in FIG. 3, with N=4, k=2, n=4, and m=192. Namely, the data driver 920 includes four TAB-implemented drivers A, B, C, and D each having 384-bit outputs, 192-bit common-signal lines A1, A2, B1, B2, C1, C2, D1, and D2, and 32 switch blocks A11 through D24. The display matrix 924 includes pixel cells 926 arranged in a 6144-bit×1536-bit matrix.

The liquid-crystal-display device 910 may be characterized in that it is provided with the four drivers A, B, C, and D, and in that each driver is connected to two sets of common-signal lines.

Other details of the liquid-crystal-display device 910 are the same as those of the liquid-crystal-display device 500 shown in FIG. 19, and a description thereof will be omitted.

Figure 33:
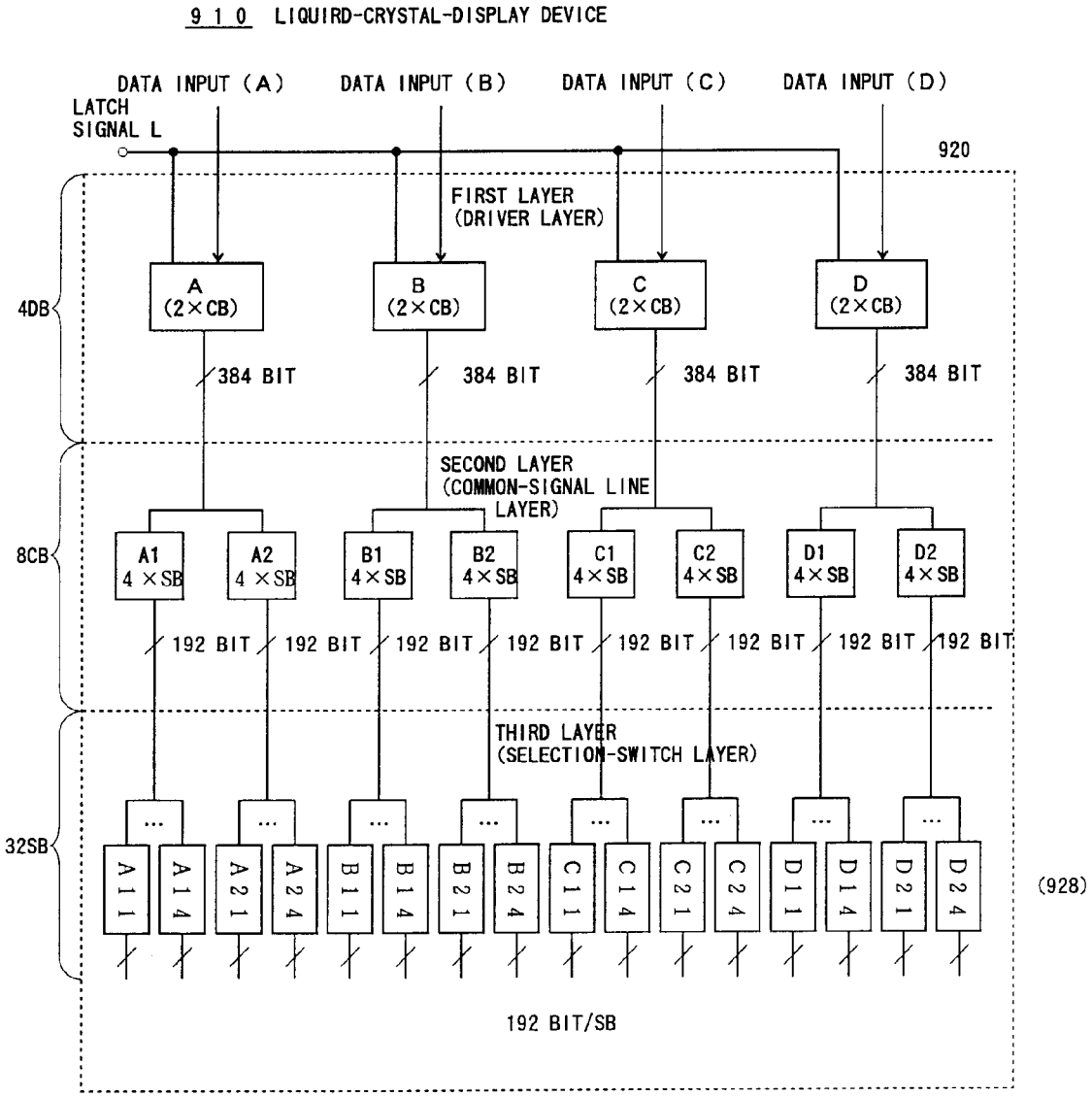
FIG. 33 is a block diagram of a data driver provided in the liquid-crystal-display device of FIG. 32.

FIG. 33 is a block diagram of the data driver 920 provided in the liquid-crystal-display device 910.

As shown in FIG. 33, the data driver 920 has the drivers A, B, C, and D provided in the first layer DB, the 192-bit common-signal lines A1 through D2 in the second layer CB, and the 32 switch blocks A11 through D24 in the third layer SB. Each of the switch blocks includes 192 analog switches 928, which may be of a CMOS type. In total, the data driver 920 includes 6144 analog switches 928 where 6144 is 32×192. It should be noted that the analog switches 928 may be of an NMOS type or a PMOS type rather than the CMOS type.

Figure 34:
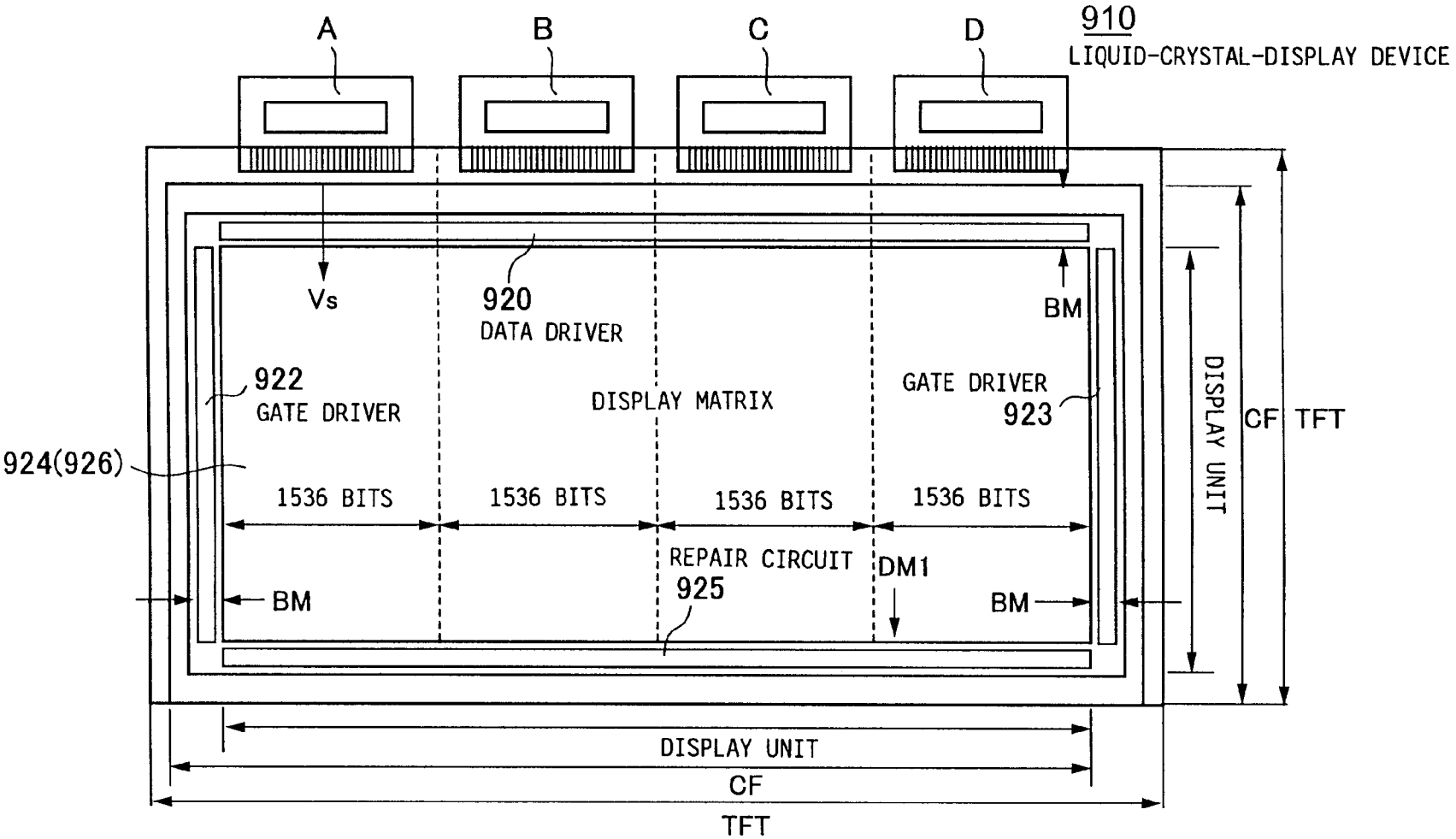
FIG. 34 is an illustrative drawing showing an implementation layout of the liquid-crystal-display device of FIG. 32.

FIG. 34 is an illustrative drawing showing an implementation layout of the liquid-crystal-display device 910.

In an example shown in FIG. 34, the liquid-crystal-display device 910 is a 15-inch-QXGA-low-temperature-p-SiTFT panel, and is provided with two gate drivers 922 and 923.

The liquid-crystal-display device 910 includes the gate drivers 922 and 923, the data driver 920, the display matrix 924, and a repair circuit 925. The repair circuit 925 serves to repair defect signal lines of the display matrix 924.

It should be noted that any one of the liquid-crystal-display devices 100 through 900 of the first through ninth respective embodiments may be provided with a plurality of gate drivers as in the present embodiment.

Figure 35:
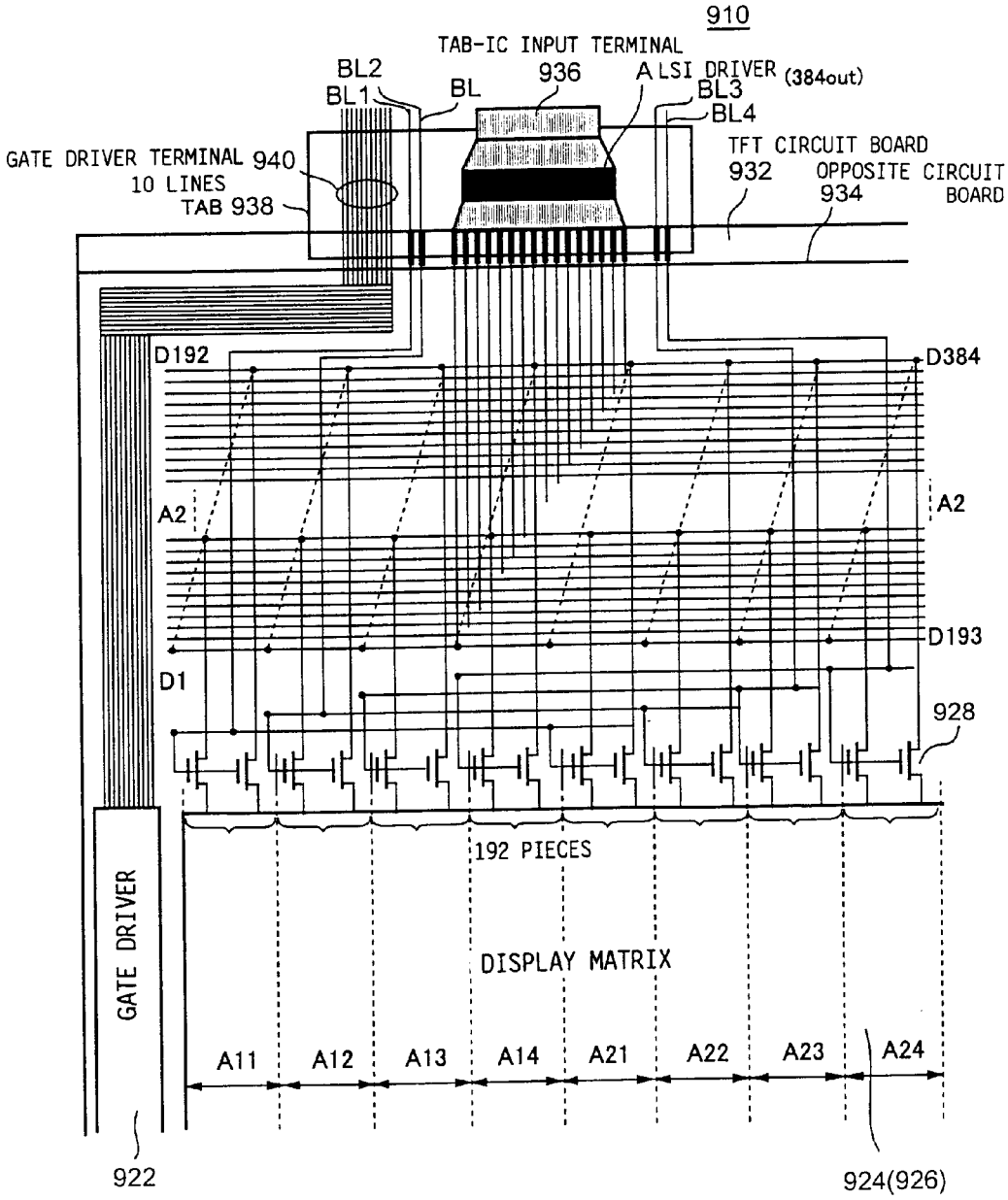
FIG. 35 is a circuit diagram showing a circuitry configuration relevant to a driver A in the liquid-crystal-display device of FIG. 32.

FIG. 35 is a circuit diagram showing a circuitry configuration relevant to the driver A in the liquid-crystal-display device 910.

As shown in FIG. 35, the liquid-crystal-display device 910 includes the driver A, a TFT circuit board 932, an opposite circuit board 934, the gate driver 922, and the display matrix 924.

The driver A has TAB-IC input terminals 936 and 384-bit output terminals. The 384-bit outputs of the driver A are comprised of 192 bits connected to the signal lines D1 through D192 of the common-signal line A1 and the other 192 bits connected to the signal lines D193 through D384 of the common-signal line A2. The signal lines D1 through D192 are connected to the respective analog switches 928 in the switch blocks A11 through A14, and the signal lines D193 through D384 are connected to the respective analog switches 928 in the switch blocks A21 through A24. Gates of the analog switches 928 are connected to the control lines BL, and are controlled by control signals BL1 through BL4 supplied through the control lines BL. For example, the 384 analog switches 928 in the switch blocks A11 and A21 are controlled by the control signal BL1.

A TAB 938 of the driver A has the control lines BL extending therefrom for the purpose of conveying the signal lines BL1 through BL4, and, also, has gate-driver-control lines 940 extending therefrom which include 10 clock lines and power lines for the gate driver 922 provided on the left-hand side of the display matrix 924. On the right-hand side of the display matrix 924, the gate driver 923 is provided as shown in FIG. 34, and has gate-driver-control lines 940 thereof extending from the TAB of the driver D. The TAB 938 shown in FIG. 35 has a size such as 3.00 mm.

FIG. 36 is a table showing an example of design specifications of the liquid-crystal-display device 910.

FIG. 37 is a table showing control timings of switch blocks during one horizontal scan period Th of the liquid-crystal-display device 910.

In the liquid-crystal -display device 910, one horizontal scan period Th is comprised of 4 timing blocks BL1 through BL4. As the control signals BL1 through BL4 are successively supplied, the analog switches 928 are switched on in corresponding switch blocks selected from the switch blocks A11 through D24.

In what follows, operation of the liquid-crystal-display device 910 will be described with reference to the accompanying drawings.

Figure 38:
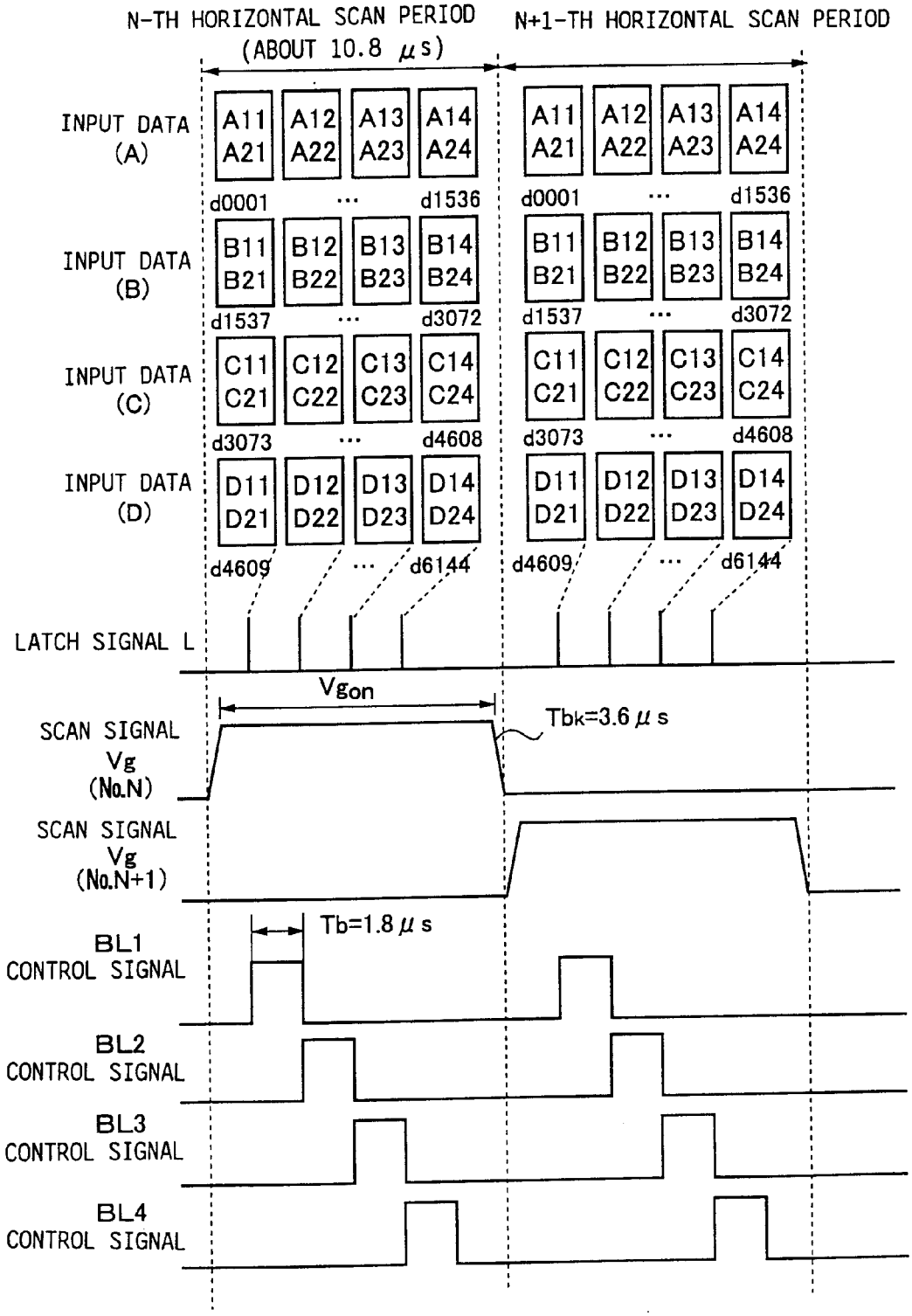
FIG. 38 is timing charts showing operation of the liquid-crystal-display device of FIG. 32.

FIG. 38 is timing charts showing operation of the liquid-crystal-display device 910.

As shown in FIG. 38, one horizontal scan period Th includes the four timing blocks BL1 through BL4. The horizontal scan period Th is approximately 10.8 $\mu$s, for example, and each of the timing blocks BL1 through BL8 has a time length Tb of about 1.8 $\mu$s. Further, one blanking interval Tbk is approximately 3.6 $\mu$s.

During the first timing block BL1, the control signal BL1 is supplied to the analog switches 928 of the switch blocks A11, A21, B11, B21, C11, C21, D11, and D21. As a result, a total of 1536 analog switches 928 are switched on. When this happens, the video signals Vs are supplied from the drivers A, B, C, and D to the pixel cells 926 as connections therebetween are established via the switched-on analog switches 928, thereby effecting the liquid-crystal display.

During the second timing block BL2, the control signal BL2 is supplied to the analog switches 928 of the switch blocks A12, A22, B12, B22, C12, C22, D12, and D22. As a result, a total of 1536 analog switches 928 are switched on. When this happens, the video signals Vs are supplied from the drivers A, B, C, and D to the pixel cells 926 as connections therebetween are established via the switched-on analog switches 928, thereby effecting the liquid-crystal display.

The operation as described above is repeated until the control signal BL4 is supplied to the analog switches 928 of the switch blocks A14, A24, B14, B24, C14, C24, D14, and D24, resulting in the video signals Vs being written in the corresponding 1536 pixel cells 926, which marks the end of the horizontal scan period Th.

It should be noted that the locations of the drivers A, B, C, and D are not limited to the specific locations as shown in FIG. 32 and 34, but may be modified in such an arrangement as shown in a liquid-crystal-display device 911 described below.

Figure 39:
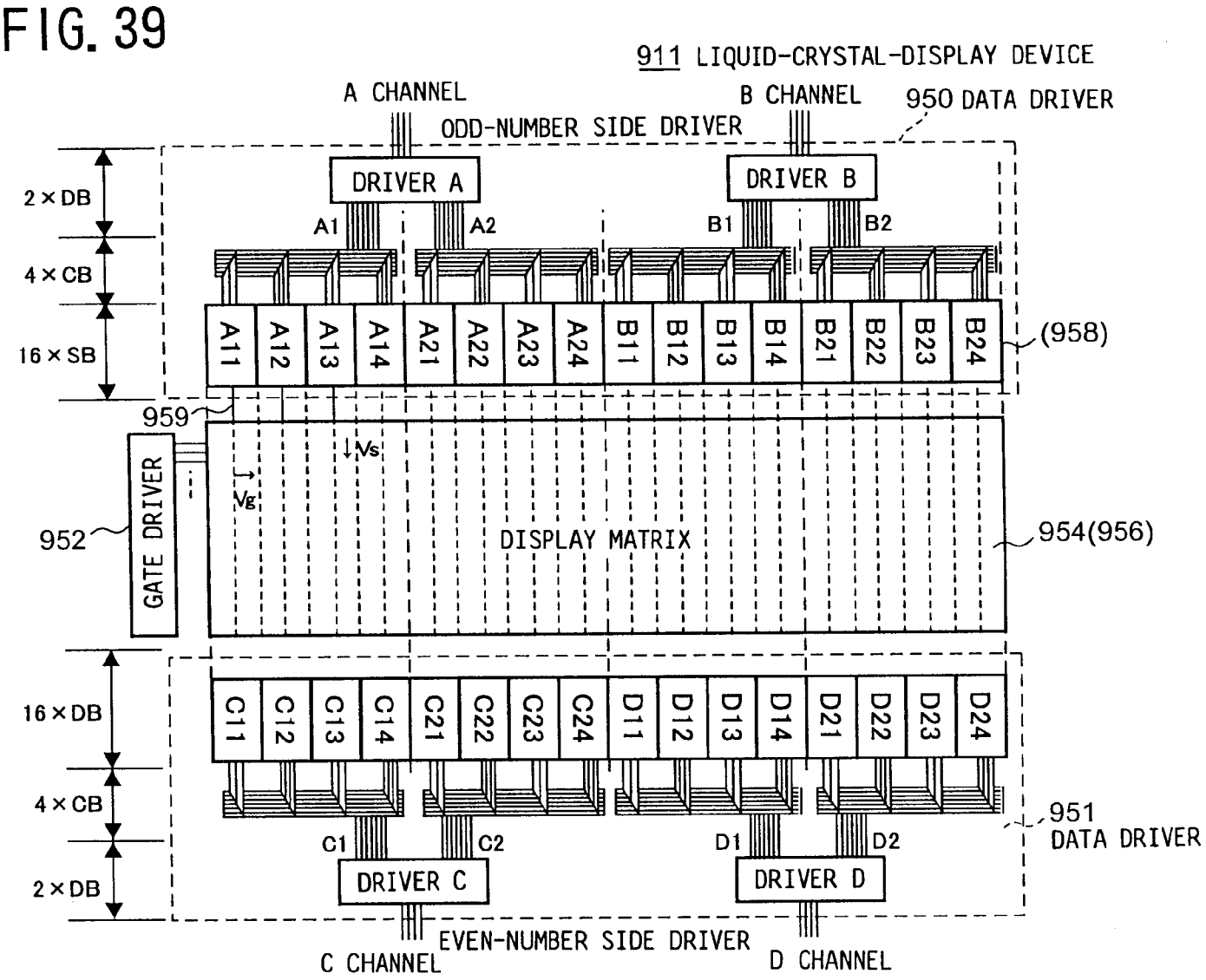
FIG. 39 is a block diagram of a liquid-crystal-display device according to an eleventh embodiment of the present invention.

FIG. 39 is a block diagram of a liquid-crystal-display device 911 according to an eleventh embodiment of the present invention.

As shown in FIG. 39, the liquid-crystal-display device 911 includes data drivers 950 and 951, a gate driver 952, and a display matrix 954. The liquid-crystal-display device 911 is an embodiment of the liquid-crystal-display device 50 shown in FIG. 3, with N=4, k=2, n=4, and m=192, which are the same configuration as that of the liquid-crystal-display device 910 shown in FIG. 32.

The liquid-crystal-display device 911 is of a multi-driver type, and may be characterized in that the two data drivers 950 and 951 are provided to face each other across the display matrix 954.

In the liquid-crystal-display device 911, 3072 analog switches 958 in the switch blocks A11 through A14, A21 through A24, B11 through B14, and B21 through B24 are connected to signal lines 959 arranged in odd-number rows in the display matrix 954. Further, 3072 analog switches 958 in the switch blocks C11 through C14, C21 through C24, D11 through D14, and D21 through D24 are connected to signal lines 959 arranged in even-number rows in the display matrix 954.

Other details and operations of the liquid-crystal-display device 911 are the same as those of the liquid-crystal-display device 910 shown in FIG. 32, and a description thereof will be omitted.

Figure 40:
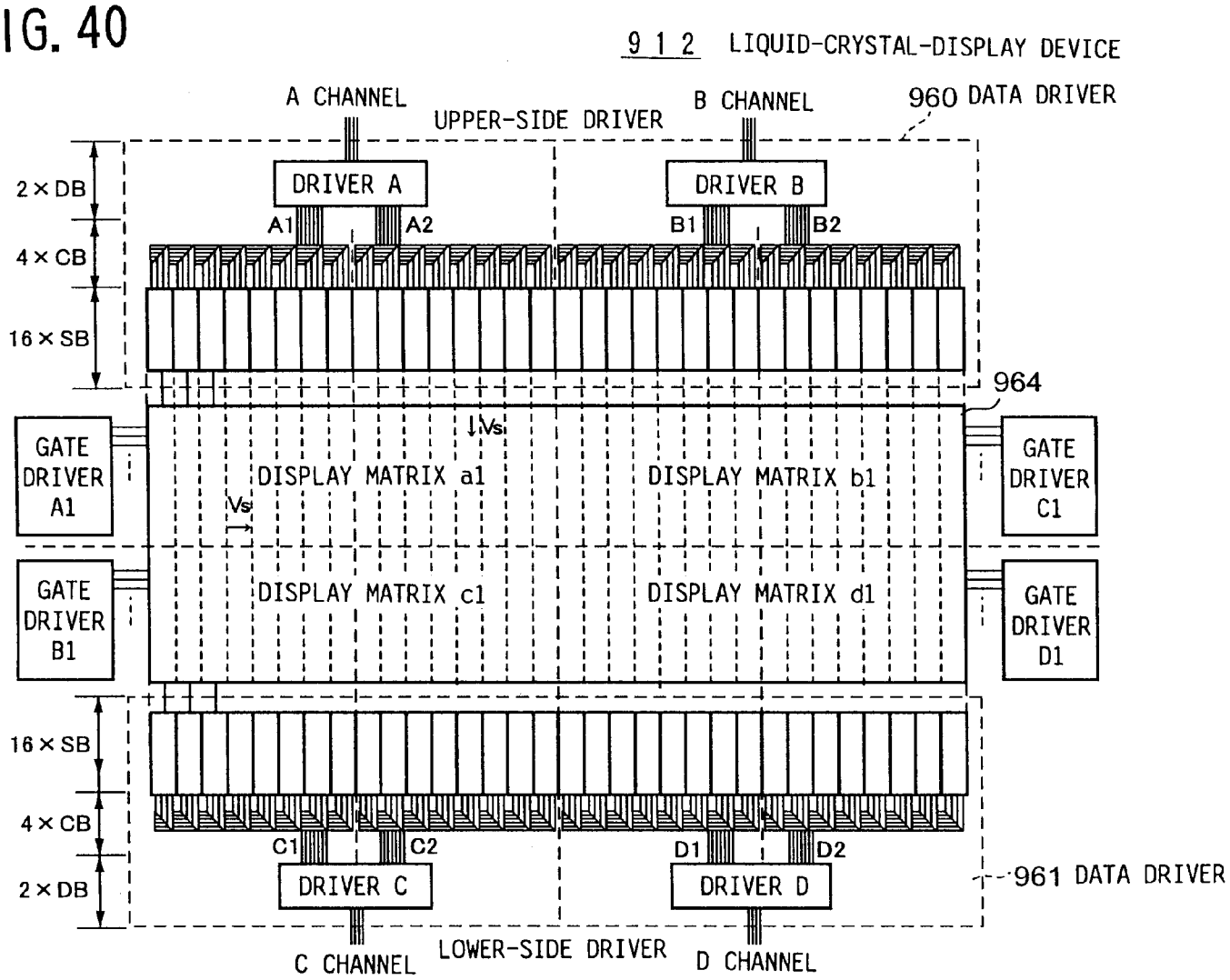
FIG. 40 is a block diagram showing an entire configuration of a liquid-crystal-display device of the QXGA type according to a twelfth embodiment of the present invention.

FIG. 40 is a block diagram showing an entire configuration of the liquid-crystal-display device 912 of the QXGA type according to a twelfth embodiment of the present invention.

As shown in FIG. 40, the liquid-crystal-display device 912 includes data drivers 960 and 961, gate drivers A1, B1, C1, and D1, and a display matrix 964. The liquid-crystal-display device 912 is an embodiment of the liquid-crystal-display device 50 shown in FIG. 3, with N=4, k=2, n=8, and m=192.

The liquid-crystal-display device 912 is of a multi-driver type, and may be characterized in that the two data drivers 960 and 961 are provided to face each other across the display matrix 964, and the four gate drivers A1, B1, C1, and D1 are provided.

The display matrix 964 includes four display matrixes a1, b1, c1, and d1. In the display matrix a1, the driver A and the gate driver A1 take care of displaying an image on the liquid-crystal display. By the same token, in the display matrix b1, the driver B and the gate driver B1 are responsible for displaying an image on the liquid-crystal display. In the display matrix c1, the driver C and the gate driver C1 attend to displaying of an image on the liquid-crystal display. Further, in the display matrix d1, the driver D and the gate driver D1 take care of displaying an image on the liquid-crystal display.

The liquid-crystal-display device 912 performs display operation thereof by following the same operation timings as those shown in FIG. 37 and FIG. 38. In the liquid-crystal-display device 912, the display matrixes al and b1 provided in the upper half and the display matrixes c1 and d1 provided in the lower half can be scanned simultaneously. Because of this, the horizontal scan period Th can be elongated to two times as long as that of the liquid-crystal-display device 910, which has only one data driver 920 on one side of the display matrix 924. In the liquid-crystal-display device 912, for example, the horizontal scan period Th can be set to 21.6 μs (=10.8 μs×2), and each of the timing blocks BL1 through BL8 can have a time length Tb of about 1.8 μs, with the blanking interval Tbk being approximately 5.6 μs.

In the following, a liquid-crystal-display device 913 of the QSXGA type according to a thirteenth embodiment of the present invention will be described with reference to FIG. 41 and FIG. 42.

Figure 41:
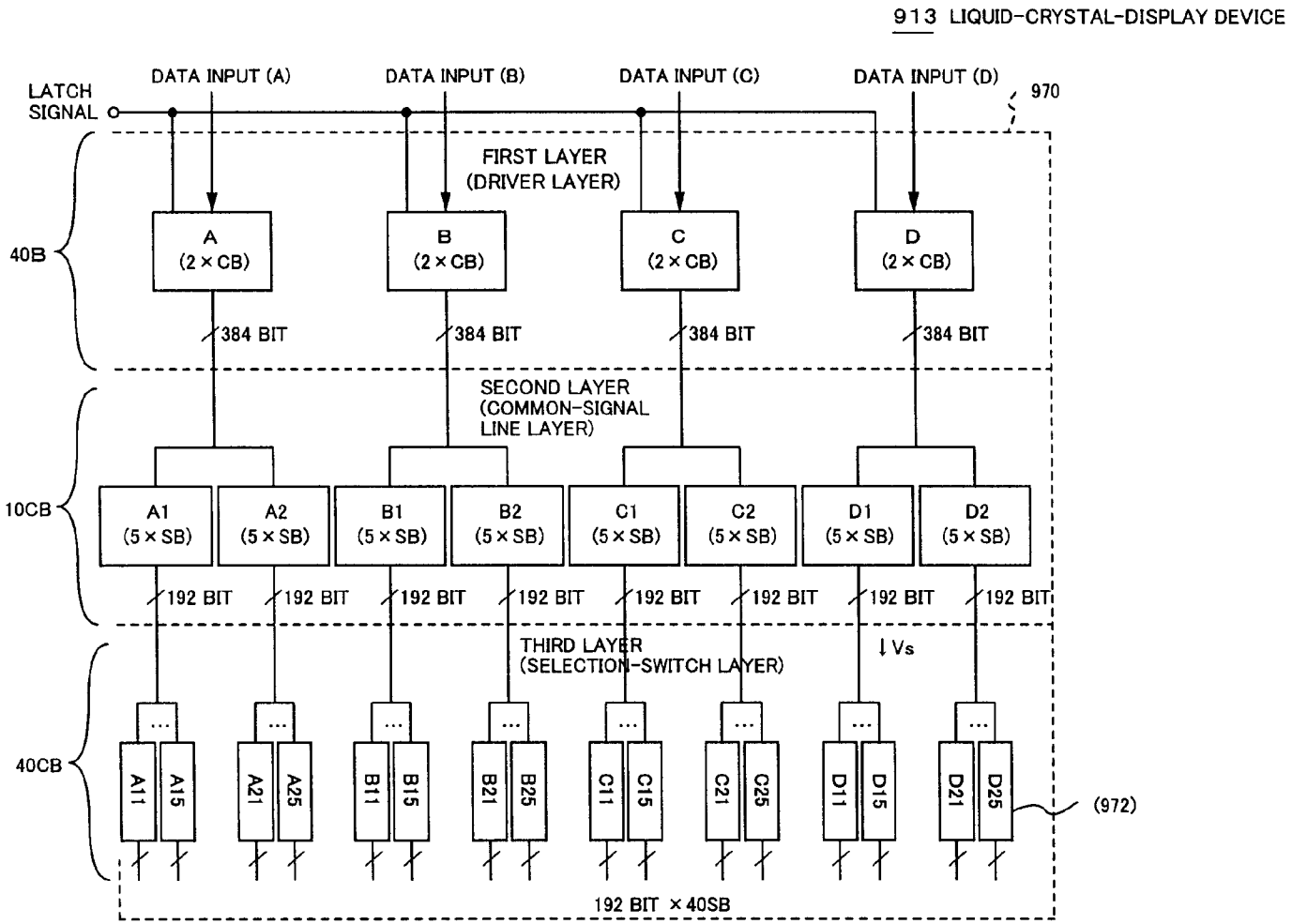
FIG. 41 is a block diagram of a data driver provided in a liquid-crystal-display device of a thirteenth embodiment.

FIG. 41 is a block diagram of a data driver 970 provided in the liquid-crystal-display device 913. As shown in FIG. 41, the data driver 970 includes TAB-implemented drivers A, B, C, and D in the first layer DB, 8 common-signal lines A1 through D2 each comprised of 192 bits in the second layer CB, and 40 switch blocks A11 through D25 in the third layer SB. Each of the switch blocks A11 through D25 includes 192 analog switches 972, which may be of a CMOS type.

Namely, the liquid-crystal-display device 913 is an embodiment of the liquid-crystal-display device 50 shown in FIG. 3, with N=4, k=2, n=5, and m=192. In total, the data driver 970 includes 7680 analog switches 972 where 7680 is 40×192. It should be noted that the analog switches 972 may be of an NMOS type or a PMOS type rather than the CMOS type.

Other details of the configuration of the liquid-crystal-display device 913 are the same as those of the liquid-crystal-display device 700 shown in FIG. 24, and a description thereof will be omitted.

FIG. 42 is a table showing control timings of switch blocks during one horizontal scan period Th of the liquid-crystal-display device 913.

In the liquid-crystal-display device 913, one horizontal scan period Th is comprised of 5 timing blocks BL1 through BL5. As the control signals BL1 through BL5 are successively supplied, the analog switches 972 are switched on in corresponding switch blocks selected from the switch blocks A11 through D25. During the first timing block BL1, for example, the control signal BL1 is supplied to the analog switches 972 of the switch blocks A11, A21, B11, B21, C11, C21, D11, and D21, so that a total of 1536 analog switches 972 are switched on.

During the timing block BL2 following the timing block BL1, the control signal BL2 is supplied to the analog switches 972 of the corresponding switch blocks, so that a total of 1536 analog switches 972 are switched on.

The operation as described above is repeated until the last timing block BL5, during which the control signal BL5 switches on a total of 1536 analog switches 972 in the corresponding switch blocks, which marks the end of the horizontal scan period Th. The video signals Vs are written in the activated pixel cells via the activated analog switches 972 during each of the timing blocks BL1 through BL5.

As described above, the liquid-crystal-display devices 910 through 913 of the tenth through thirteenth respective embodiments have the drivers A, B, C, and D each connected to the two common-signal lines, which are each comprised of 192 signal lines. Because of this configuration, the wiring width of the common-signal line is significantly reduced. When the wiring pitch of the common-signal line is 16 μm, for example, the common-signal lines D1 through D1536 of the related-art QXGA panel require the wiring width of 24.6 mm (16 μm×1536). On the other hand, the common-signal line of the liquid-crystal-display device 910 of the tenth embodiment requires only the wiring width of 3.07 mm (16 μm×192). This width is significantly narrower even in comparison with the wiring width of 6.1 mm of the fifth embodiment. In this manner, the present embodiments achieve a light-weight structure and miniaturization of panel-frame size by reducing the wiring width of common-signal lines.

In order to achieve a signal-writing speed of 1.8 μs/block in the related-art liquid-crystal-display device 10 of the QXGA type shown in FIG. 1, the display matrix 18 needs to be comprised of 4 blocks, and the data width of each block needs to be set to 1536 bits. In this case, the common-signal lines D1 through D1536 intersect with the lead lines 31 at 6140 (=(1536−1)×4) locations at the maximum.

On the other hand, the common-signal lines D1 through D192 of the liquid-crystal-display device 910 of the tenth embodiment, for example, intersect with lead lines at 764 (=(192−1)×4) locations at the maximum where the lead lines connect between the common-signal lines D1 through D192 and the analog switches 928. Assuming that capacitance per intersection is 5 fF, the total capacitance of the common-signal lines D1 through D1536 is 30.7 pF in the related-art configuration. Under the same assumption, the common-signal lines D1 through D192 of the tenth embodiment have the capacitance of 3.8 pF. This is half the capacitance of the common-signal lines D1 through D384 of the fifth embodiment since the capacitance of the fifth embodiment is 7.7 pF (=(384−1)×4×5). In this manner, the tenth through thirteenth embodiments described above can reduce the intersection capacitance of the common-signal lines A1 through D2 by a significant margin.

Further, the liquid-crystal-display devices of the tenth through thirteenth embodiments have the four drivers A, B, C, and D each connected to the two sets of common-signal lines, so that their horizontal extension becomes ⅛ of that of the related art. Because of this, the tenth through thirteenth embodiments can reduce the wiring resistance of the common-signal lines A1 through D2. For example, if a 15-inch QXGA panel has a pixel pitch of 0.1485 μm, a horizontal extension of the display matrix being 304 mm (0.1485 μm×2048), a wiring pitch of the common-signal lines being 16 μm, and a unit-length wiring-sheet resistance being 0.2 Ω, the total resistance would be 7.6 kΩ in the case of the related art. In contrast, the total resistance would be 0.95 kΩ in the case of the tenth embodiment, which is even lower than 1.9 kΩ of the fifth embodiment.

In this manner, the liquid-crystal-display devices of the tenth through thirteenth embodiments have the intersection capacitance and wiring resistance of the common-signal lines reduced in comparison with the related-art configuration, thereby achieving a significantly reduced RC time constant. For example, the time constant RC of the tenth embodiment is 3.6 ns (=0.95 kΩ×3.8 pF). This is 1/64 of the time constant RC of the QXGA-type related-art configuration in which the time constant RC is 233 ns (=7.6 kΩ×30.7 pF), and is 1/4 of the time constant RC of the fifth embodiment in which the time constant RC is 14.6 ns (=1.9 kΩ×7.7 pF).

In this manner, the tenth through thirteenth embodiments of the present invention can further improve the time constant, thereby further enhancing image quality in the liquid-crystal-display device.

In the above description, the liquid-crystal-display devices 100 and 200 of the first and second respective embodiments as well as the drivers A, B, C, and D provided in the liquid-crystal-display devices of the fifth through thirteenth embodiments have been described as being provided by TAB implementation. Notwithstanding such a description, they may be provided as an IC chip having a form of COG (chip-on-glass) implementation or COF (chip-on-film) implementation. Alternatively, they may be provided as p-SiTFT built-in drivers as in the liquid-crystal-display devices 300 and 400 of the third and fourth embodiments. Further, the liquid-crystal-display device may adopt the multi-domain-vertical arrangement (MVA) scheme and/or the in-phase-switching-mode (IPS) scheme so as to improve view angle characteristics.

Further, the present invention is not limited to these embodiments, but various variations and modifications may be made without departing from the scope of the present invention.

The present application is based on Japanese priority application No. 11-206822 filed on Jul. 21, 1999, with the Japanese Patent Office, the entire contents of which are hereby incorporated by reference.

What is claimed is:

1. A liquid-crystal-display device which displays an image on display matrix by supplying video signals to pixel cells of the display matrix, comprising:

a data driver supplying the video signals to the display matrix and including N digital drivers, N×k×n common-signal lines are connected to a corresponding one of the N digital drivers, and every n blocks of the N×k×n switch blocks are connected together to a corresponding one of the N×k common-signal lines, each of the common-signal lines being comprised of m lines and each of the switch blocks includes m selection switches, which couples the common-signal lines to the pixel cells of the display matrix.

2. The liquid-crystal-display device as claimed in claim 1, wherein one horizontal scan period includes n timing periods, during each of which one of said every n blocks of the N×k×n switch blocks is selected by a control signal, the digital drivers supplying the video signals to the pixel cells that are connected by the selection switches of the selected switch blocks.

3. The liquid-crystal-display device as claimed in claim 1, wherein said data driver includes first through third layers, the digital drivers being arranged in line in the first layer, the common-signal lines being arranged in line in the second layer, and the switch blocks being arranged in line in the third layer.

4. The liquid-crystal-display device as claimed in claim 1, wherein the digital drivers are provided in a TAB-implemented LSI chip, which includes n switch-block-control lines for supplying control signals to the switch blocks.

5. The liquid-crystal-display device as claimed in claim 4, wherein one of the digital drivers includes gate-driver-control lines for supplying control signals to a gate driver that provides scan signals to the display matrix.

6. The liquid-crystal-display device as claimed in claim 1, wherein the digital drivers are provided in a COG-implemented LSI chip or a COF-implemented LSI chip.

7. The liquid-crystal-display device as claimed in claim 1, wherein the digital drivers are provided as a panel-built-in circuit that is formed as an integral part of the display matrix via p-SiTFT.

8. The liquid-crystal-display device as claimed in claim 7, wherein said data driver further includes a block-selection circuit that supplies control signals to the switch blocks at predetermined timings, the block-selection circuit being formed as an integral part of the display matrix via p-SiTFT.

9. The liquid-crystal-display device as claimed in claim 1, wherein the selection switches are analog switches of a type selected from the group consisting of an NMOS type based on N-channel transistors, a PMOS type based on P-channel transistors, and a CMOS type based on N-channel transistors and P-channel transistors.

10. The liquid-crystal-display device as claimed in claim 1, wherein a number of the pixel cells of the display matrix in a horizontal direction is a multiple of an integer selected from the group consisting of 200, 240, 256, 300, and 384.

11. The liquid-crystal-display device as claimed in claim 1, further comprising another data driver situated to face said data driver across the display matrix, the two data drivers supply the video signals to respective pixel cells.

12. The liquid-crystal-display device as claimed in claim 11, wherein one of the two data drivers supply the video signals to the pixel cells connected to even-number signal lines in the display matrix, and another one of the two data drivers supply the video signals to the pixel cells connected to odd-number signal lines in the display matrix.

13. The liquid-crystal-display device as claimed in claim 1, further comprising two gate drivers which are situated on both sides of the display matrix, and which supply scan signals to respective pixel cells of the display matrix.

14. The liquid-crystal-display device as claimed in claim 1, further comprising a repair circuit which repairs defect signal lines in the display matrix.

15. The liquid-crystal-display device as claimed in claim 1, where displaying of the image is based on multi-domain-vertical-arrangement scheme.

16. The liquid-crystal-display device as claimed in claim 1, where displaying of the image is based on an in-phase-switching-mode scheme.

* * * * *